US009756884B2

(12) United States Patent
Turner

(10) Patent No.: US 9,756,884 B2
(45) **Date of Patent: *Sep. 12, 2017**

(54) ARTICLES OF APPAREL INCORPORATING CUSHIONING ELEMENTS AND METHODS OF MANUFACTURING THE ARTICLES OF APPAREL

(71) Applicant: NIKE, Inc., Beaverton, OR (US)

(72) Inventor: David Turner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/191,145

(22) Filed: Jun. 23, 2016

(65) Prior Publication Data

US 2016/0295936 A1 Oct. 13, 2016

Related U.S. Application Data

(60) Continuation of application No. 14/029,945, filed on Sep. 18, 2013, now Pat. No. 9,398,779, which is a (Continued)

(51) Int. Cl.
*A41D 13/015* (2006.01)
*A41D 13/05* (2006.01)
(Continued)

(52) U.S. Cl.
CPC ..... *A41D 13/015* (2013.01); *A41B 1/08* (2013.01); *A41D 1/06* (2013.01); *A41D 13/0015* (2013.01);
(Continued)

(58) Field of Classification Search
CPC ..... A41D 13/0562; A41D 13/0593; A41D 31/005; Y10T 156/1052
See application file for complete search history.

(56) References Cited

U.S. PATENT DOCUMENTS 921,352 A 5/1909 Blaker et al.
1,282,411 A 10/1918 Golembiowski
(Continued)

FOREIGN PATENT DOCUMENTS

CA 892301 2/1972
CA 2063814 A1 1/1991
(Continued)

OTHER PUBLICATIONS

Andrew Alderson, "A Triumph of Lateral Thought", in Chemistry & Industry, May 17, 1999; pp. 384-391.
(Continued)

*Primary Examiner* — Mark A Osele
*Assistant Examiner* — Christopher C Caillouet
(74) *Attorney, Agent, or Firm* — Shook, Hardy & Bacon L.L.P.

(57) ABSTRACT

A method of making articles of apparel that include a base layer having a first surface and an opposite second surface. The base layer is associated with a thermoplastic polymer element, then an aperture is formed through the base layer and the thermoplastic polymer element. A cushioning elements that may have a first material layer, a second material layer, and a plurality of foam components is positioned proximate the aperture. The first material layer and the second material layer are bonded to the second surface of the base layer. The foam components are located between and secured to the first material layer and the second material layer. In addition, the foam components are positioned to correspond with a location of the aperture.

20 Claims, 59 Drawing Sheets

Related U.S. Application Data division of application No. 13/035,592, filed on Feb. 25, 2011, now Pat. No. 8,561,214.

(51) Int. Cl.

| | |
|---|---|
| ***A41D 31/00*** | (2006.01) |
| ***A41B 1/08*** | (2006.01) |
| ***A41D 1/06*** | (2006.01) |
| ***A41D 13/00*** | (2006.01) |
| ***A41D 19/015*** | (2006.01) |
| ***A42B 3/06*** | (2006.01) |
| ***A43B 7/32*** | (2006.01) |
| ***A63B 71/12*** | (2006.01) |

(52) U.S. Cl.

CPC ..... *A41D 13/0156* (2013.01); *A41D 13/05* (2013.01); *A41D 13/0543* (2013.01); *A41D 13/0562* (2013.01); *A41D 13/0593* (2013.01); *A41D 19/01523* (2013.01); *A41D 31/005* (2013.01); *A42B 3/063* (2013.01); *A43B 7/32* (2013.01); *A63B 71/1225* (2013.01); *A41D 2400/22* (2013.01); *A63B 2071/1233* (2013.01); *A63B 2071/1241* (2013.01)

(56) References Cited

U.S. PATENT DOCUMENTS

| | | | |
|---|---|---|---|
| 1,910,810 | A | 5/1933 | Nash |
| 1,924,677 | A | 8/1933 | Cadgene |
| 2,266,886 | A | 12/1941 | McCoy |
| 2,569,398 | A | 9/1951 | Burd et al. |
| 2,723,214 | A | 11/1955 | Meyer |
| 2,738,834 | A | 3/1956 | Jaffe et al. |
| 2,751,609 | A | 6/1956 | Oesterling et al. |
| 2,785,739 | A | 3/1957 | McGregor, Jr. et al. |
| 3,012,926 | A | 12/1961 | Wintermute et al. |
| 3,020,186 | A | 2/1962 | Lawrence |
| 3,119,904 | A | 1/1964 | Anson |
| 3,137,746 | A | 6/1964 | Seymour et al. |
| 3,233,885 | A | 2/1966 | Propst |
| 3,258,800 | A | 7/1966 | Robinsky |
| 3,285,768 | A | 11/1966 | Habib |
| 3,293,671 | A | 12/1966 | Griffin |
| 3,305,423 | A | 2/1967 | Le Masson |
| 3,371,584 | A | 3/1968 | Zernov |
| 3,404,406 | A | 10/1968 | Balliet |
| 3,441,638 | A | 4/1969 | Ripon et al. |
| 3,465,364 | A | 9/1969 | Edelson |
| 3,471,865 | A | 10/1969 | Molitoris |
| 3,512,190 | A | 5/1970 | Buff |
| 3,515,625 | A | 6/1970 | Sedlak et al. |
| 3,647,505 | A | 3/1972 | Bjorn |
| 3,679,263 | A | 7/1972 | Cadiou |
| 3,722,355 | A | 3/1973 | King |
| 3,746,602 | A | 7/1973 | Giuffrida et al. |
| 3,746,605 | A | 7/1973 | Dillon et al. |
| 3,775,526 | A | 11/1973 | Gilmore |
| 3,832,265 | A | 8/1974 | Denommee |
| 3,867,238 | A | 2/1975 | Johannsen et al. |
| 3,867,239 | A | 2/1975 | Alesi et al. |
| 3,877,353 | A | 4/1975 | Smith et al. |
| 3,882,547 | A | 5/1975 | Morgan |
| 3,911,185 | A | 10/1975 | Wright, Jr. |
| 3,914,487 | A | 10/1975 | Azoulay |
| 3,922,329 | A | 11/1975 | Kim et al. |
| 3,977,406 | A | 8/1976 | Roth |
| 4,023,213 | A | 5/1977 | Rovani |
| 4,126,177 | A | 11/1978 | Smith et al. |
| 4,136,222 | A | 1/1979 | Jonnes |
| 4,138,283 | A | 2/1979 | Hanusa |
| 4,181,554 | A | 1/1980 | Rich |
| 4,190,696 | A | 2/1980 | Fuoco et al. |
| 4,197,342 | A | 4/1980 | Bethe |
| 4,249,302 | A | 2/1981 | Crepeau |
| 4,255,552 | A | 3/1981 | Schollenberger |
| 4,305,716 | A | 12/1981 | Nickum et al. |
| 4,422,183 | A | 12/1983 | Landi et al. |
| 4,440,525 | A | 4/1984 | Perla |
| 4,482,592 | A | 11/1984 | Kramer |
| 4,485,919 | A | 12/1984 | Sandel |
| 4,493,865 | A | 1/1985 | Kuhlmann et al. |
| 4,507,801 | A | 4/1985 | Kavanagh et al. |
| 4,512,037 | A | 4/1985 | Vacanti |
| 4,516,273 | A | 5/1985 | Gregory et al. |
| 4,534,354 | A | 8/1985 | Bonner, Jr. et al. |
| 4,538,301 | A | 9/1985 | Sawatzki et al. |
| 4,559,251 | A | 12/1985 | Wachi |
| 4,581,186 | A | 4/1986 | Larson et al. |
| 4,631,221 | A | 12/1986 | Disselbeck et al. |
| 4,642,814 | A | 2/1987 | Godfrey |
| 4,646,367 | A | 3/1987 | El Hassen |
| 4,692,199 | A | 9/1987 | Kozlowski et al. |
| 4,713,854 | A | 12/1987 | Graebe |
| 4,718,214 | A | 1/1988 | Waggoner |
| 4,730,761 | A | 3/1988 | Spano |
| 4,734,306 | A | 3/1988 | Lassiter |
| 4,756,026 | A | 7/1988 | Pierce, Jr. |
| 4,774,724 | A | 10/1988 | Sacks |
| 4,780,167 | A | 10/1988 | Hill |
| 4,809,374 | A | 3/1989 | Saviez |
| 4,852,274 | A | 8/1989 | Wilson |
| 4,856,393 | A | 8/1989 | Braddon |
| 4,867,826 | A | 9/1989 | Wayte |
| 4,884,295 | A | 12/1989 | Cox |
| 4,964,936 | A | 10/1990 | Ferro |
| 4,982,447 | A | 1/1991 | Henson |
| 4,985,933 | A | 1/1991 | Lemoine |
| 4,989,265 | A | 2/1991 | Nipper et al. |
| 4,991,230 | A | 2/1991 | Vacanti |
| 5,007,111 | A | 4/1991 | Adams |
| 5,020,156 | A | 6/1991 | Neuhalfen |
| 5,020,157 | A | 6/1991 | Dyer |
| 5,029,341 | A | 7/1991 | Wingo, Jr. |
| 5,030,501 | A | 7/1991 | Colvin et al. |
| 5,042,318 | A | 8/1991 | Franz |
| 5,052,053 | A | 10/1991 | Peart et al. |
| 5,060,313 | A | 10/1991 | Neuhalfen |
| 5,071,698 | A | 12/1991 | Scheerder et al. |
| 5,129,295 | A | 7/1992 | Geffros et al. |
| 5,160,785 | A | 11/1992 | Davidson, Jr. |
| 5,168,576 | A | 12/1992 | Krent et al. |
| 5,188,879 | A | 2/1993 | Hill et al. |
| 5,214,797 | A | 6/1993 | Tisdale |
| 5,232,762 | A | 8/1993 | Ruby |
| 5,233,767 | A | 8/1993 | Kramer |
| 5,274,846 | A | 1/1994 | Kolsky |
| 5,289,830 | A | 3/1994 | Levine et al. |
| 5,322,730 | A | 6/1994 | Ou |
| 5,325,537 | A | 7/1994 | Marion et al. |
| 5,349,893 | A | 9/1994 | Dunn |
| 5,353,455 | A | 10/1994 | Loving et al. |
| 5,360,653 | A | 11/1994 | Ackley |
| 5,380,392 | A | 1/1995 | Imamura et al. |
| 5,399,418 | A | 3/1995 | Hartmanns et al. |
| 5,405,665 | A | 4/1995 | Shukushima et al. |
| 5,407,421 | A | 4/1995 | Goldsmith |
| 5,423,087 | A | 6/1995 | Krent et al. |
| 5,452,477 | A | 9/1995 | Mann |
| 5,459,896 | A | 10/1995 | Raburn et al. |
| 5,477,558 | A | 12/1995 | Volker et al. |
| 5,534,208 | A | 7/1996 | Barr et al. |
| 5,534,343 | A | 7/1996 | Landi et al. |
| 5,551,082 | A | 9/1996 | Stewart et al. |
| 5,594,954 | A | 1/1997 | Huang |
| 5,601,895 | A | 2/1997 | Cunningham |
| 5,614,301 | A | 3/1997 | Katz |
| 5,628,063 | A | 5/1997 | Reed et al. |
| 5,675,844 | A | 10/1997 | Guyton et al. |
| 5,689,836 | A | 11/1997 | Fee et al. |
| 5,692,935 | A | 12/1997 | Smith |
| 5,697,101 | A | 12/1997 | Aldridge |
| 5,720,714 | A | 2/1998 | Penrose et al. |
| 5,727,252 | A | 3/1998 | Oetting et al. |

(56) References Cited

U.S. PATENT DOCUMENTS

| | | | |
|---|---|---|---|
| 5,738,925 | A | 4/1998 | Chaput |
| 5,780,147 | A | 7/1998 | Sugahara et al. |
| 5,823,981 | A | 10/1998 | Grim et al. |
| 5,915,819 | A | 6/1999 | Gooding |
| 5,920,915 | A | 7/1999 | Bainbridge et al. |
| 5,938,878 | A | 8/1999 | Hurley et al. |
| 5,940,888 | A | 8/1999 | Sher |
| 5,987,643 | A | 11/1999 | Beutler et al. |
| 6,041,447 | A | 3/2000 | Endler et al. |
| 6,053,005 | A | 4/2000 | Boitnott |
| 6,070,267 | A | 6/2000 | McKewin et al. |
| 6,070,273 | A | 6/2000 | Sgro et al. |
| 6,085,353 | A | 7/2000 | van der Sleesen et al. |
| 6,093,468 | A | 7/2000 | Toms et al. |
| 6,167,790 | B1 | 1/2001 | Bambara et al. |
| 6,219,852 | B1 | 4/2001 | Bain et al. |
| 6,235,661 | B1 | 5/2001 | Khanamirian |
| 6,253,376 | B1 | 7/2001 | Ritter |
| 6,295,654 | B1 | 10/2001 | Farrell |
| 6,301,722 | B1 | 10/2001 | Nickerson et al. |
| 6,317,888 | B1 | 11/2001 | McFarlane |
| 6,374,409 | B1 | 4/2002 | Galy |
| 6,485,448 | B2 | 11/2002 | Lamping et al. |
| 6,584,616 | B2 | 7/2003 | Godshaw et al. |
| 6,654,960 | B2 | 12/2003 | Cho |
| 6,654,962 | B2 | 12/2003 | DeMott |
| 6,743,325 | B1 | 6/2004 | Taylor |
| 6,820,279 | B2 | 11/2004 | Lesosky |
| 6,841,022 | B2 | 1/2005 | Tsukagoshi et al. |
| 6,851,124 | B2 | 2/2005 | Munoz |
| 6,968,573 | B2 | 11/2005 | Silver |
| 6,969,548 | B1 | 11/2005 | Goldfine |
| 7,007,356 | B2 | 3/2006 | Cudney et al. |
| 7,018,351 | B1 | 3/2006 | Iglesias et al. |
| 7,114,189 | B1 | 10/2006 | Kleinert |
| RE42,689 | E | 9/2011 | Taylor |
| RE43,441 | E | 6/2012 | Taylor |
| 8,231,756 | B2 | 7/2012 | Kim |
| 8,425,712 | B2 | 4/2013 | Turner |
| 8,561,214 | B2 | 10/2013 | Turner |
| 2005/0181183 | A1 | 8/2005 | Pacey |
| 2006/0199456 | A1 | 9/2006 | Taylor |
| 2006/0280547 | A1 | 12/2006 | Wyatt |
| 2007/0000005 | A1 | 1/2007 | Wang |
| 2008/0245469 | A1 | 10/2008 | Lin |
| 2008/0264557 | A1 | 10/2008 | Kim |
| 2008/0290556 | A1 | 11/2008 | Kim |
| 2009/0008142 | A1 | 1/2009 | Shimizu et al. |
| 2009/0070911 | A1 | 3/2009 | Chang |
| 2009/0155536 | A1 | 6/2009 | Chang |
| 2009/0165193 | A1 | 7/2009 | Michel et al. |
| 2009/0233511 | A1 | 9/2009 | Turner |
| 2009/0321002 | A1 | 12/2009 | Spengler |
| 2010/0129573 | A1 | 5/2010 | Kim |
| 2010/0192280 | A1 | 8/2010 | McClard et al. |
| 2010/0193117 | A1 | 8/2010 | Kim |
| 2010/0205716 | A1 | 8/2010 | Kim |
| 2010/0205722 | A1 | 8/2010 | Kim |
| 2010/0206472 | A1 | 8/2010 | Kim |
| 2011/0061154 | A1 | 3/2011 | Turner et al. |
| 2011/0209267 | A1 | 9/2011 | Rush et al. |
| 2011/0247744 | A1 | 10/2011 | Turner |

FOREIGN PATENT DOCUMENTS

| | | | |
|---|---|---|---|
| CA | 2162723 | A1 | 11/1994 |
| CA | 2289622 | A1 | 11/1998 |
| CH | 638665 | A5 | 10/1983 |
| CN | 2225163 | Y | 4/1996 |
| CN | 2305870 | Y | 2/1999 |
| DE | 3119489 | A1 | 12/1982 |
| DE | 3530397 | A1 | 3/1987 |
| DE | 9102039 | U1 | 2/1991 |
| DE | 4336468 | A1 | 4/1995 |
| EP | 0083454 | A1 | 10/1988 |
| EP | 0552304 | A1 | 7/1993 |
| EP | 0595887 | B1 | 12/1998 |
| EP | 1175840 | A2 | 1/2002 |
| FR | 2740303 | A1 | 4/1997 |
| FR | 2903579 | A1 | 1/2008 |
| GB | 832101 | | 4/1960 |
| GB | 1274569 | | 5/1972 |
| GB | 2120167 | A | 11/1983 |
| GB | 2177892 | A | 2/1987 |
| GB | 2233877 | A | 1/1991 |
| GB | 2477510 | A | 8/2011 |
| JP | 1316235 | | 12/1989 |
| JP | 10337797 | | 12/1989 |
| JP | 2508289 | Y2 | 8/1996 |
| JP | 10053905 | | 2/1998 |
| JP | 2000136414 | A | 5/2000 |
| WO | 9205717 | A1 | 4/1992 |
| WO | 9723142 | A1 | 7/1997 |
| WO | 9733403 | A1 | 9/1997 |
| WO | 9733493 | A1 | 9/1997 |
| WO | 9736740 | A1 | 10/1997 |
| WO | 9934972 | A1 | 7/1999 |
| WO | 9935926 | A1 | 7/1999 |
| WO | 0050336 | A1 | 8/2000 |
| WO | 0103530 | A1 | 1/2001 |
| WO | 0115892 | A1 | 3/2001 |
| WO | 0216124 | A1 | 2/2002 |
| WO | 02081202 | A1 | 10/2002 |
| WO | 2006036072 | A1 | 4/2006 |
| WO | 2006088734 | A1 | 8/2006 |
| WO | 2008044015 | A1 | 4/2008 |
| WO | 2010104868 | A2 | 9/2010 |

OTHER PUBLICATIONS

Burke, "A Stretch of the Imagination", New Scientist Magazine, vol. 154 issue 2085, Jul. 6, 1997 at p. 36 (available from research.dh.umu.se/dynamic/artiklar/shape/stretch.html, last accessed Nov. 11, 2013).

Joseph Hamill & Carolyn K. Bensel, "Biomechanical Analysis of Military Boots: Phase III", in United States Army Technical Report NATICKITR-96.013; dated Mar. 11, 1996; 42 pages.

Joseph F. Annis & Paul Webb, "Development of a Space Activity Suit", in NASA Contractor Report NASA CR-1892; dated Nov. 1971; 139 pages.

ARTICLES OF APPAREL INCORPORATING CUSHIONING ELEMENTS AND METHODS OF MANUFACTURING THE ARTICLES OF APPAREL

CROSS-REFERENCE TO RELATED APPLICATION

This application is a continuation of U.S. application Ser. No. 14/029,945 (filed on Sep. 18, 2013, and issued as U.S. Pat. No. 9,398,779), which is a divisional of allowed U.S. application Ser. No. 13/035,592 (filed Feb. 25, 2011, and issued as U.S. Pat. No. 8,561,214). Each of U.S. application Ser. Nos. 13/035,592 and 14/029,945 is hereby incorporated by reference in its entirety.

BACKGROUND

Materials or elements that impart padding, cushioning, or otherwise attenuate impact forces are commonly incorporated into a variety of products. Athletic apparel, for example, often incorporates cushioning elements that protect the wearer from contact with other athletes, equipment, or the ground. More specifically, pads used in American football and hockey incorporate cushioning elements that provide impact protection to various parts of a wearer. Helmets utilized during American football, hockey, bicycling, skiing, snowboarding, and skateboarding incorporate cushioning elements that provide head protection during falls or crashes. Similarly, gloves utilized in soccer (e.g., by goalies) and hockey incorporate cushioning elements that provide protection to the hands of a wearer. In addition to apparel, mats (e.g., for yoga or camping), chair cushions, and backpacks, for example, all incorporate cushioning elements to enhance comfort.

SUMMARY

Various articles of apparel that incorporate cushioning elements are disclosed below. In general, the apparel may include a base layer having a first surface and an opposite second surface. The base layer defines an aperture extending through the base layer and from the first surface to the second surface. The cushioning elements may have a first material layer, a second material layer, and a plurality of foam components. The first material layer and the second material layer are bonded to the second surface of the base layer. The foam components are located between and secured to the first material layer and the second material layer. In addition, the foam components are positioned to correspond with a location of the aperture. In some configurations, a bonding element may be utilized to bond the first material layer and the second material layer to the base layer.

Methods for manufacturing the articles of apparel are also disclosed below. In one example, a method includes bonding a thermoplastic polymer element to a base layer. An aperture is formed through the thermoplastic polymer element and the base layer. A plurality of foam components are secured between a first material layer and a second material layer. Additionally, the first material layer and the second material layer are bonded to the thermoplastic polymer element to join the base layer with the first material layer and the second material layer.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various articles of apparel (e.g., shorts, pants, shirts, wraps, gloves, helmets, and footwear) that incorporate cushioning elements. Additionally, the following discussion and accompanying figures disclose various processes associated with manufacturing the apparel and cushioning elements.

Apparel Configuration

Figure 1:
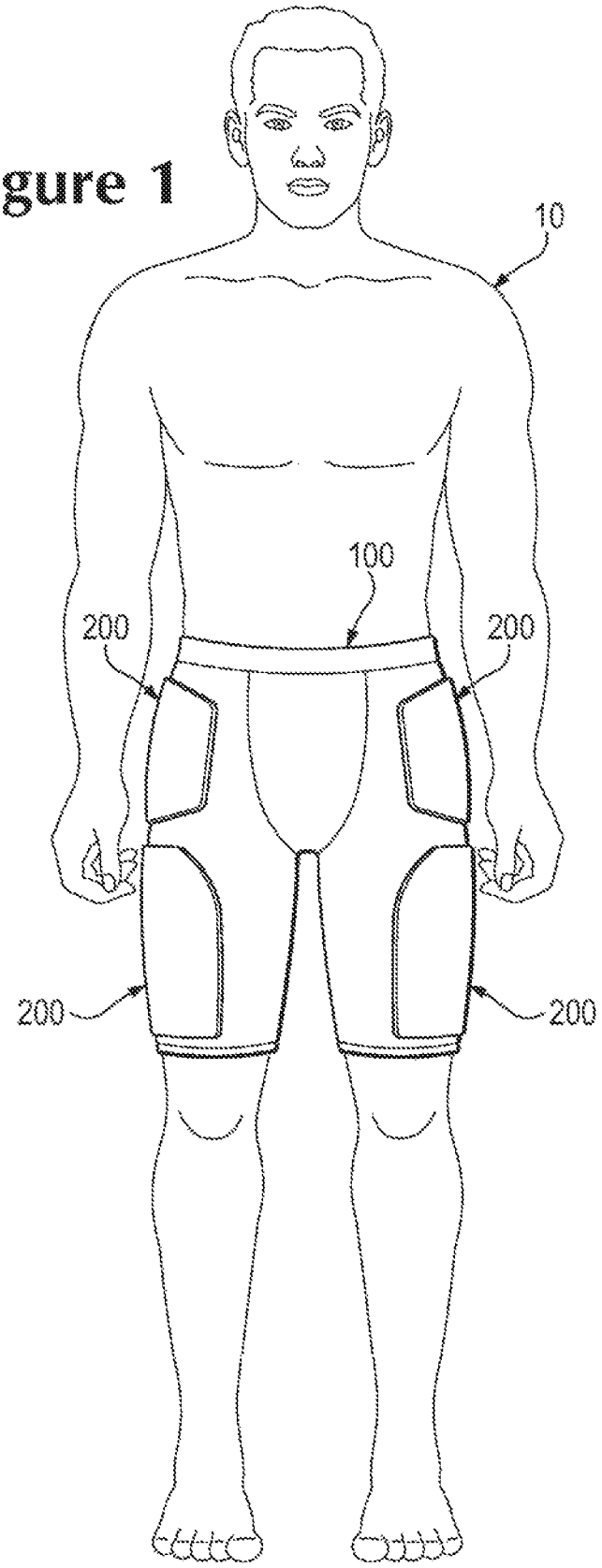
FIG. 1 is a front elevational view of an individual wearing an article of apparel.
Figure 2:
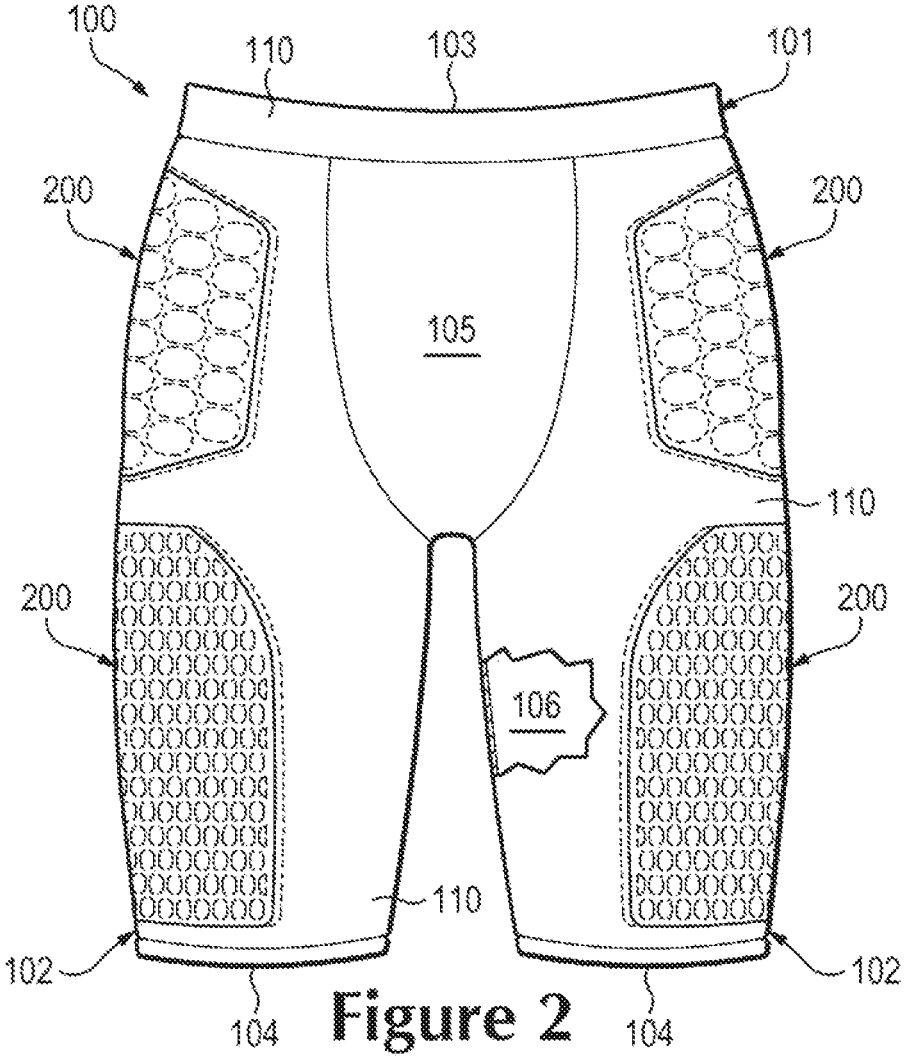
FIG. 2 is a front elevational view of article of apparel.
Figure 3:
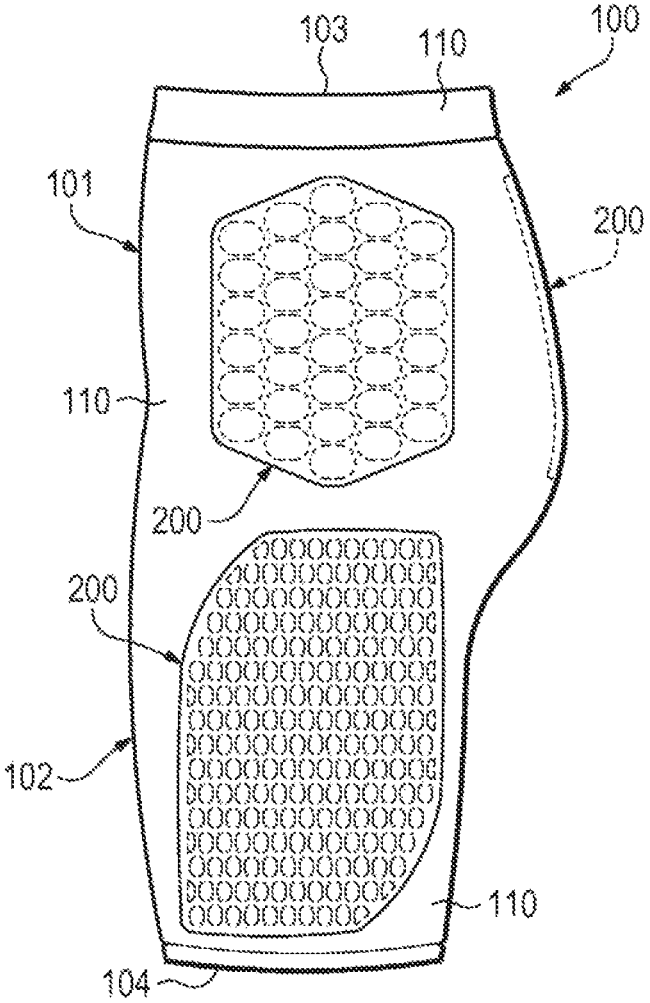
FIGS. 3 and 4 are side elevational views of the article of apparel.
Figure 4:
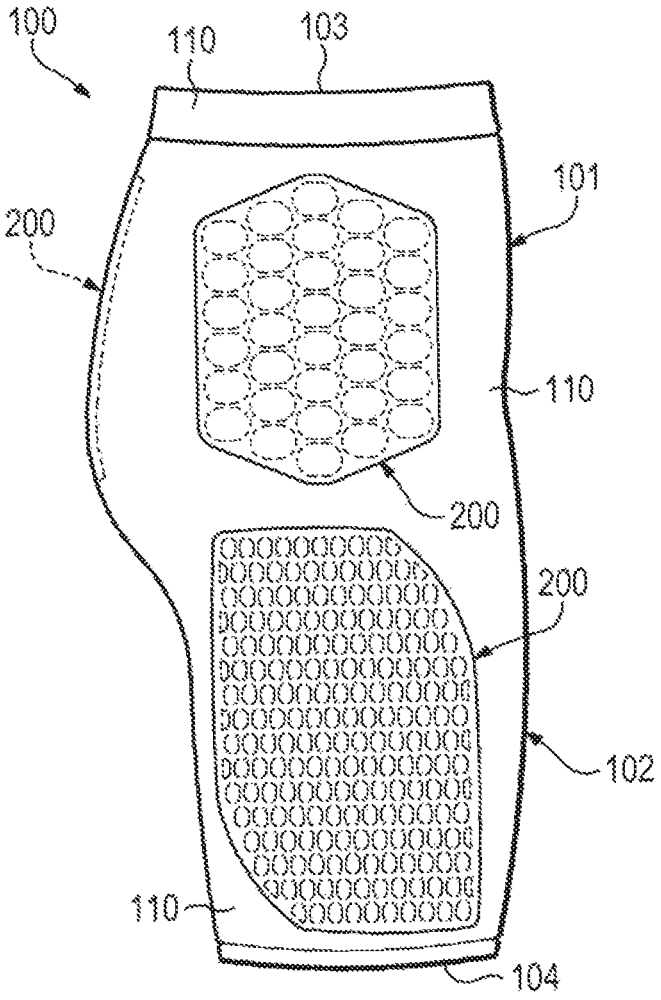
Figure 5:
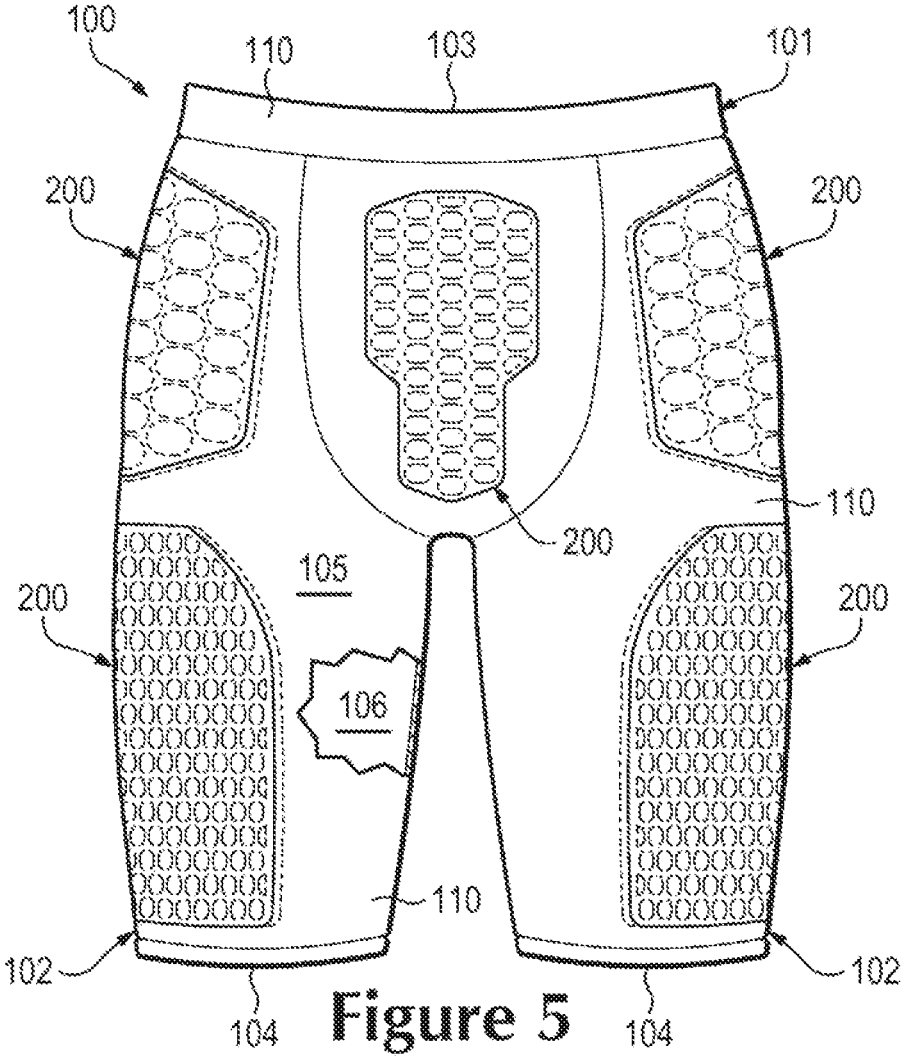
FIG. 5 is a rear elevational view of the article of apparel.
Figure 6:
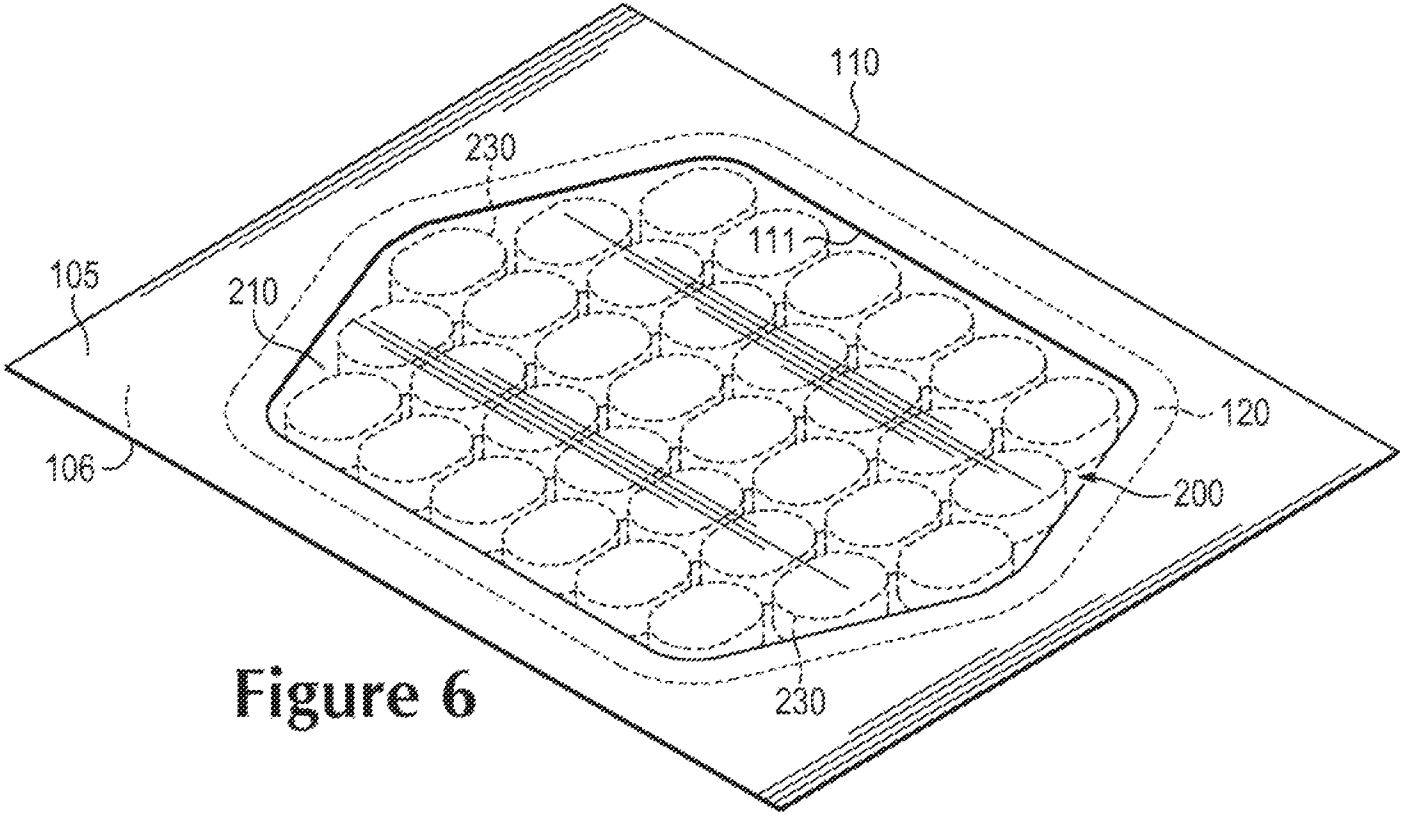
FIG. 6 is a perspective view of a portion of the apparel including a cushioning element.

With reference to FIG. 1, an individual 10 is depicted as wearing article of apparel 100 with the general configuration of a shorts-type garment. Although apparel 100 may be worn under other articles of apparel, apparel 100 may be worn alone, may be exposed, or may be worn over other articles of apparel. Apparel 100 may also be worn in combination with other pieces of equipment (e.g., athletic or protective equipment). Accordingly, the configuration of apparel 100 and the manner in which apparel 100 is worn by individual 10 may vary significantly.

Apparel 100 is depicted individually in FIGS. 2-5 as including a pelvic region 101 and pair of leg regions 102 that extend outward from pelvic region 101. Pelvic region 101 corresponds with a pelvic area of individual 10 and covers at least a portion of the pelvic area when worn. An upper area of pelvic region 101 defines a waist opening 103 that extends around a waist of individual 10 when apparel 100 is worn. Leg regions 102 correspond with a right leg and left leg of individual 10 and cover at least a portion of the right leg and the left leg when worn. Lower areas of leg regions 102 each define a thigh opening 104 that extends around a thigh of individual 10 when apparel 100 is worn.

The primary elements forming apparel 100 are a base layer 110 and a plurality of cushioning elements 200. Base layer 110 extends throughout apparel 100 and forms areas of pelvic region 101 and both of leg regions 102, as well as defining waist opening 103 and thigh opening 104. Although base layer 110 may be a single element of textile or other material, base layer 110 may also be a plurality of joined elements. Additionally, base layer 110 defines an exterior surface 105 that faces away from individual 10 when apparel 100 is worn, and base layer 110 defines an opposite interior surface 106 that faces toward individual 10 and may contact individual 10 when apparel 100 is worn.

Cushioning elements 200 are incorporated into various area of apparel 100 to impart padding, cushioning, or otherwise attenuate impact forces. When apparel 100 is worn during athletic activities, for example, cushioning elements 200 may protect individual 10 from contact with other athletes, equipment, or the ground. With regard to apparel 100, cushioning elements 200 are located in both of pelvic region 101 and leg regions 102 and are positioned, more specifically, to protect the hips, thighs, and tailbone of individual 10. As described in greater detail below, cushioning elements 200 may be incorporated into a variety of different articles of apparel, and cushioning elements 200 may be positioned in various areas of the articles of apparel to protect specific portions (e.g., muscles, bones, joints, impact areas) of individual 10. Additionally, the shapes, sizes, and other properties of cushioning elements 200, as well as the materials and components utilized in cushioning elements 200, may vary significantly to provide a particular level of protection to the specific portions of individual 10. Although cushioning elements 200 may be located within apparel 100 and not visible, cushioning elements 200 are depicted as forming portions of an exterior and an interior of apparel 100.

Cushioning Element Configure

A portion of apparel 100 that includes one of cushioning elements 200 is depicted in FIGS. 6-9B. Base layer 110 defines an aperture 111 that extends from exterior surface 105 to interior surface 106, thereby extending through base layer 110. Cushioning element 200 is located proximal to aperture 111 and is secured to base layer 110. More particularly, cushioning element 200 is secured to interior surface 106 with a bonding element 120 and is exposed through aperture 111.

Cushioning element 200 includes a first material layer 210, a second material layer 220, and a plurality of pad components 230 that are secured to each of material layers 210 and 220. First material layer 210 and second material layer 220 cooperatively form an outer surface or covering for cushioning element 200. That is, first material layer 210 and second material layer 220 cooperatively form a pocket or void, in which pad components 230 are located. Although cushioning element 200 may be incorporated into apparel 100 in a variety of ways, first material layer 210 is depicted as being exposed through aperture 111, second material layer 220 is depicted as being located inward from first material layer 210, and pad components 230 are depicted as being positioned to correspond with the location of aperture 111.

Figure 9A:
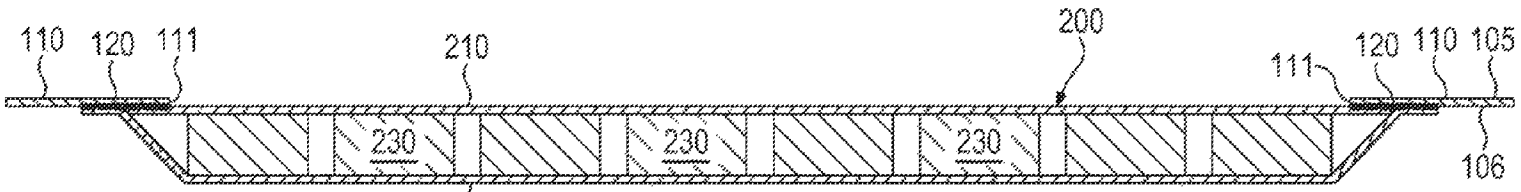
FIGS. 9A and 9B are cross-sectional views of the portion of the apparel, as defined by section lines 9A and 9B in FIG. 8.
Figure 9B:
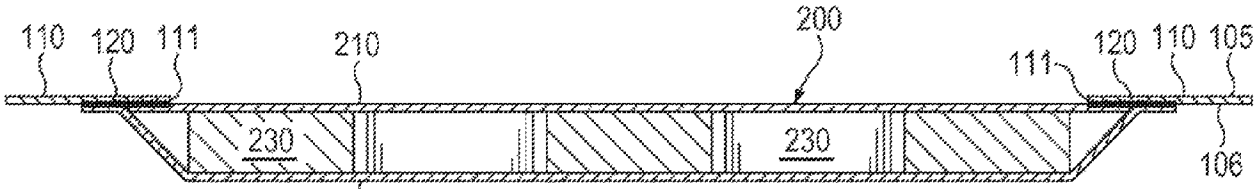
Figure 9C:
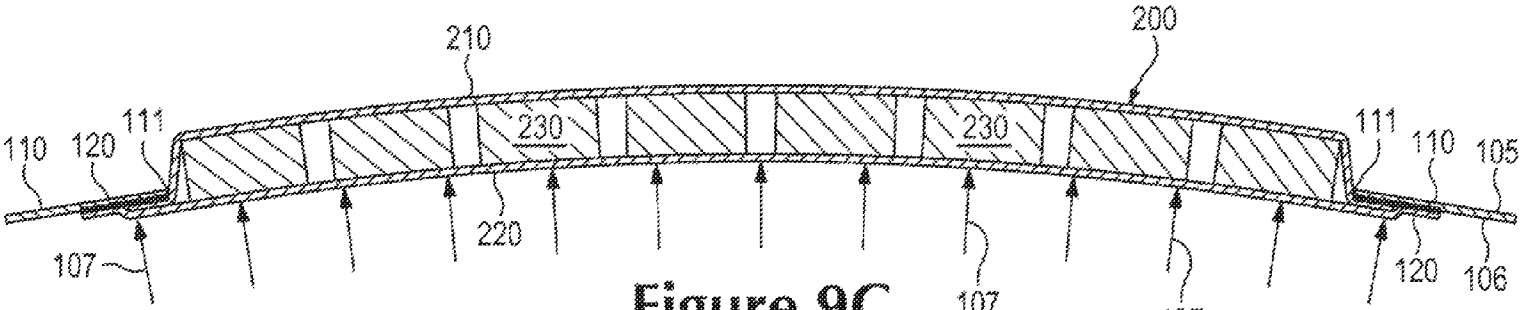
FIG. 9C is a cross-sectional view corresponding with FIG. 9A and depicting another configuration of the portion of the apparel.

Both of material layers 210 and 220 are secured to the portion of base layer 110 forming interior surface 106 with bonding element 120. Referring to FIGS. 9A and 9B, first material layer 210 is secured to a portion of bonding element 120 that is adjacent to aperture 111 and second material layer 220 is secured to a portion of bonding element 120 that is spaced from aperture 111. In this configuration, the area of second material layer 220 may be greeter than the area of first material layer 210. That is, second material layer 220 is secured to a more outward portion of base layer 110 (i.e., the portion that is spaced from aperture 111) than first material layer 210 and may have greater area.

A variety of materials may be utilized for first material layer 210 and second material layer 220, including various textiles, polymer sheets, leather, or synthetic leather, for example. Combinations of these materials (e.g., a polymer sheet bonded to a textile) may also be utilized for material layers 210 and 220. Although material layers 210 and 220 may be formed from the same material, each of material layers 210 and 220 may also be formed from different materials. With regard to textiles, material layers 210 and 220 may be formed from knitted, woven, non-woven, spacer, or mesh textile components that include rayon, nylon, polyester, polyacrylic, elastane, cotton, wool, or silk, for example. Moreover, the textiles may be non-stretch, may exhibit one-directional stretch, or may exhibit multi-directional stretch. Accordingly, a variety of materials are suitable for material layers 210 and 220.

Pad components 230 are located between and secured (e.g., bonded) to each of material layers 210 and 220. In addition, pad components 230 are positioned to correspond with the location of aperture 111. That is, pad components 230 are generally positioned adjacent to aperture 111 and may be positioned such that aperture 111 effectively extends around pad components 230. Although the shapes of pad components 230 may vary significantly, the surfaces that are secured material layers 210 and 220 are depicted as having an elliptical or generally elongate shape with rounded end areas, and side surface of pad components 230 extend in a generally straight fashion between material layers 210 and 220. Pad components 230 are also depicted as being spaced evenly from each other and arranged in rows, particularly offset rows, but may be spaced or located in a variety of arrangements. An advantage of arranging pad components 230 in offset rows is that the area between pad components 230 is effectively minimized, while retaining a regular spacing between adjacent pad components 230.

A variety of materials may be utilized for pad components 230, including various polymer foam materials that return to an original shape after being compressed. When formed from polymer foam materials, pad components 230 may have the form of foam components. Examples of suitable polymer foam materials that are suitable for pad components 230 include polyurethane, ethylvinylacetate, polyester, polypropylene, and polyethylene foams. Moreover, both thermoplastic and thermoset polymer foam materials may be utilized. In some configurations of cushioning element 200, pad components 230 may be formed from a polymer foam material with a varying density, or solid polymer or rubber materials may be utilized. Fluid-filled chambers may also be utilized as pad components 230. Also, different pad components 230 may be formed from different materials, or may be formed from similar materials with different densities. As discussed in greater detail below, the polymer foam materials forming pad components 230 attenuate impact forces to provide cushioning or protection. By selecting thicknesses, materials, and densities for each of the various pad components 230, the degree of impact force attenuation may be varied throughout cushioning element 200 to impart a desired degree of cushioning or protection.

The compressible polymer foam materials forming pad components 230 attenuate impact forces that compress or otherwise contact cushioning element 200. When incorporated into apparel 100 or another article of apparel, for example, the polymer foam materials of pad components 230 may compress to protect a wearer from contact with other athletes, equipment, or the ground. Accordingly, cushioning element 200 may be utilized to provide cushioning or protection to area of individual 10 or other wearers that are covered by cushioning element 200.

Figure 7A:
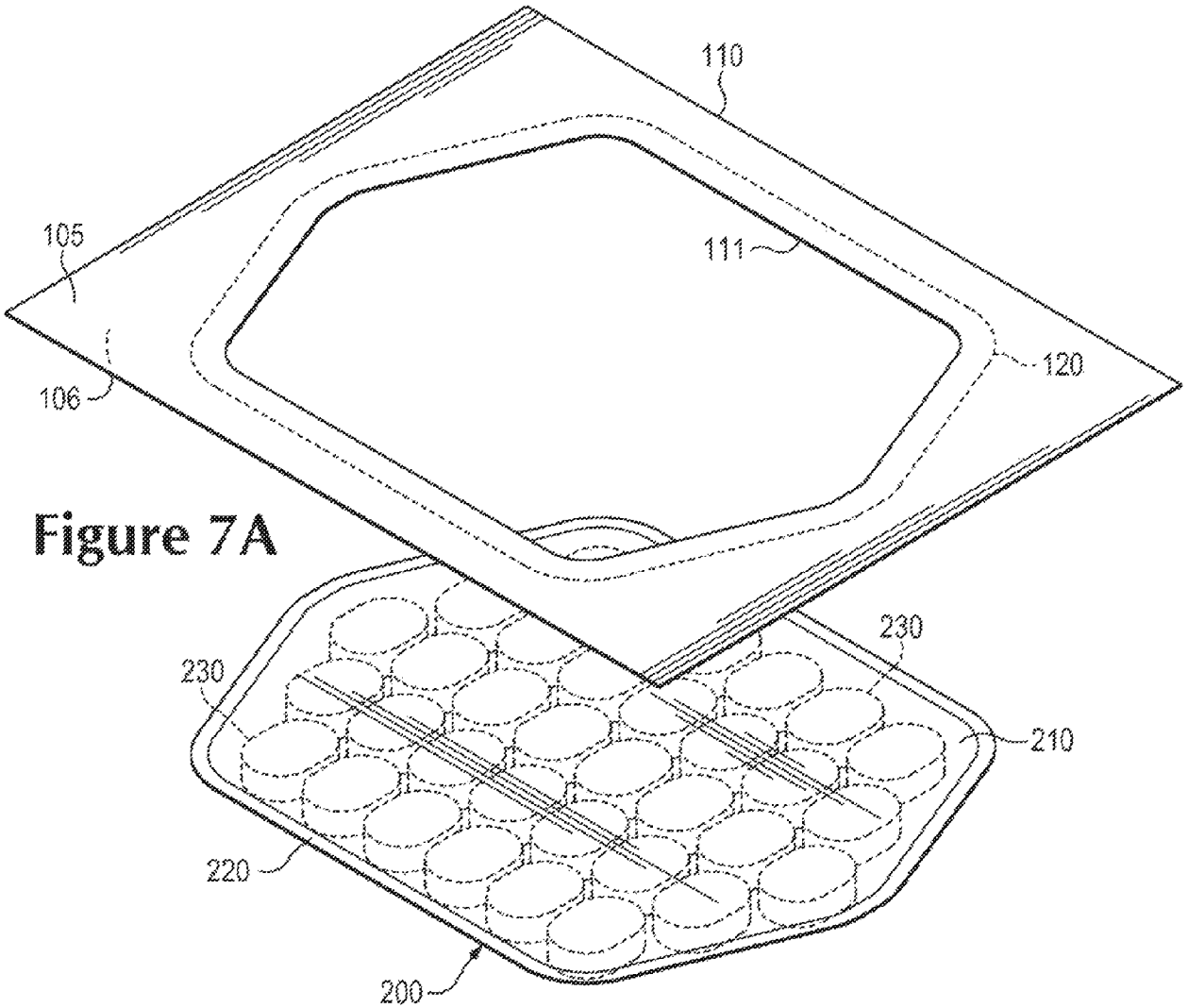
FIGS. 7A and 7B are an exploded perspective views of the portion of the apparel.
Figure 7B:
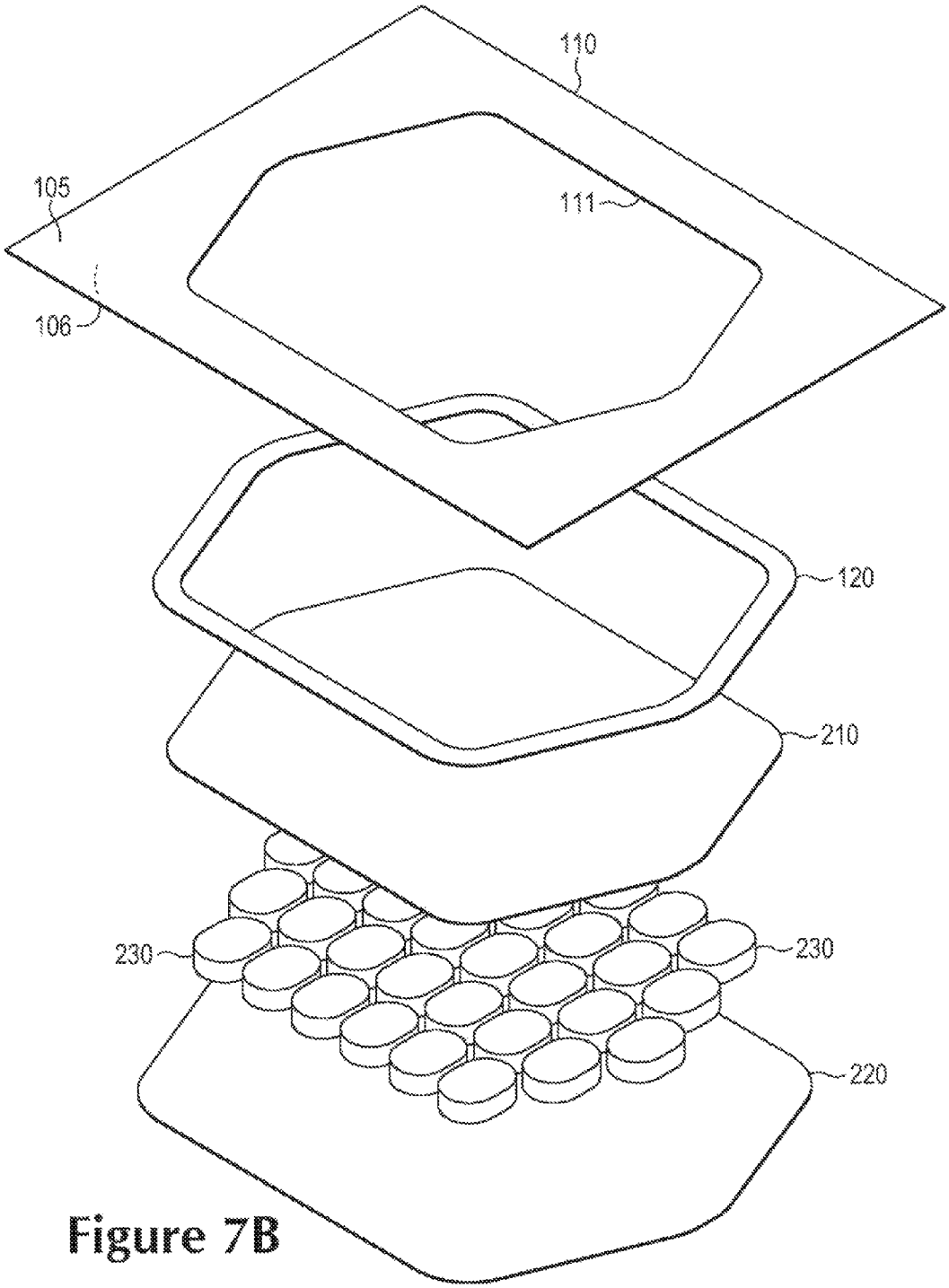
Figure 8:
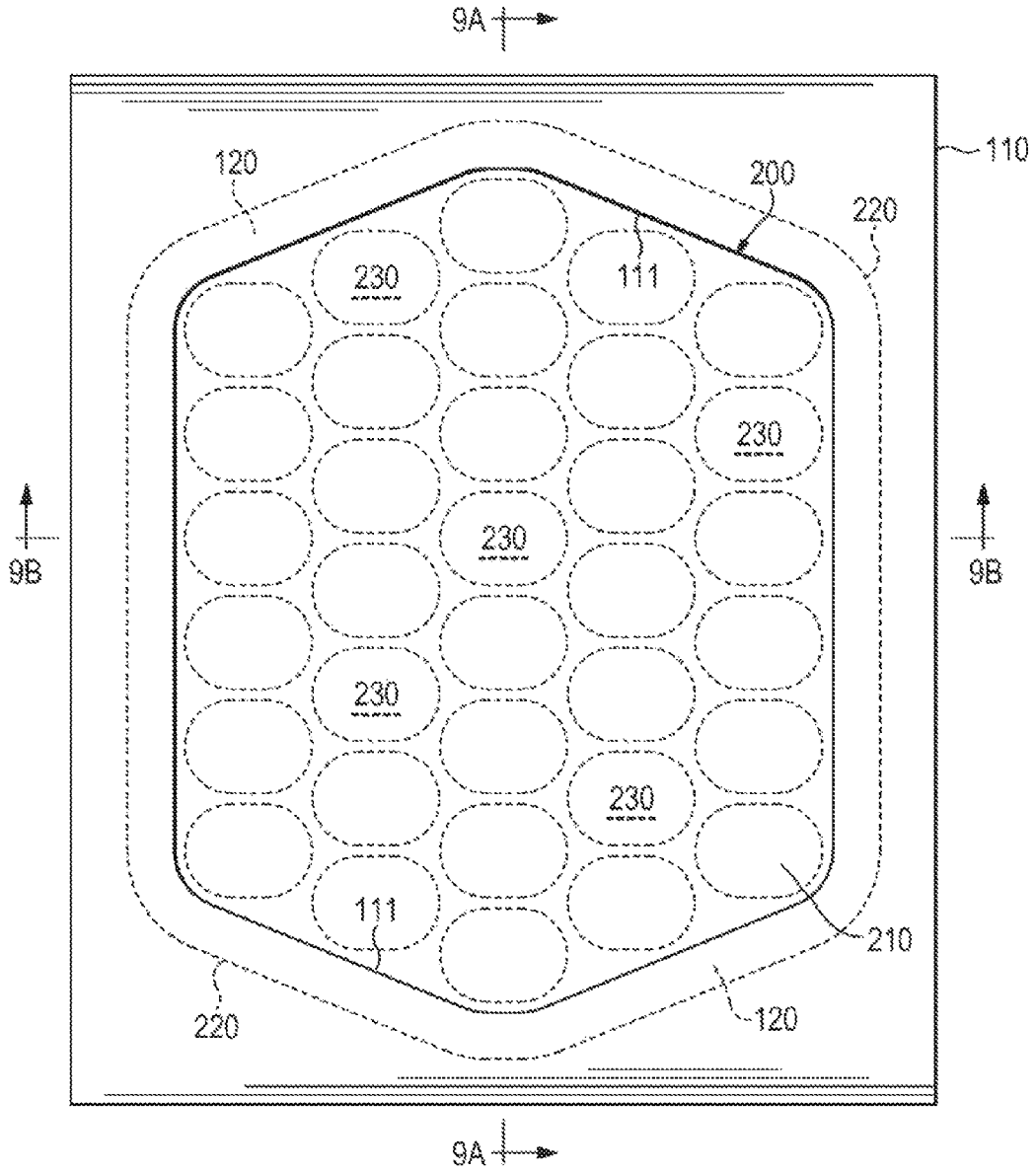
FIG. 8 is a top plan view of the portion of the apparel.

Bonding element 120 joins material layers 210 and 220 to base layer 110 around aperture 111. Referring to FIGS. 7A and 7B, for example, bonding element 120 is located at an edge of aperture 111 and extends entirely around aperture 111. A variety of materials may be utilized for bond in element 120, including thermoplastic polymer materials (e.g., polyurethane), various adhesives, or heat-activated adhesives, for example. When formed from a thermoplastic polymer material, for example, the application of heat and pressure may be utilized to bond material layers 210 and 220 to interior surface 106 with bonding element 120. A thermoplastic polymer material melts when heated and returns to a solid state when cooled sufficiently. Based upon this property of thermoplastic polymer materials, thermalbonding processes may be utilized to form a thermalbond that joins material layers 210 and 220 to base layer 110. As utilized herein, the term "thermalbonding" or variants thereof is defined as a securing technique between two elements that involves a softening or melting of a thermoplastic polymer material within at least one of the elements such that the materials of the elements are secured to each other when cooled. Similarly, the term "thermalbond" or variants thereof is defined as the bond, link, or structure that joins two elements through a process that involves a softening or melting of a thermoplastic polymer material within at least one of the elements such that the materials of the elements are secured to each other when cooled. With regard to bonding element 120, thermalbonding may involve, for example, the melting or softening of thermoplastic materials within bonding element 120 to join material layers 210 and 220 to base layer 110. Additionally, thermalbonding does not generally involve the use of stitching or adhesives, but involves directly bonding elements to each other with heat. In some situations, however, stitching or adhesives may be utilized to supplement the thermalbond or the joining of elements through thermalbonding. As an alternative to thermalbonding, an adhesive, a thermally-activated adhesive, stitching, or other securing structure may be utilized to join each of material layers 210 and 220 to interior surface 106.

In addition to attenuating impact forces, cushioning element 200 has an advantage of simultaneously providing one or more of breathability, flexibility, a relatively low overall mass, and launderability. When incorporated into an article of apparel, such as apparel 100, a wearer may perspire and generate excess heat. By utilizing a permeable textile for material layers 210 and 220 and also forming gaps between adjacent pad components 230, areas for air to enter apparel 100 and for moisture to exit apparel 100 are formed through cushioning element 200. More particularly, air and moisture may pass through material layers 210 and 220 and between pad components 230 to impart breathability to areas of apparel 100 having cushioning element 200. Moreover, the materials and structure discussed above for cushioning element 200 impart flexibility and a low overall mass to cushioning element 200. Furthermore, the materials and structure discussed above for cushioning element 200 permits cushioning element 200 to be laundered without significant shrinkage or warping, even when temperatures associated with commercial laundering processes are utilized. Accordingly, cushioning element 200 may simultaneously provide impact force attenuation, breathability, flexibility, a relatively low overall mass, and launderability to an article of apparel.

The position of cushioning element 200 with respect to aperture 111 and surfaces 105 and 106 may vary depending upon whether apparel 100 is being worn by individual 10. Referring to FIG. 7A, base layer 110 and cushioning element 200 are depicted as being in a neutral state, which may occur when apparel 100 is not being worn and no significant forces are exerted upon apparel 100. In this state, first material layer 210 extends across aperture 111 and pad components 230 are located below aperture 111. Referring to FIG. 7C, however, a force 107 is acting upon cushioning element 200, and may also be acting upon base layer 110. That is, force 107 presses upward on second material layer 220 and portions of interior surface 106. Force 107 may, for example, be similar to a force that the body of individual 10 exerts upon apparel 100. In this state, first material layer 210 and pad components 230 protrude through aperture 111 due in the presence of force 107. Note that FIG. 1 depicts a configuration where cushioning elements 200 protrude outward due to the presence of individual 10, whereas FIGS. 2-5 depict a configuration wherein cushioning elements 200 are recessed within apparel 100 due to the absence of individual 10.

Manufacturing Process

Figure 10:
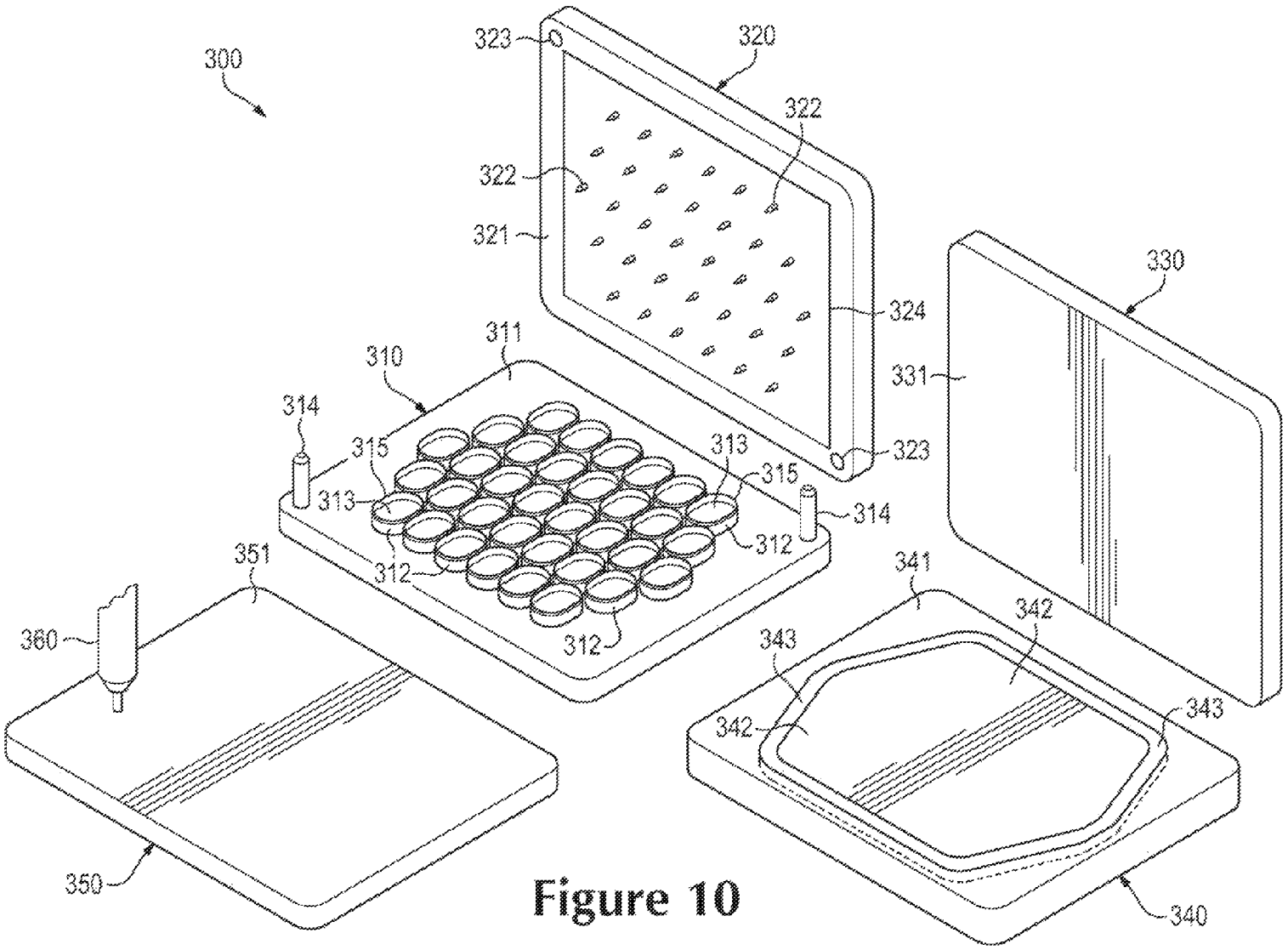
FIG. 10 is a perspective view of portions of a manufacturing apparatus utilized in a manufacturing process for the portion of the apparel.

A variety of techniques may be utilized to manufacture apparel 100 to include cushioning element 200. With reference to FIG. 10, a manufacturing apparatus 300 is disclosed as including a die 310, an extractor 320, a heating plate 330, a press plate 340, a platen 350, and a cutter 360. The configurations depicted in FIG. 10 and discussed below for manufacturing apparatus 300 are intended to provide an example of a manufacturing apparatus that may be utilized in the manufacture of apparel 100. A variety of other manufacturing apparatuses that operate in a similar manner may also be utilized.

Die 310 includes a base 311, a plurality of die elements 312, a plurality of ejection members 313, and a pair of registration pegs 314. Base 311 is formed from a durable and rigid material, such as steel or aluminum, to provide a foundation for die 310. Die elements 312 extend outward (e.g., upward) from base 311 and exhibit a general shape of pad components 230. More particularly, an interior area of each die element 312 has the general shape of an individual pad component 230. As discussed in greater detail below, edges 315 (e.g., upper edges) of die elements 312 are utilized to cut through a material that forms pad components 230, thereby shaping and forming each of pad components 230. Edges 315 may generally have a sharpened configuration that assists with cutting through the material that forms pad components 230. Ejection members 313 are located within the interior areas of each die element 312 and are spaced (e.g., spaced downward) from edges 315. As an example, ejection members 313 may be formed from a polymer foam material with lesser compressibility than a polymer foam material forming pad components 230. Additionally, registration pegs 314 extend outward (e.g., upward) from base 311.

In addition to having the general shape of pad components 230, die elements 312 are arranged or otherwise located relative to each other in the same manner as pad components 230. As noted above, pad components 230 are depicted as being spaced evenly from each other and arranged in offset rows. Similarly, die elements 312 are spaced evenly from each other and arranged in offset rows. That is, die elements 312 are arranged in a configuration that corresponds with the positions of pad components 230 in cushioning element 200. If, however, a different arrangement is desired for pad components 230, then die elements 312 may be moved or otherwise repositioned to correspond with the different arrangement.

Extractor 320 includes a base 321, a plurality of extractor elements 322, a pair of registration apertures 323, and an extractor sheet 324. Base 321 is formed from a durable and rigid material, such as steel or aluminum, to provide a foundation for extractor 320. Extractor elements 322 have the configurations of pins that extend outward (e.g., downward) from base 321 and have sharpened or pointed end areas. As discussed in greater detail below, extractor elements 322 assist with retaining the positions of pad components 230 upon removal from die 310. As an alternative to pins, extractor elements 322 (a) may have the configurations of needles, nails, spikes, or prongs or (b) may be a vacuum system that retains the positions of pad components 230 upon removal from die 310, for example Accordingly, extractor elements 322 are any device or system that may be used to secure pad components 230 to extractor 320 and assist with retaining the positions of pad components 230 upon removal from die 310. Additionally, registration apertures 323 form holes in base 321 that are positioned to correspond with and receive registration pegs 314.

The positions of extractor elements 322 correspond with the locations of die elements 312. Moreover, extractor elements 322 are arranged or otherwise located relative to each other in the same manner as die elements 312, and die elements 313 are arranged or otherwise located relative to each other in the same manner as pad components 230. That is, extractor elements 322 are arranged in a configuration that corresponds with the positions of pad components 230 in cushioning element 200. If, however, a different arrangement is desired for pad components 230, then extractor elements 322 and die elements 312 may be moved or otherwise repositioned to correspond with the different arrangement.

Extractor sheet 324 lays adjacent to base 321 and includes a plurality of apertures that receive extractor elements 322. That is, extractor elements 322 extend through the apertures in extractor sheet 324. A variety of materials may be utilized for extractor sheet 324, including various polymer materials and metals.

Heating plate 330 includes a base 331 that may also be formed from a durable and rigid material, such as steel or aluminum, and incorporates heating elements. More particularly, electric coils may extend through base 331 to heat base 331 to temperatures that bond (a) pad components 230 to material layers 210 and 220 and (b) material layers 210 and 220 to base layer 110 with bonding element 120. As an alternative, base 331 may incorporate fluid channels through which a heated fluid passes, or radiant heaters, radio frequency emitters, or other devices may be utilized. In some configurations of heating plate 330, a surface of base 331 that contacts portions of cushioning element 200 during the manufacturing process may incorporate a rubber or silicone material.

Press plate 340 includes a base 341, a first compressible element 342, and a second compressible element 343. As with bases 311, 321, and 331, base 341 may be formed from a durable and rigid material, such as steel or aluminum. Compressible elements 342 and 343 are recessed within a surface of base 341 such that second compressible element 343 surrounds or otherwise extends around first compressible element 342. First compressible element 342 has a shape that forms a general outline of the area of cushioning element 200 that includes pad components 230, and second compressible element 343 has a shape that forms a general outline of bonding element 120. Compressible elements 342 and 343 are formed from materials (e.g., silicone, polymer foam) that compress or deform when a force is applied and return to an original shape when the force is removed. Although both of compressible elements 342 and 343 compress, the degree of compression may be different. That is, first compressible element 342 may compress to a greater degree than second compressible element 343.

Platen 350 is generally formed from non-compressible material and includes a surface 351 against which elements may be pressed. Although platen 350 is depicted as being a individual element, platen 350 may be a workbench surface, a surface within an existing heat press that includes heating plate 350, or any other suitable surface. Cutter 360 is a laser cutting apparatus, such as any conventional $CO_2$ or Nd:YAG laser apparatuses. As an alternative to a laser cutting apparatus, cutter 360 may be a die cutting apparatus, punch press, or pair of scissors.

Figure 11A:
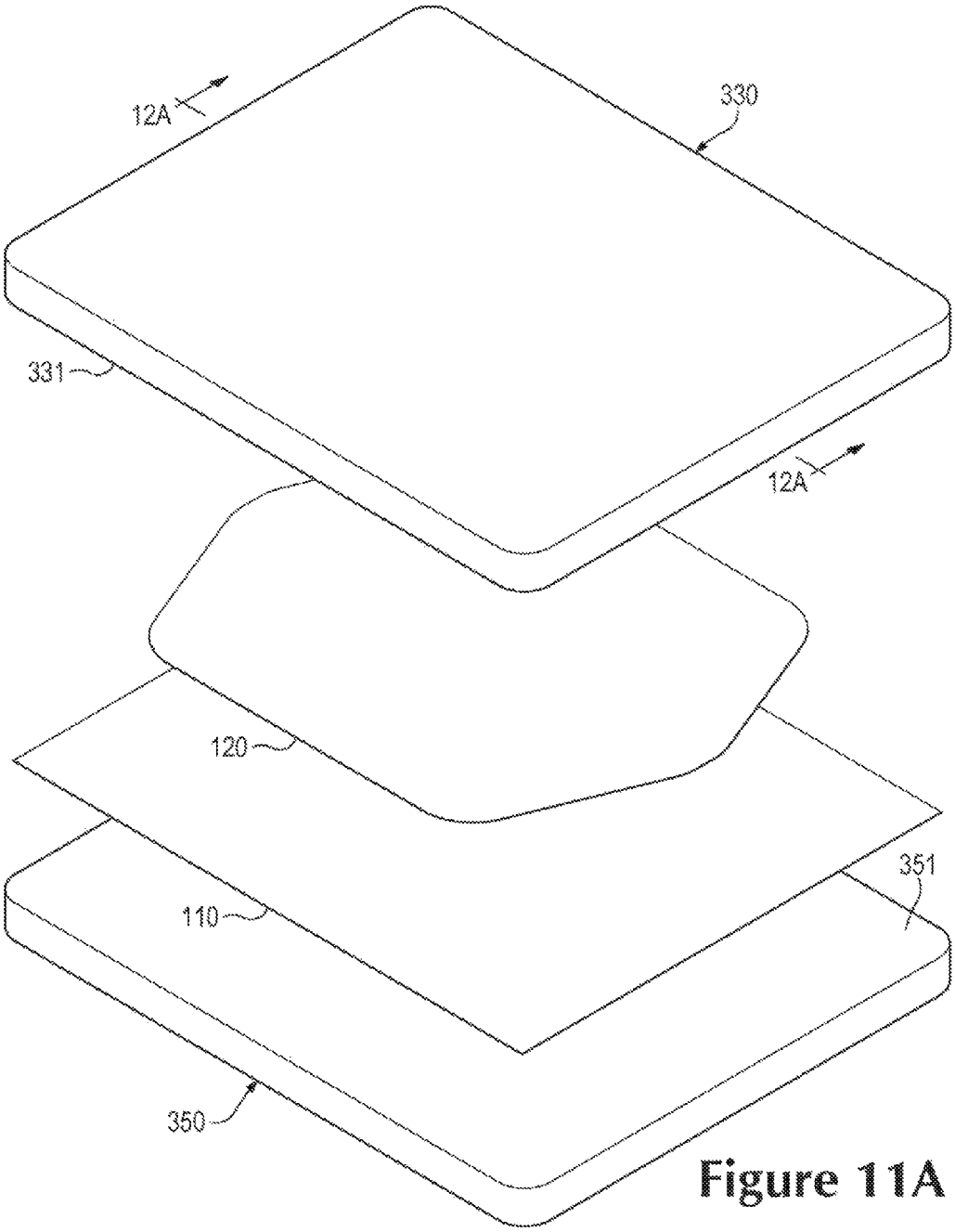
FIGS. 11A-11N are schematic perspective views of the manufacturing process.
Figure 11B:
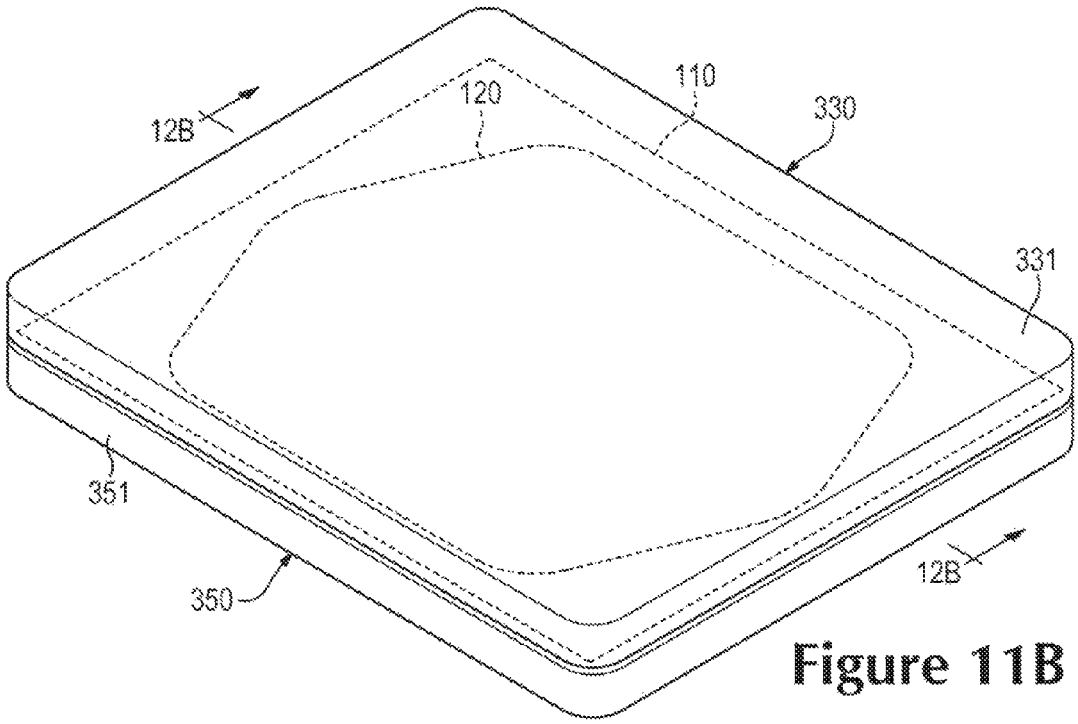
Figure 11C:
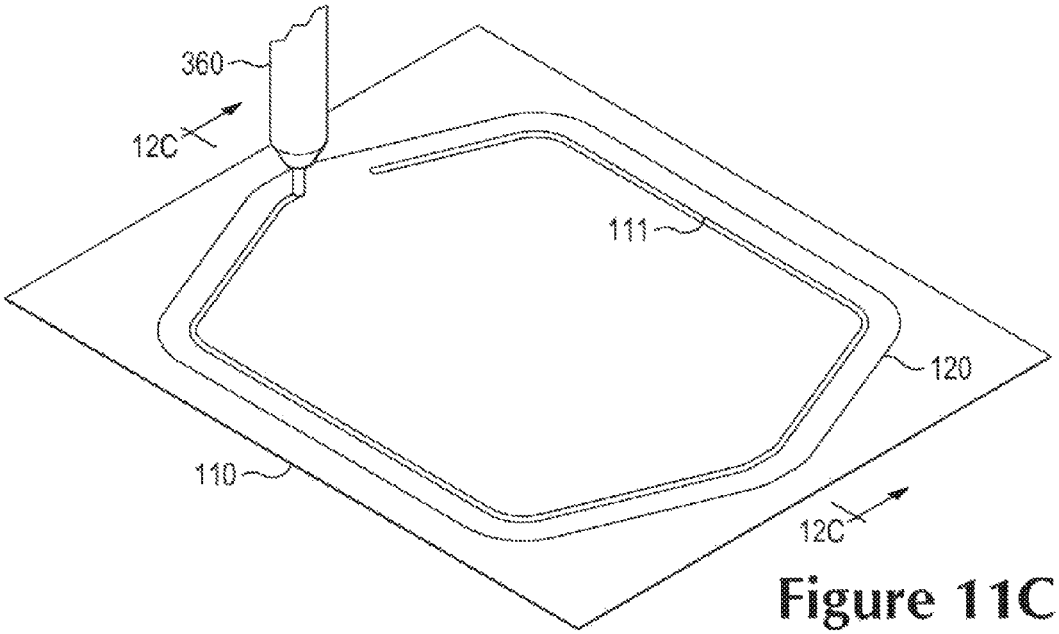
Figure 11D:
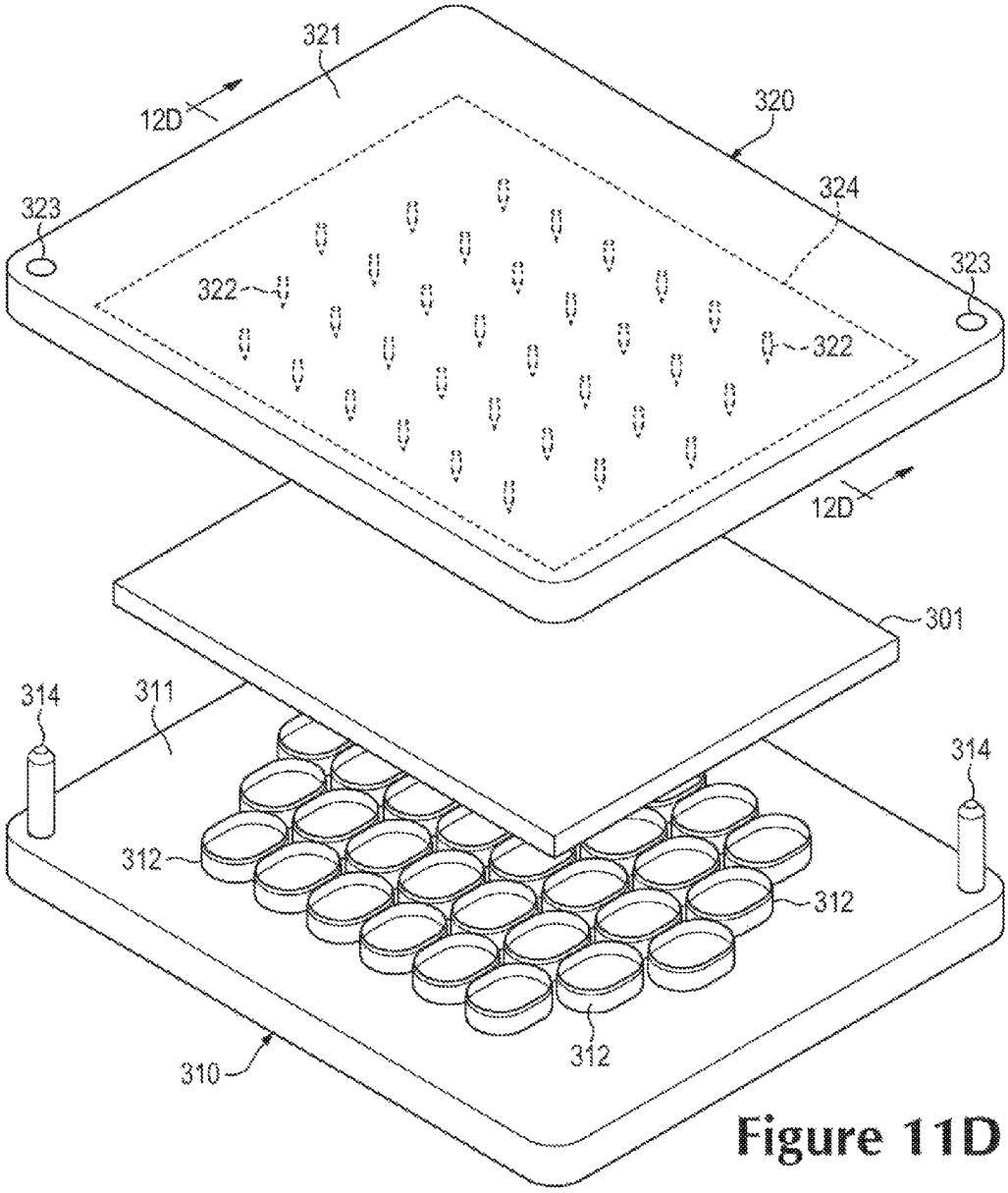
Figure 11E:
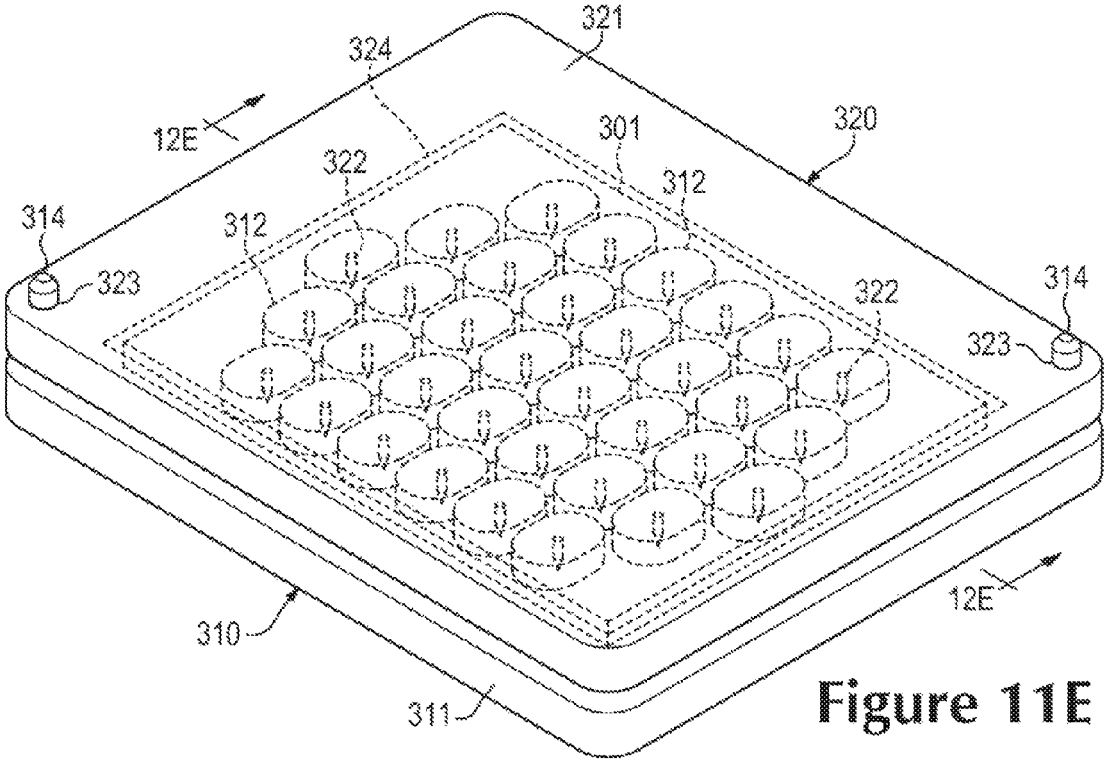
Figure 11F:
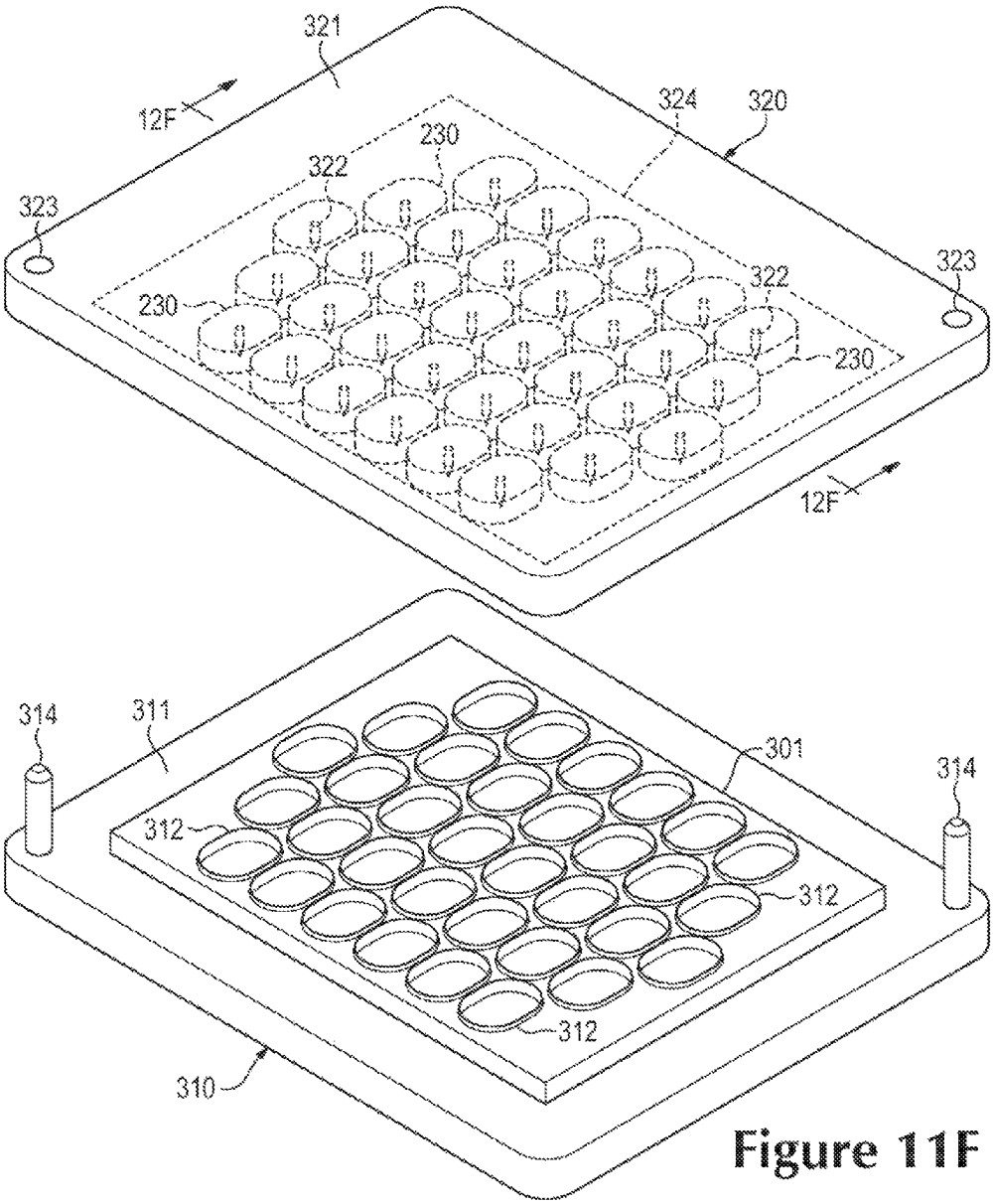

With reference to FIGS. 11A-11M and 12A-12M, an example of a suitable manufacturing process utilizing manufacturing apparatus 300 is disclosed. As an initial portion of the manufacturing process, base layer 110 is formed to define aperture 111 and include bonding element 120. Referring to FIGS. 11A and 12A, base layer 110 and bonding element 120 are located between heating plate 330 and platen 350. Base layer 110 and bonding element 120 are then compressed to effectively bond or otherwise secure bonding element 120 to base layer 110, as depicted in FIGS. 11B and 12B. As discussed above, base 331 of heating plate 330 incorporates heating elements. As such, the temperature of base 331 may be elevated to a point where bonding occurs between base layer 110 and bonding element 120. The combination of base layer 110 and bonding element 120 is then incised or otherwise cut with cutter 360 to form aperture 111, as depicted in FIGS. 11C and 12C. That is, a laser from cutter 360 incises and passes through both base layer 110 and bonding element 120 to form aperture 111. From this portion of the manufacturing process, bonding element 120 is located at an edge of aperture 111 and extends entirely around aperture 111, and aperture 111 extends through a central area of bonding element 120. At this stage of the process, the combination of base layer 110 and bonding element 120 are set aside for future use.

Figure 12A:
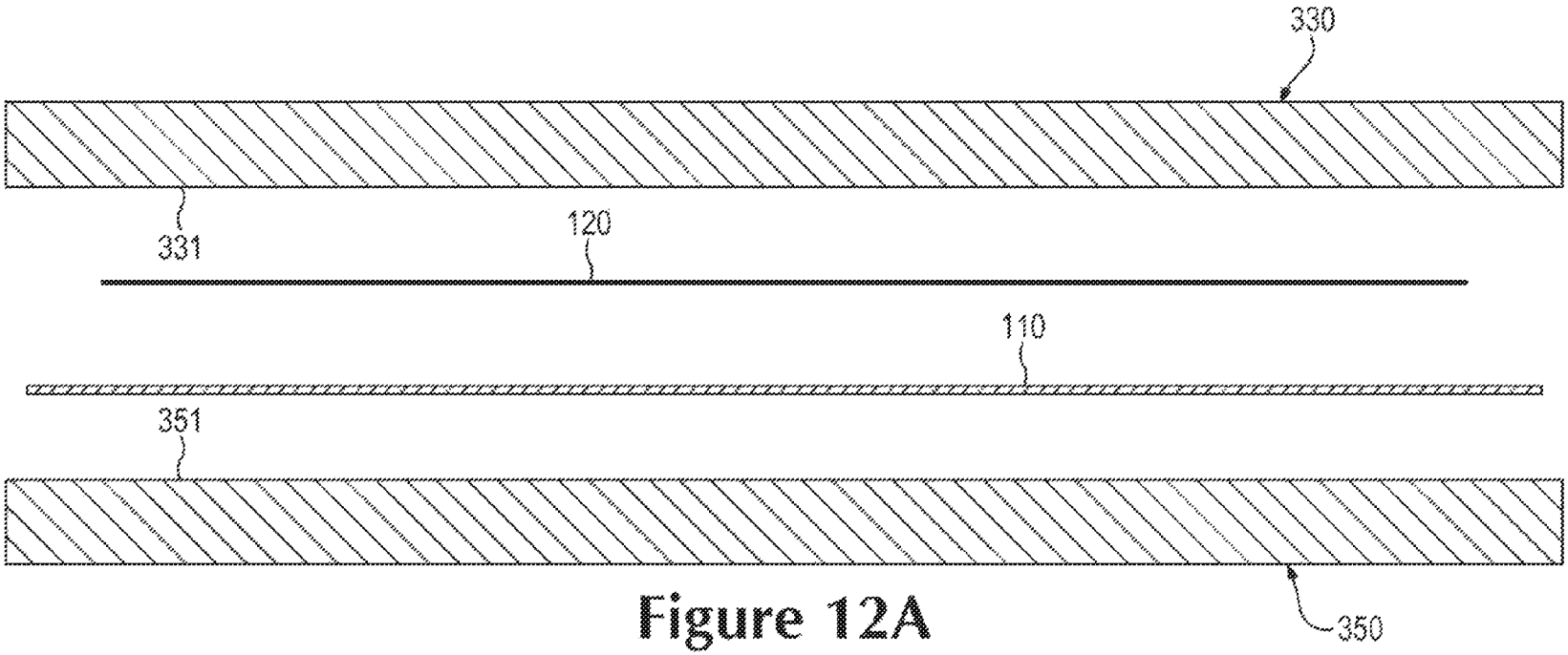
FIGS. 12A-12N are schematic cross-sectional views of the manufacturing process, as respectively defined by section lines 12A-12N in FIGS. 11A-11N.
Figure 12B:
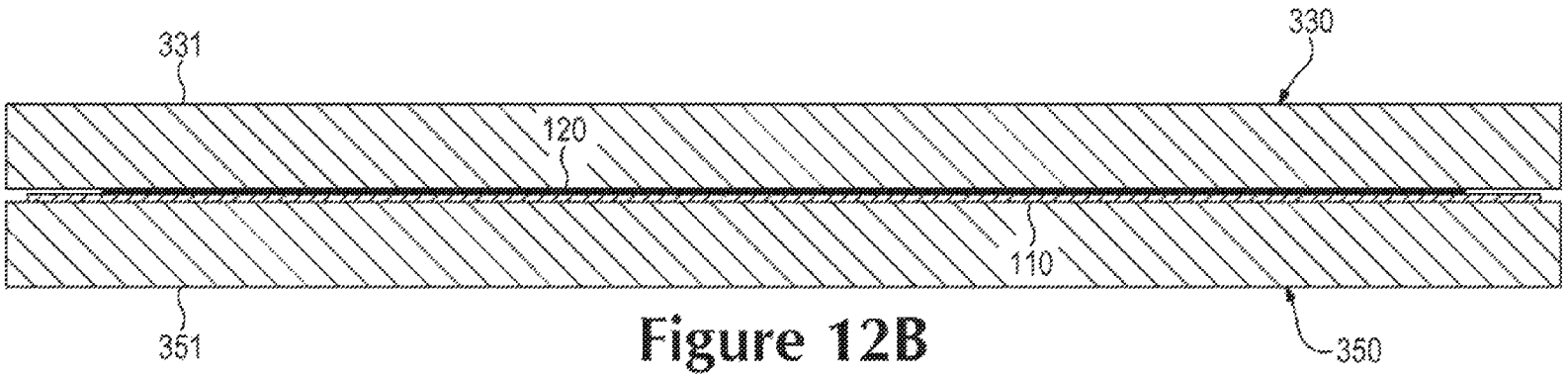
Figure 12C:
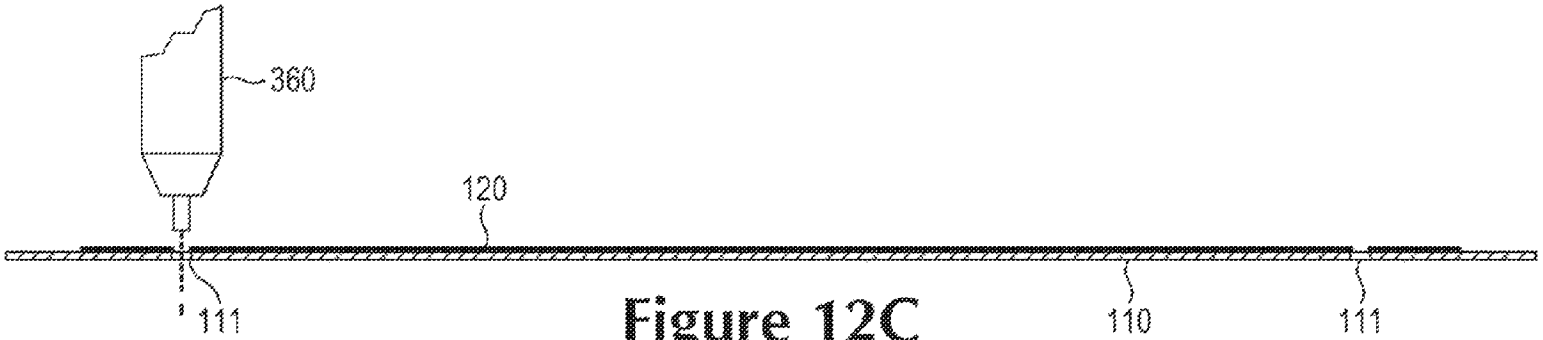
Figure 12D:
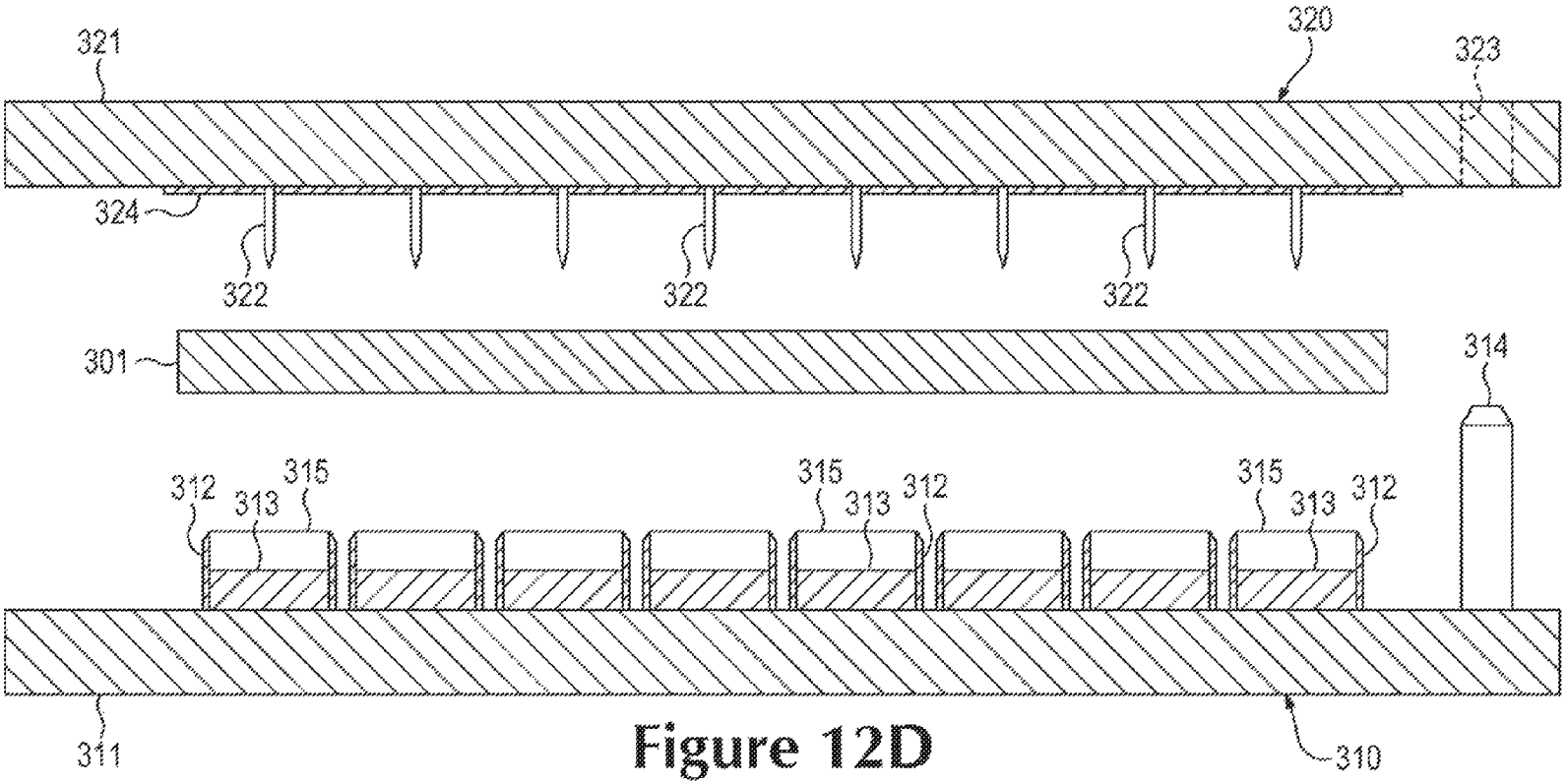
Figure 12E:
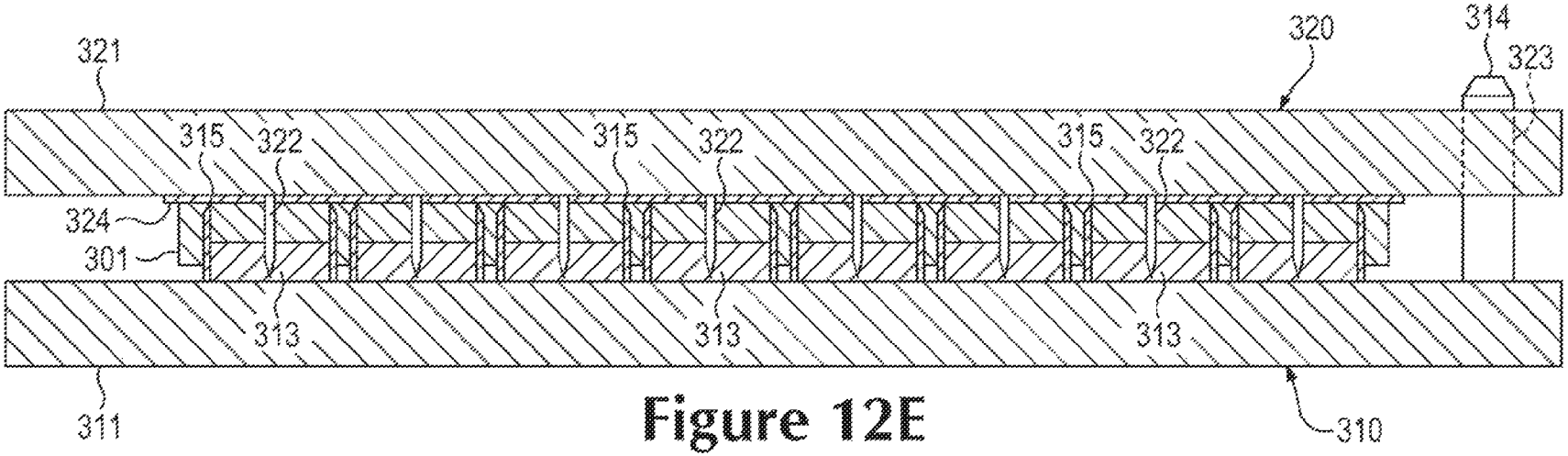

Continuing with the manufacturing process, die elements 312 are arranged in a configuration that corresponds with the positions of pad components 230 in cushioning element 200, and extractor elements 322 are arranged in a configuration that corresponds with the positions of die elements 312 and pad components 230 in cushioning element 200. A blank 301 is then placed between die 310 and extractor 320, as depicted in FIGS. 11D and 12D. Blank 301, from which pad components 230 are cut, is formed from the same material as pad components 230 and has a thickness of pad components 230. One blank 301 is positioned, die 310 and extractor 320 dose upon, compress, and cut blank 301, as depicted in FIGS. 11E and 12E. More particularly, (a) blank 301 is compressed against die elements 312 such that edges 315 pierce and cut through blank 301 and (b) extractor elements 322 pierce and enter blank 301. Note that extractor elements 322 are positioned to correspond with each of die elements 312 and enter the interior area of each of die elements 312, which is where ejection members 313 are located. Depending upon the lengths of extractor elements 322, end areas of extractor elements 322 may pass through bank 301 and pierce ejection members 313 during this operation. In order to ensure that die elements 312 properly align with extractor elements 322, registration pegs 314 are aligned with and enter registration apertures 323.

Figure 12F:
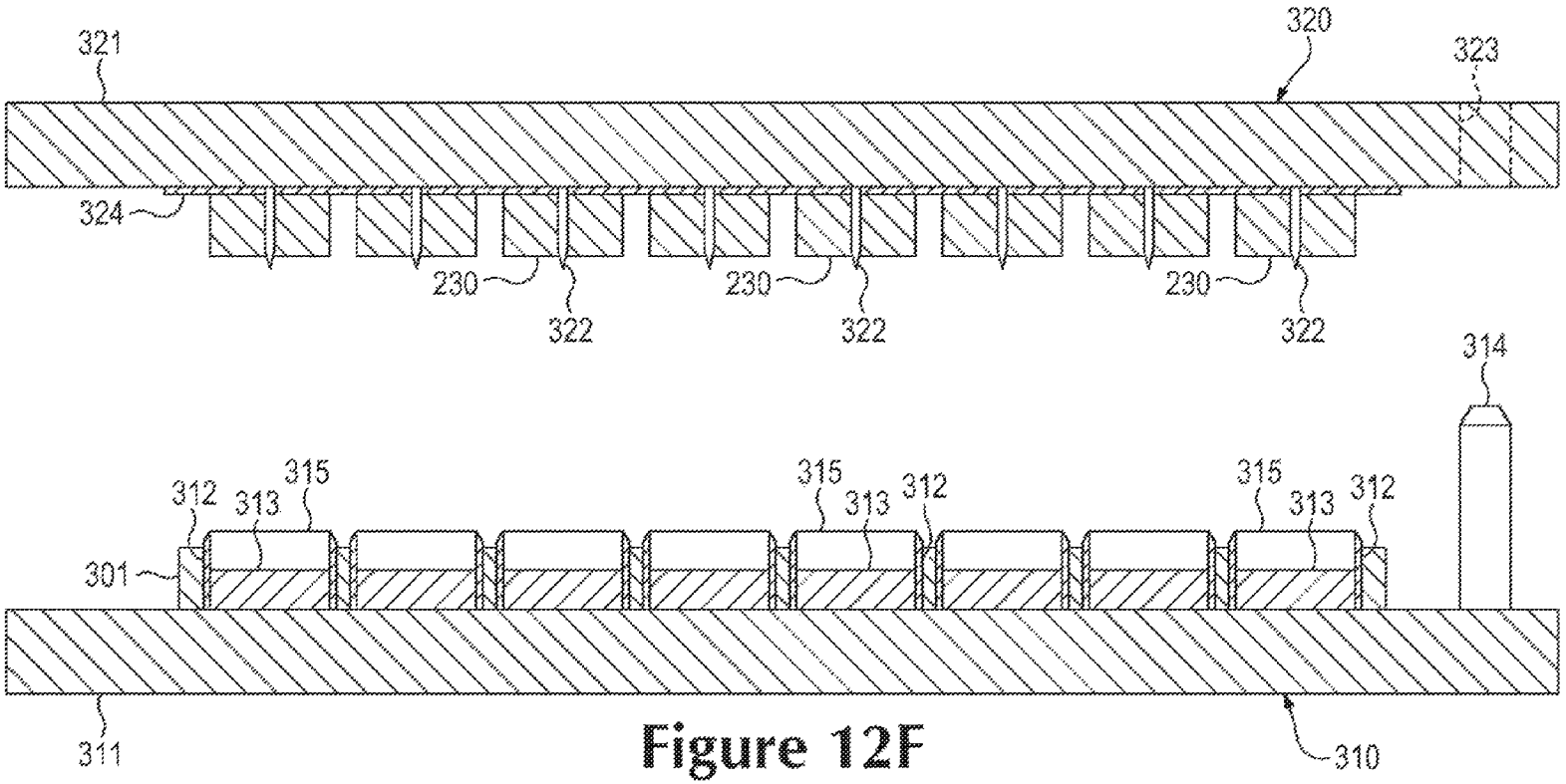

At this stage of the process, die elements 312 have effectively cut through blank 301. Referring to FIG. 12E, edges 315 of die elements 312 pass entirely through blank 301 to rest against a surface of extractor sheet 324. As noted above, the interior area of each die element 312 has the general shape of an individual pad component 230. Accordingly, the individual pad components 230 are located within die elements 312 and are compressed between a surface of extractor sheet 324 and ejection members 313. As depicted in FIGS. 11F and 12F, die 310 and extractor 320 then separate to remove pad components 230 from within die elements 312, and pad components 230 are secured to extractor 320 by the various extractor elements 322. Referring again to FIG. 12E, portions of blank 301 within die elements 312 (i.e., the portions forming pad components 230) are compressed more than portion of blank 301 that are exterior of die elements 312. That is, portions of blank 301 within die elements 312 are compressed against ejection members 313. When die 310 and extractor 320 separate, the compression of pad components 230 causes pad components 230 to expand outward from die elements 312 and remain properly positioned on extractor elements 322. As a result, pad components 230 remain secured to extractor elements 322 upon the separation of die 310 and extractor 320. Additionally, note that blank 301 may remain within die 310 (i.e., around the various die elements 312) at this stage, or may be separated from the 310, and also that blank 301 defines various apertures where pad components 230 were removed.

Referring to FIG. 12F, extractor elements 322 extend through and protrude from pad components 230. An advantage of this configuration is that extractor elements 322 may have a length that is suitable for a variety of thicknesses in pad components 230. As described in greater detail below, extractor elements 322 may also have a configuration that retracts into base 321, thereby facilitating future bonding steps or accommodating configurations where pad components 230 have different thicknesses.

As a summary of the manufacturing process up to this point, pad components 230 have effectively been removed from blank 301. More particularly, (a) die elements 312 were utilized to cut through blank 301 to form pad components 230 and (b) pad components 230 are removed from die elements 312 and remain secured to extractor 320 due to the presence of extractor elements 322, which extend into the various pad components 230. Additionally, pad components 230 are positioned and oriented in the same manner as die elements 312 and are, therefore, positioned and oriented as within cushioning element 200. Accordingly, pad components 230 have been removed from blank 301 and are positioned and oriented to be incorporated into cushioning element 200.

Figure 11G:
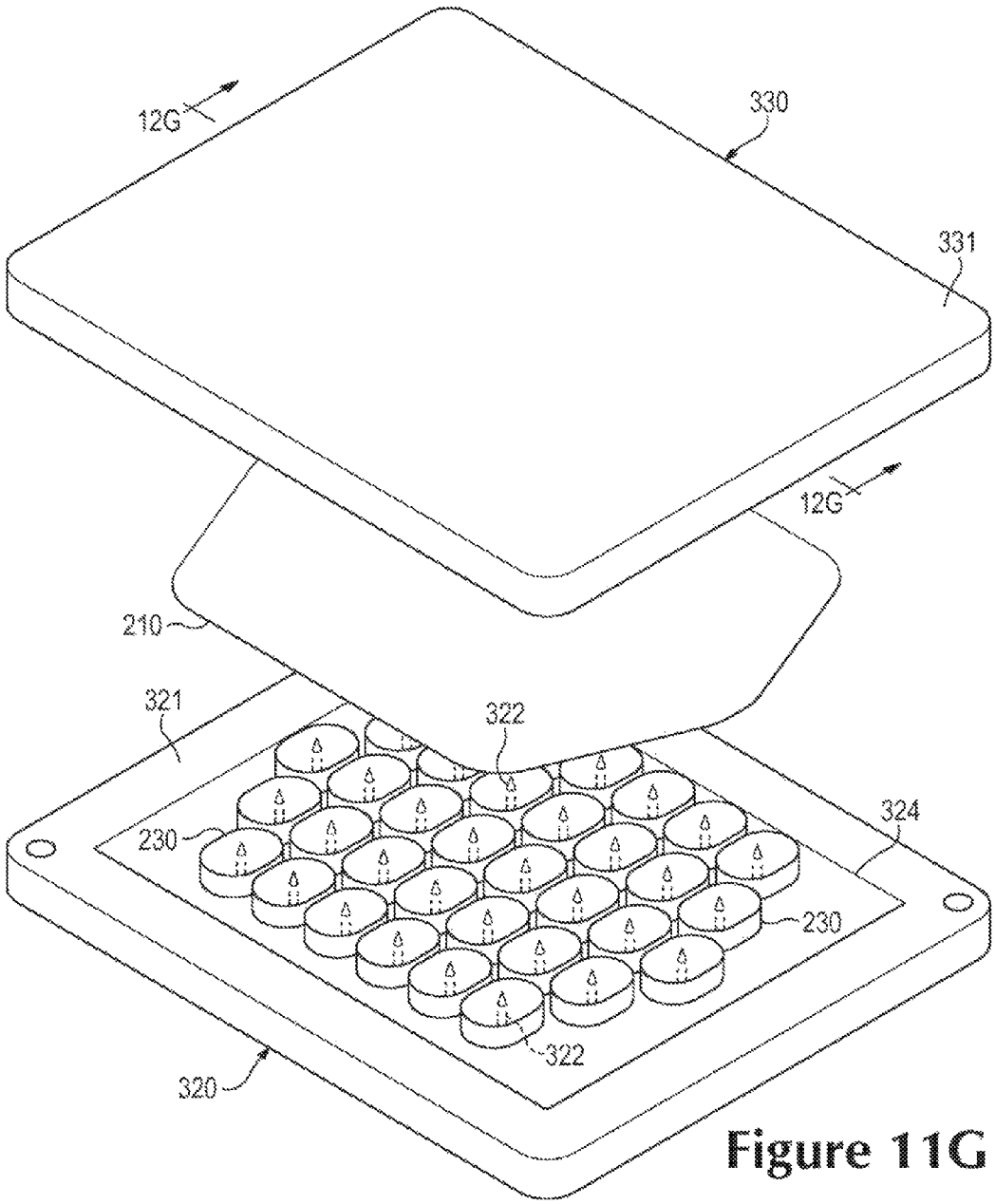
Figure 11H:
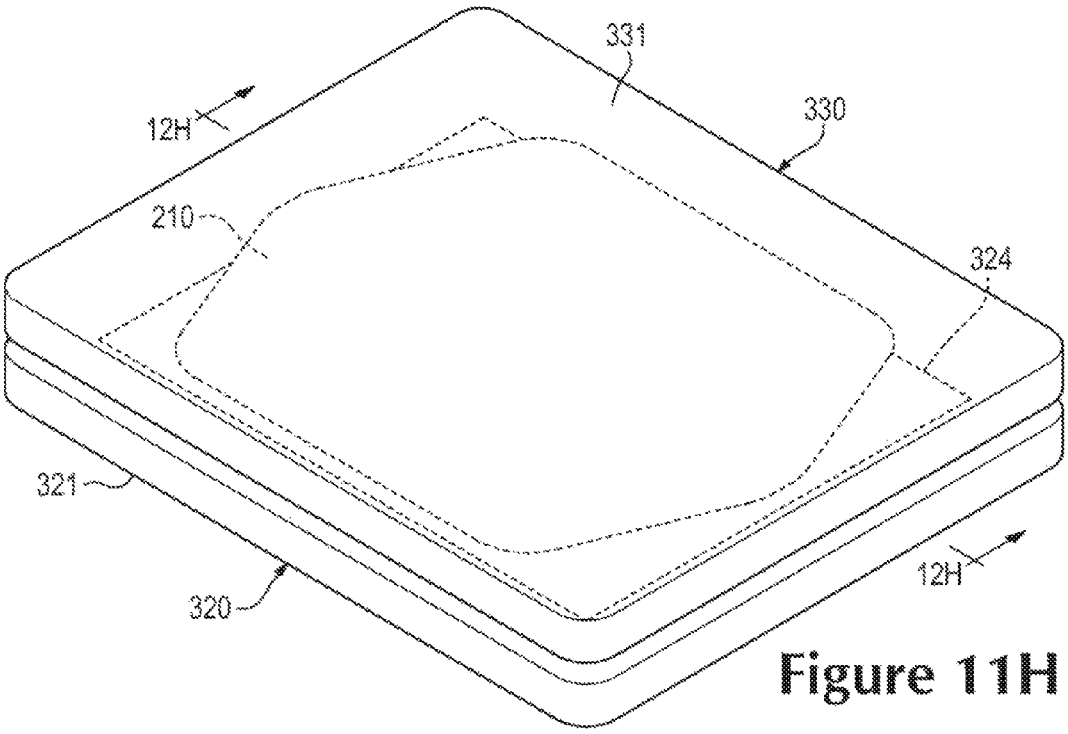
Figure 12G:
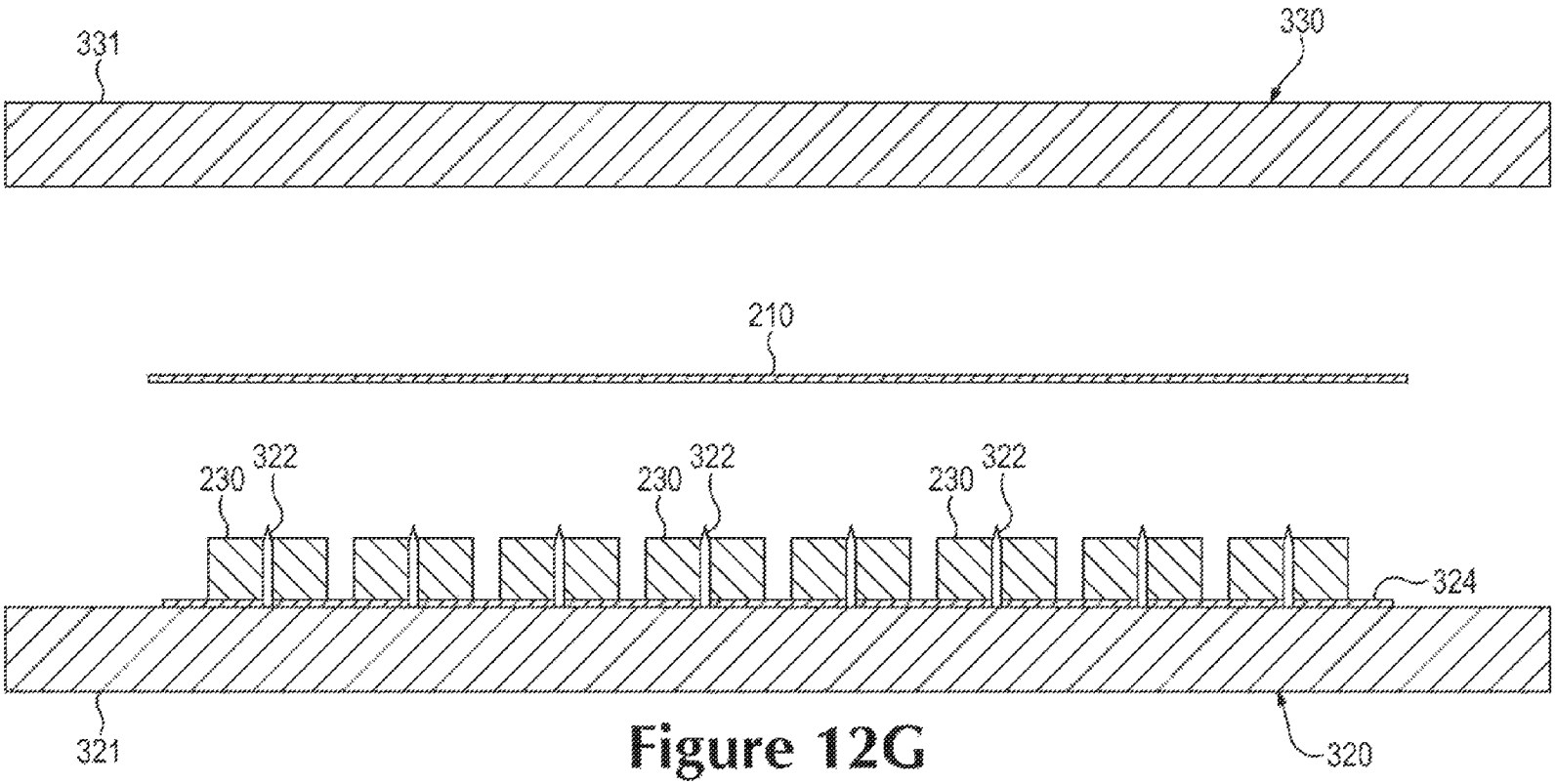
Figure 12H:
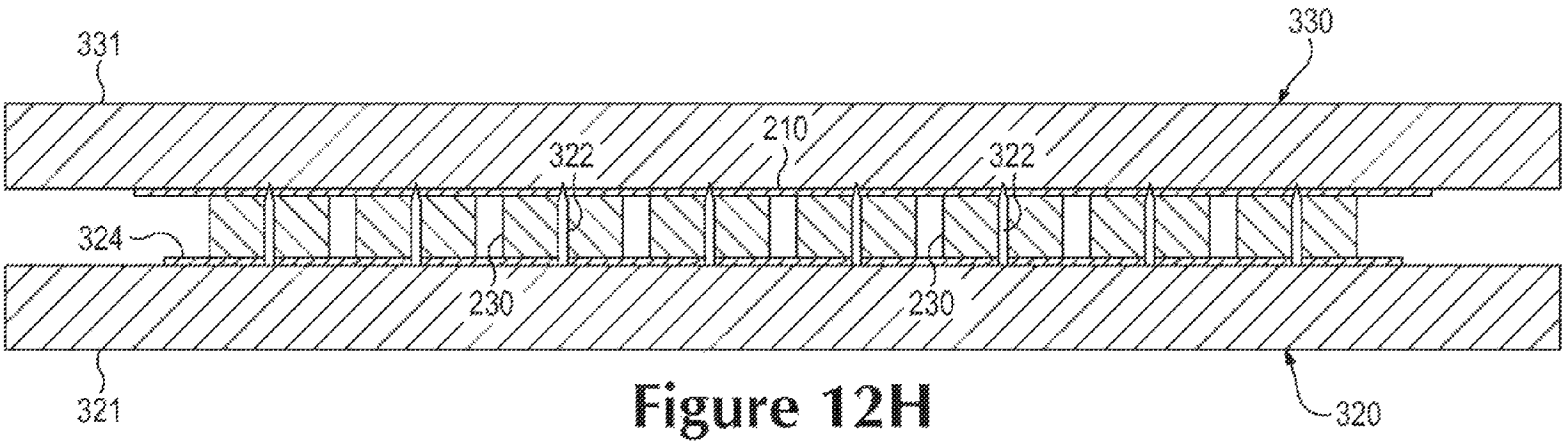

The combination of extractor 320 and pad component 230 is then positioned adjacent to heating plate 330, as depicted in FIGS. 11G and 12G. Additionally, first material layer 210 is placed between pad components 230 and heating plate 330. Extractor 320 and heating plate 330 then close upon and compress first material layer 210 and pad components 230, as depicted in FIGS. 11H and 12H. As discussed above, base 331 of heating plate 330 incorporates heating elements. As such, the temperature of base 331 may be elevated to a point where bonding occurs between first material layer 210 and pad components 230. Although extractor elements 322 are depicted as protruding into heating plate 330, extractor elements 322 may have a retractable configuration that retracts into base 321.

When compressed between extractor 320 and heating plate 330, energy from heating plate 330 may be utilized to bond first material layer 210 and pad components 230 to each other. As discussed above, a thermoplastic polymer material melts when heated and returns to a solid state when cooled sufficiently. Based upon this property of thermoplastic polymer materials, thermalbonding processes may be utilized to form a thermalbond that joins first material layer 210 are pad components 230. In this context, thermalbonding may involve, for example, (a) the melting or softening of thermoplastic materials within either of first material layer 210 and pad components 230 that joins the elements together, (b) the melting or softening of a thermoplastic material within pad components 230 such that the thermoplastic polymer material extends into or infiltrates the structure of a textile utilized for first material layer 210, or (c) the melting or softening of a thermoplastic material within first material layer 210 such that the thermoplastic polymer material extends into or infiltrates the structure of pad components 230. Thermalbonding may occur when only one element includes a thermoplastic polymer material or when both elements include thermoplastic polymer materials. Additionally, thermalbonding does not generally involve the use of stitching or adhesives, but involves directly bonding elements to each other with heat. In some situations, however, stitching or adhesives may be utilized to supplement the thermalbond or the joining of elements through thermalbonding. As an alternative to thermalbonding, an adhesive, a thermally-activated adhesive, or other securing structure may be utilized to join first material layer 210 and pad components 230.

As discussed above, a surface of base 331 that contacts portions of cushioning element 200 during the manufacturing process may incorporate a rubber or silicone material. Referring to FIG. 12H, extractor elements 322 are spaced from and do not contact base 331. In situations where the compression of first material layer 210 and pad components 230 induces extractor elements 322 to contact base 331, the rubber or silicone material may be present to receive end areas of extractor elements 322. That is, the end areas of extractor elements 322 may pierce and enter the rubber or silicone material during the compression of first material layer 210 and pad components 230.

Figure 11I:
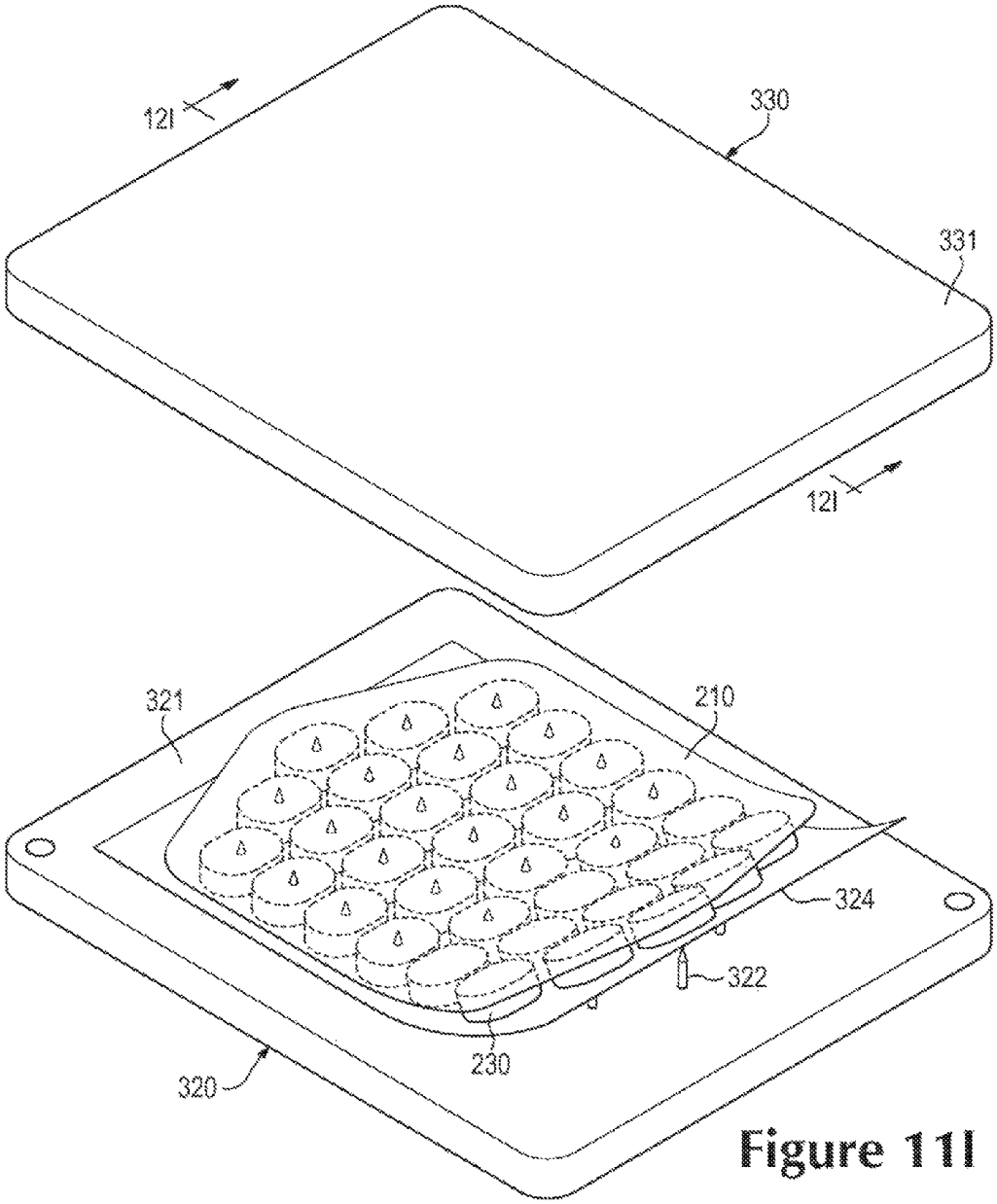
Figure 11J:
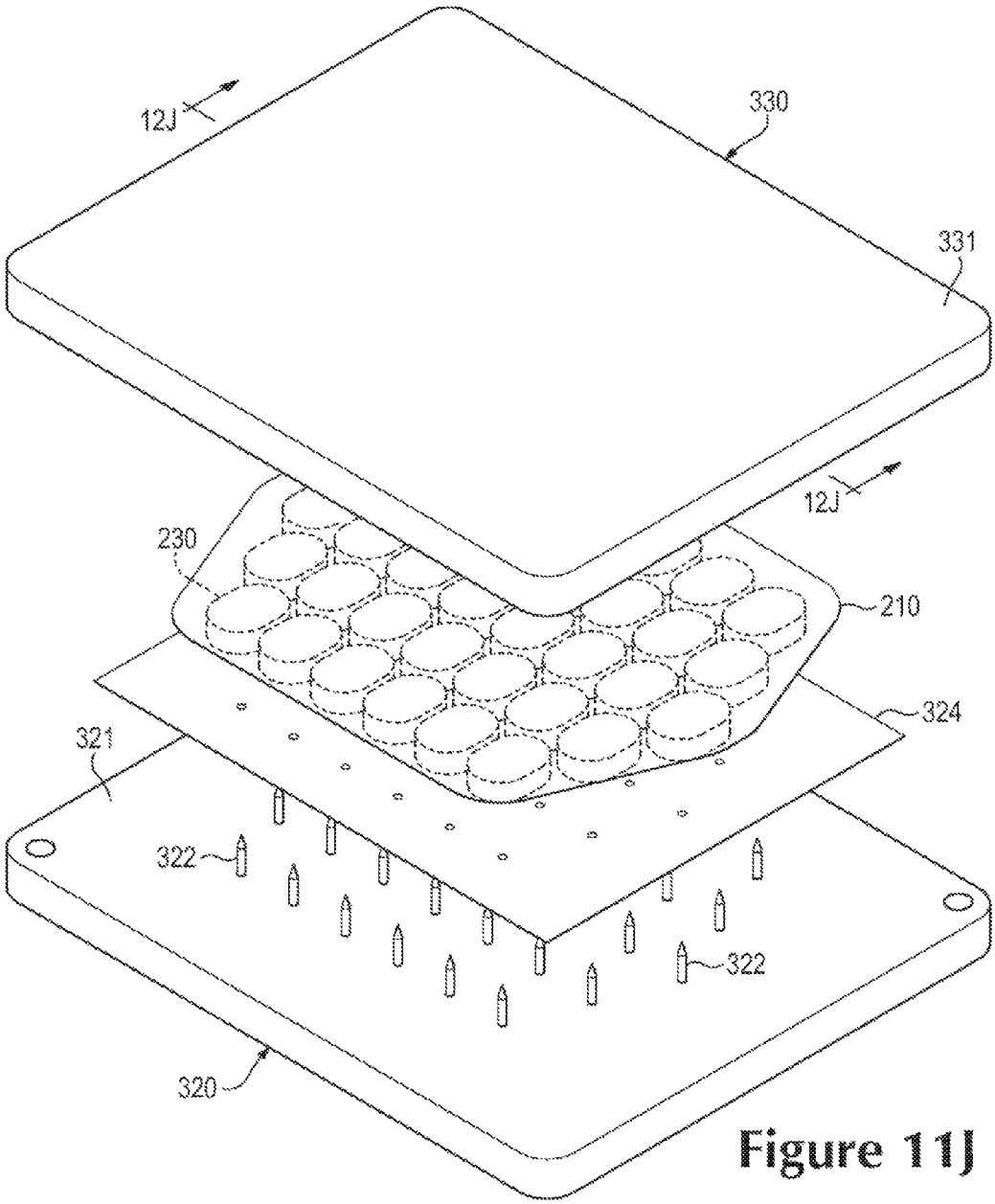
Figure 12I:
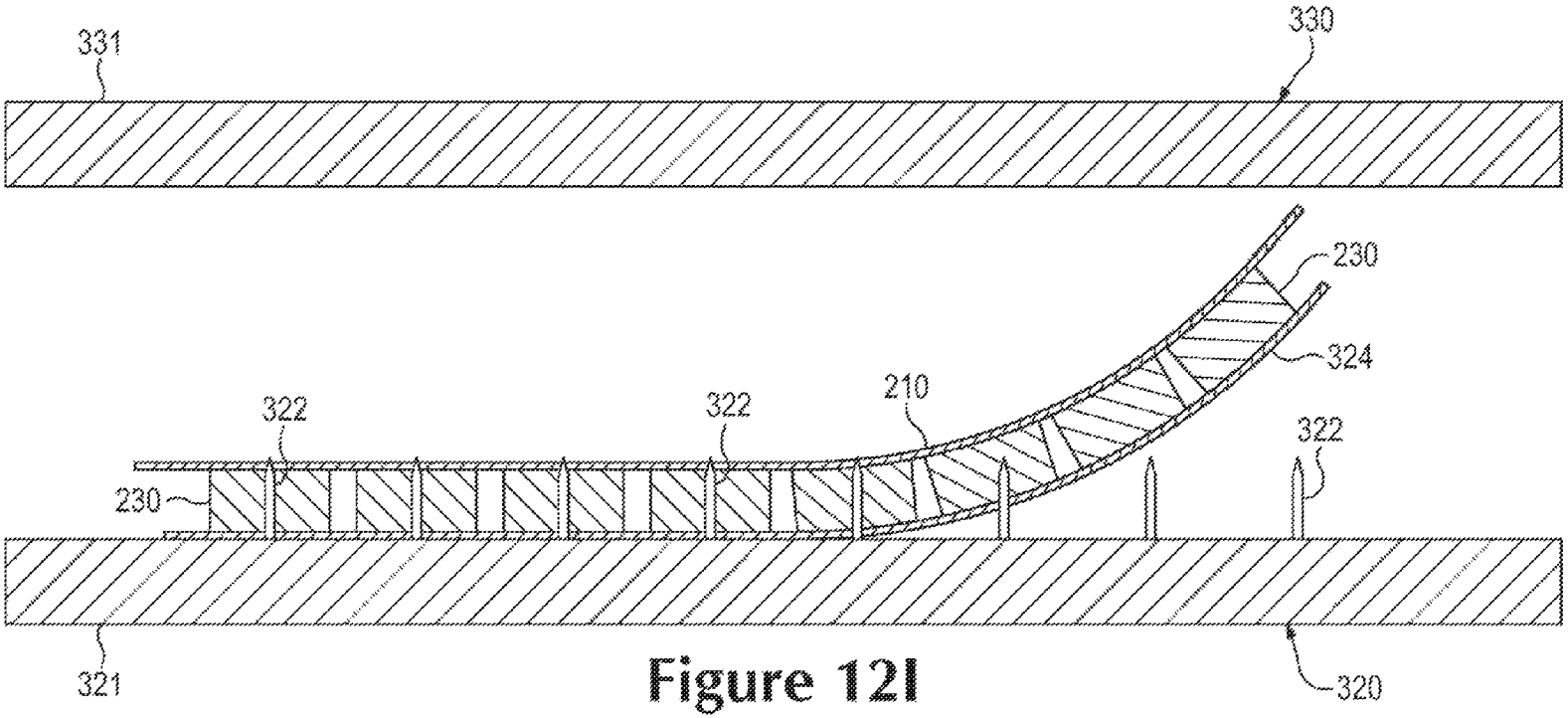
Figure 12J:
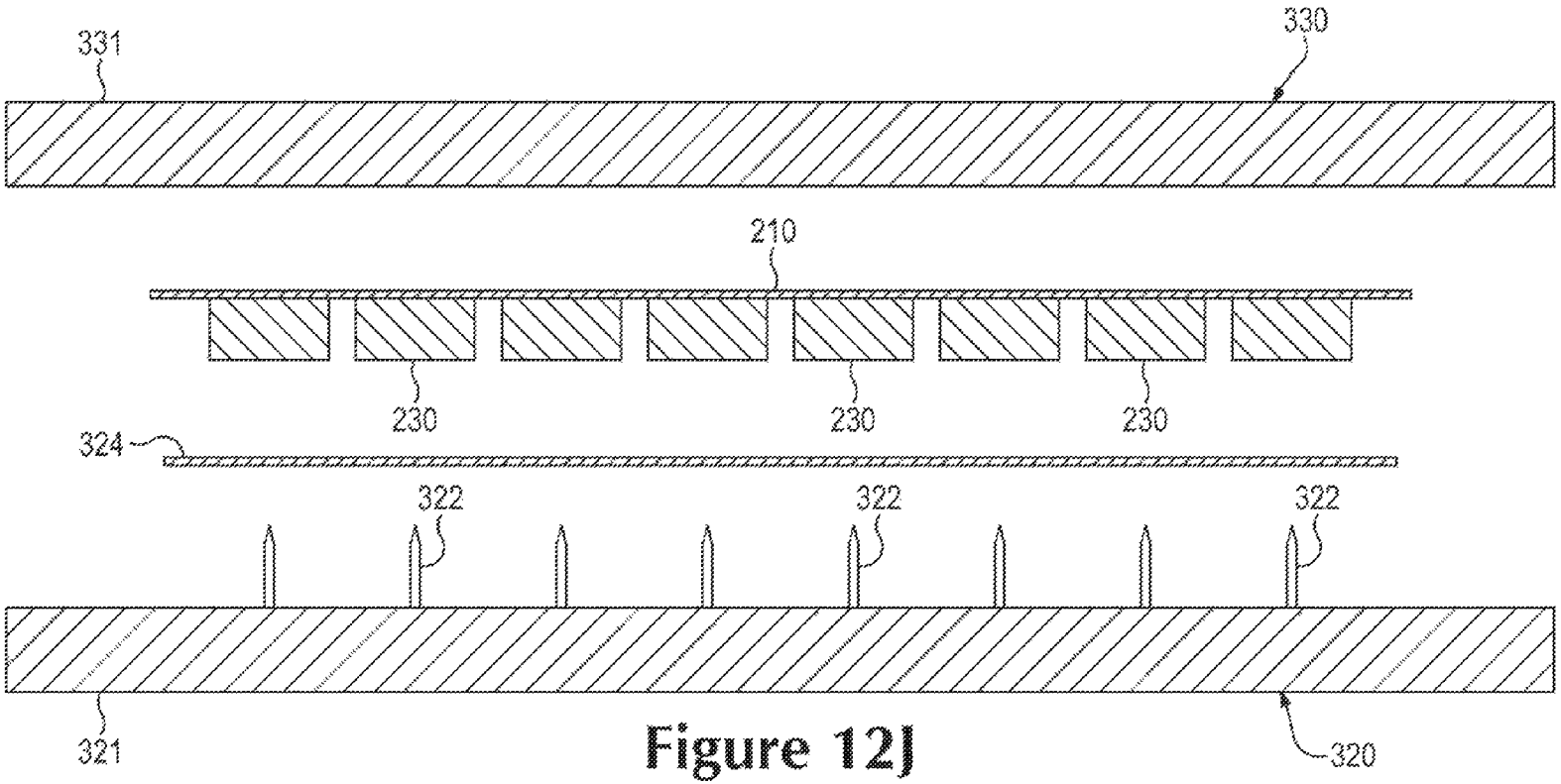

Following compression and bonding, extractor 320 and heating plate 330 separate to expose the bonded first material layer 210 and pad components 230. At this stage, the thermoplastic material, adhesive, or other element that joins first material layer 210 and pad components 230 may have an elevated temperature or may not be fully cured. In order to prevent separation between first material layer 210 and pad components 230, extractor sheet 324 may be pulled from base 321, which effectively pushes pad components 230 from extractor elements 322, as depicted in FIGS. 11I and 12I. That is, extractor sheet 324 is separated from extractor elements 322 to push pad components 230 from extractor 320. Upon fully separating extractor sheet 324 from extractor elements 322, the combination of first material layer 210 and pad components 230 is free from extractor 320, as depicted in FIGS. 11J and 12J.

Figure 11K:
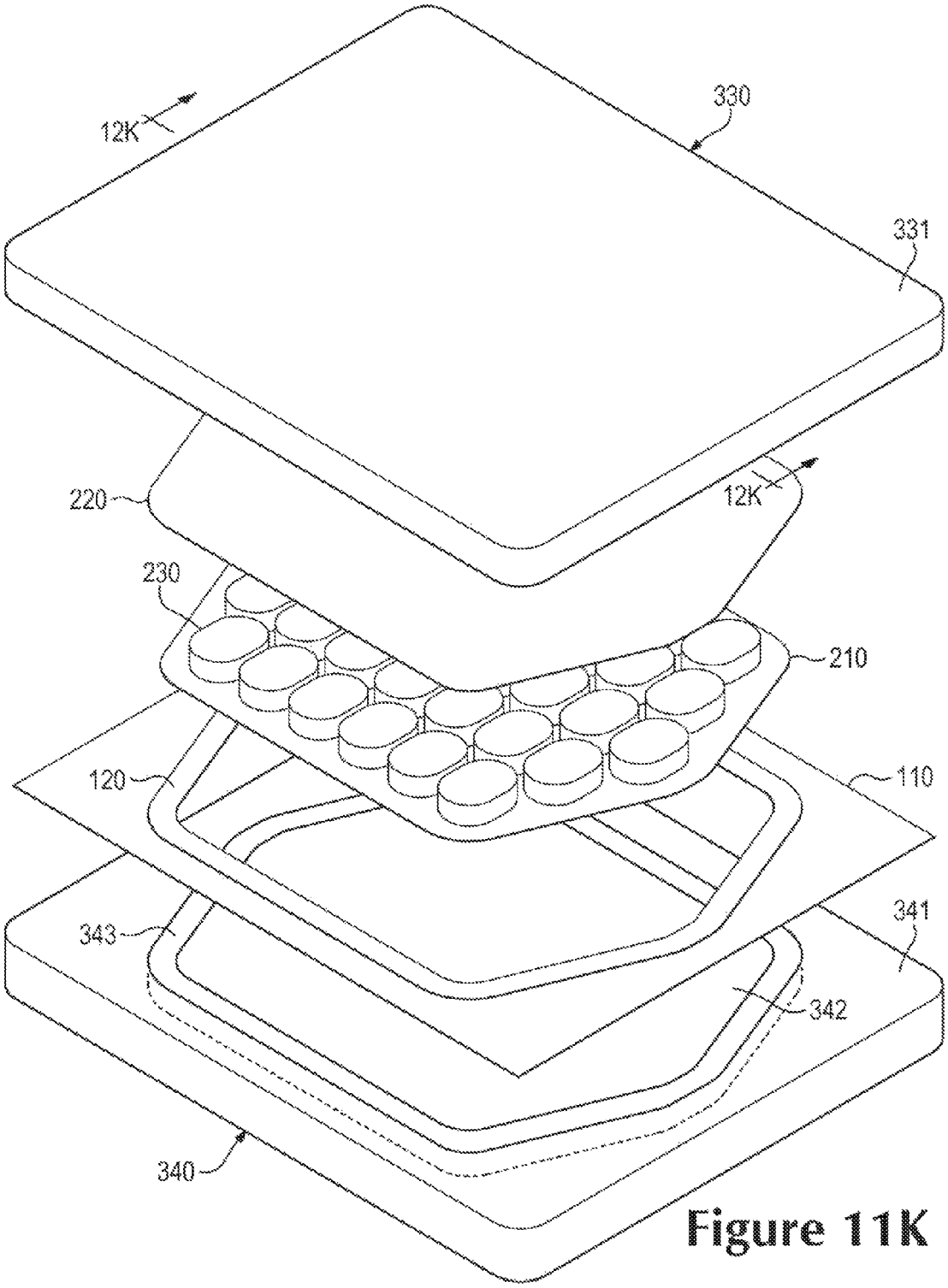
Figure 11L:
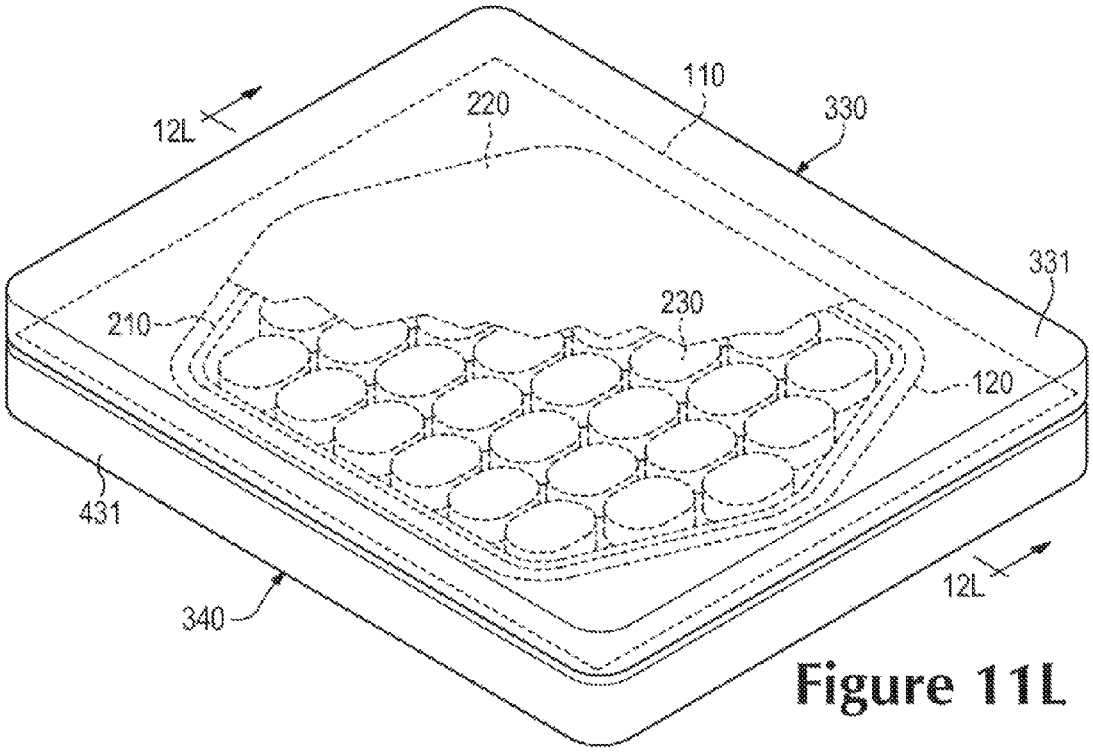
Figure 12K:
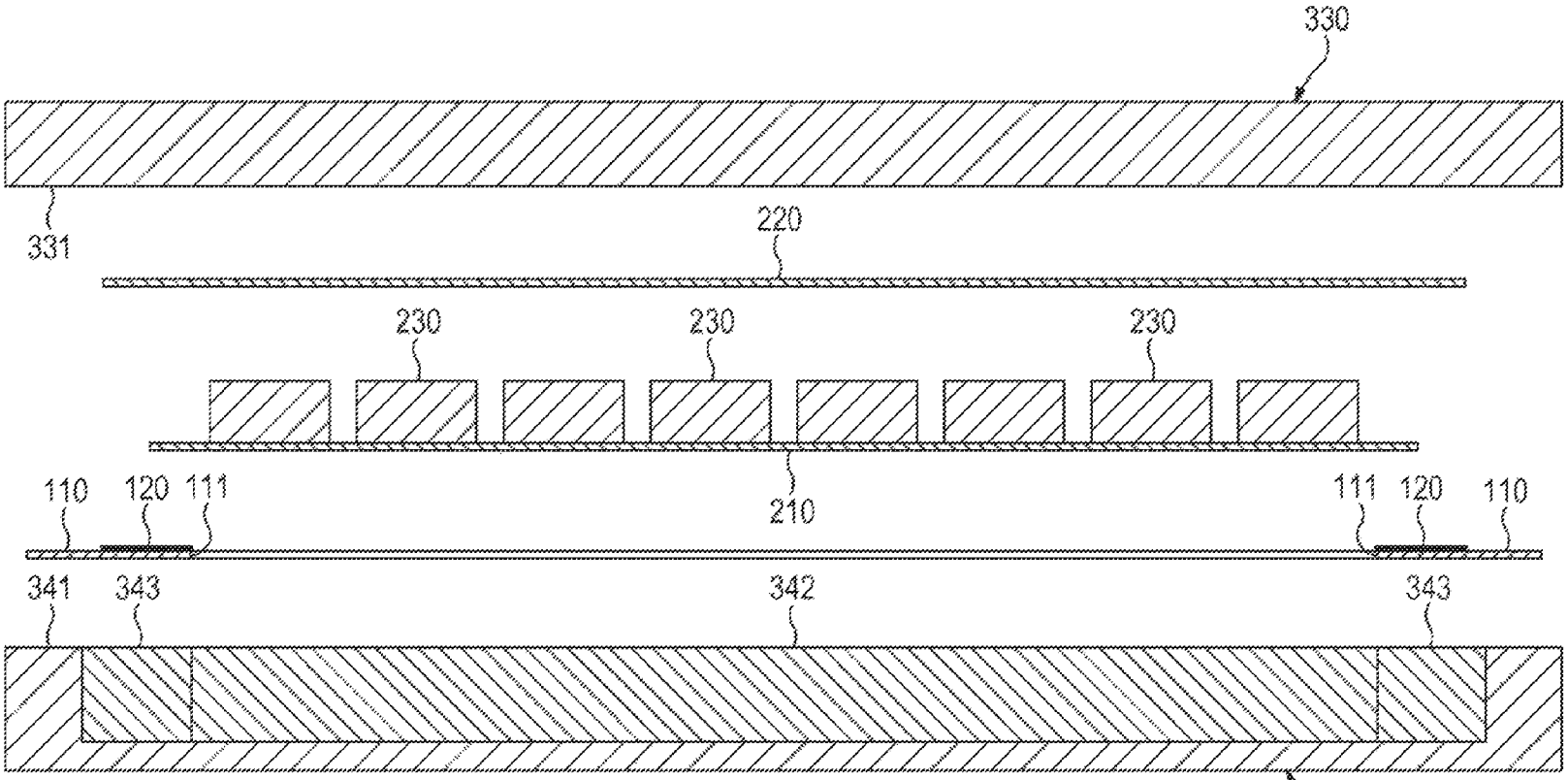
Figure 12L:
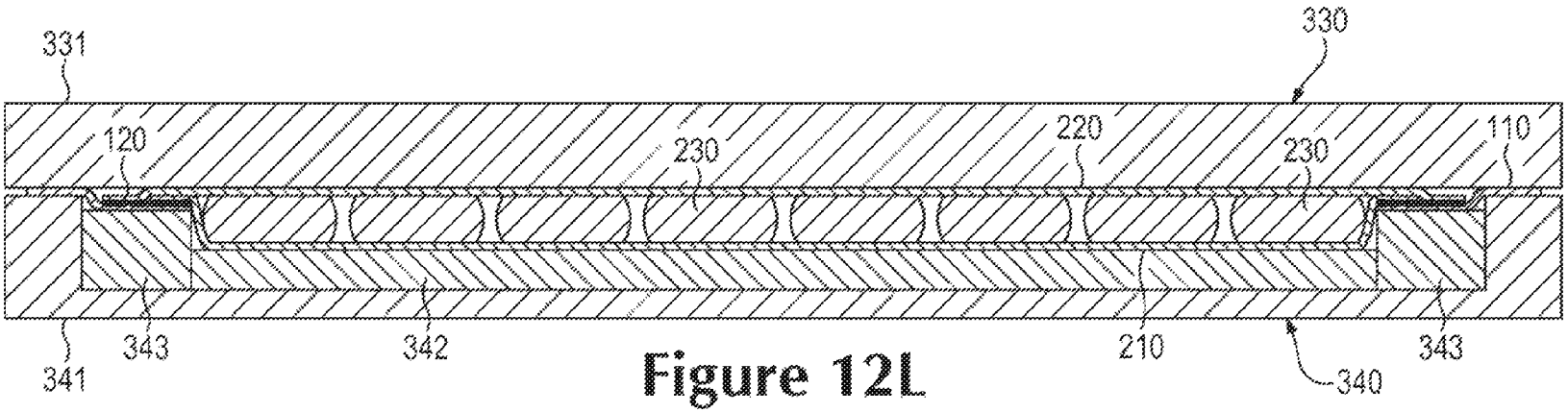

Continuing with the manufacturing of cushioning element 200, the combination of base layer 110 and bonding element 120 is placed adjacent to press plate 340, second material layer 220 is placed adjacent to heating plate 330, and the combination of first material layer 210 and pad components 230 is located between these elements, as depicted in FIGS. 11K and 12K. Referring specifically to FIG. 12K, note that (a) pad components 230 are located to correspond with a position of first compressible element 342 and (b) bonding element 120 is located to correspond with a location of second compressible element 343. Press plate 340 and heating plate 330 then close upon and compress the elements, as depicted in FIGS. 11L and 12L. Given the elevated temperature of base 331, bonding (e.g., thermalbonding) occurs between (a) first material layer 210 and a portion of bonding element 120 that is adjacent to aperture 111 to secure first material layer 210 to interior surface 106 of base layer 110, (b) second material layer 220 and a portion of bonding element 120 that is spaced from aperture 111 to secure second material layer 220 to interior surface 106 of base layer 110, and (c) second material layer 220 and pad components 230. Note that this process also secures or bonds (a) first material layer 210 to a portion of bonding element 120 that is adjacent to aperture 111 and (b) second material layer 220 to a portion of bonding element 120 that is spaced from aperture 111.

The varying compressibilities of first compressible element 342 and second compressible element 343 assist with forming the various bonds discussed above. Pad components 230 exhibit greater thickness than other elements within cushioning element 200. As a result, first compressible element 342 compresses or otherwise deforms to accommodate the thickness of pad components during bonding of second material layer 220 and pad components 230. Second compressible element 343 has lesser compressibility than first compressible element 342 because the thickness of base layer 110, bonding element 120, and material layers 210 and 220 is relatively small. Although second compressible element 342 will compress during the formation of bonds between (a) first material layer 210 and a portion of bonding element 120 that is adjacent to aperture 111 and (b) second material layer 220 and a portion of bonding element 120 that is spaced from aperture 111, the degree of compression will be less than that of first compressible element 342. Accordingly, compressible elements 342 and 343 each have compressibilities that accommodate the thicknesses of the components being compressed.

Although utilizing both compressible elements 342 and 343 provides an effective manner of bonding various elements, other configurations for press plate 340 may also be utilized. For example, second compressible element 343 may be absent in some configurations of press plate 340. Additionally, press plate 340 may be formed to have a contoured configuration with a depression for receiving pad components 230 instead of both of compressible elements 342 and 343.

Figure 11M:
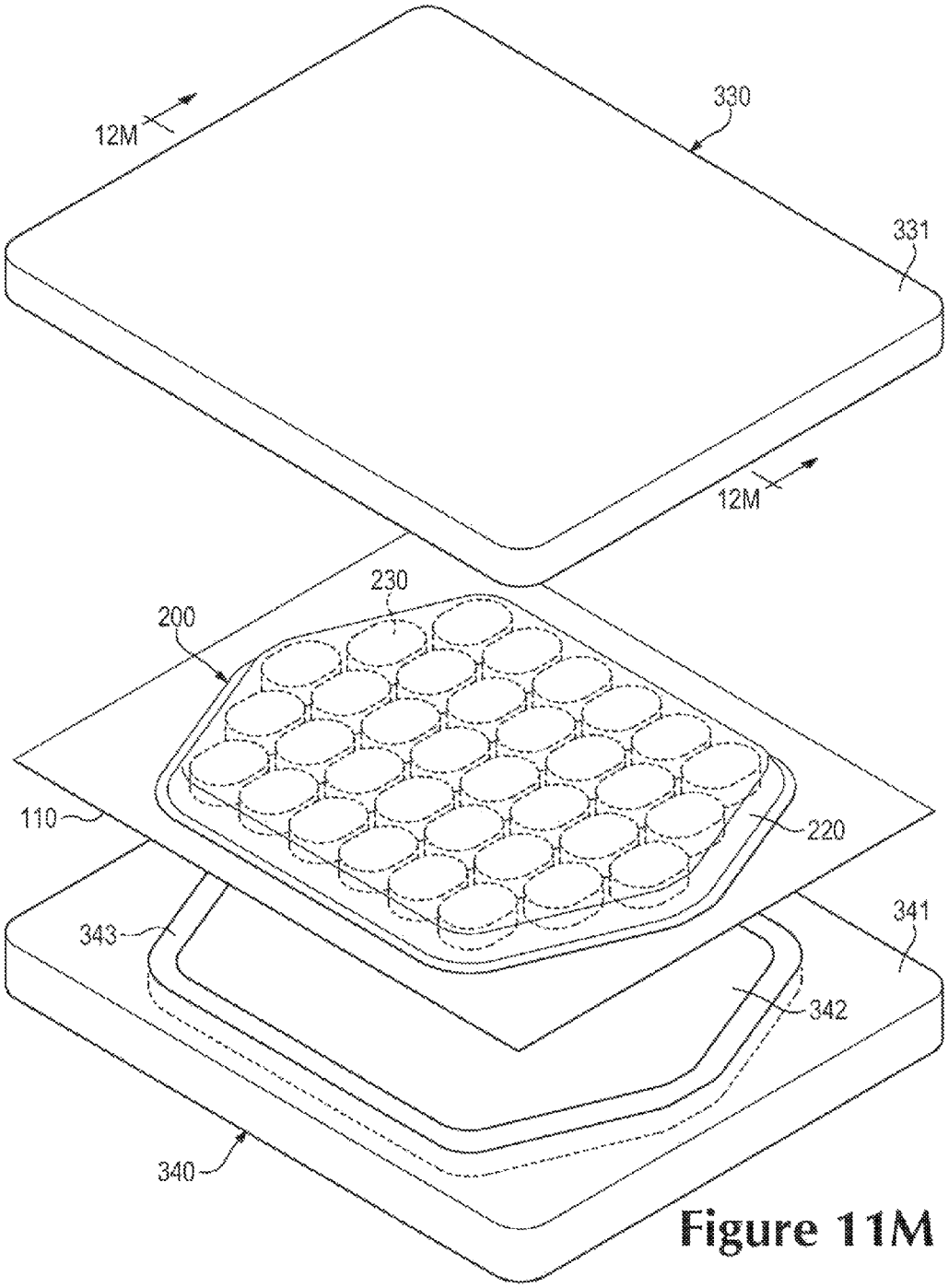
Figure 12M:
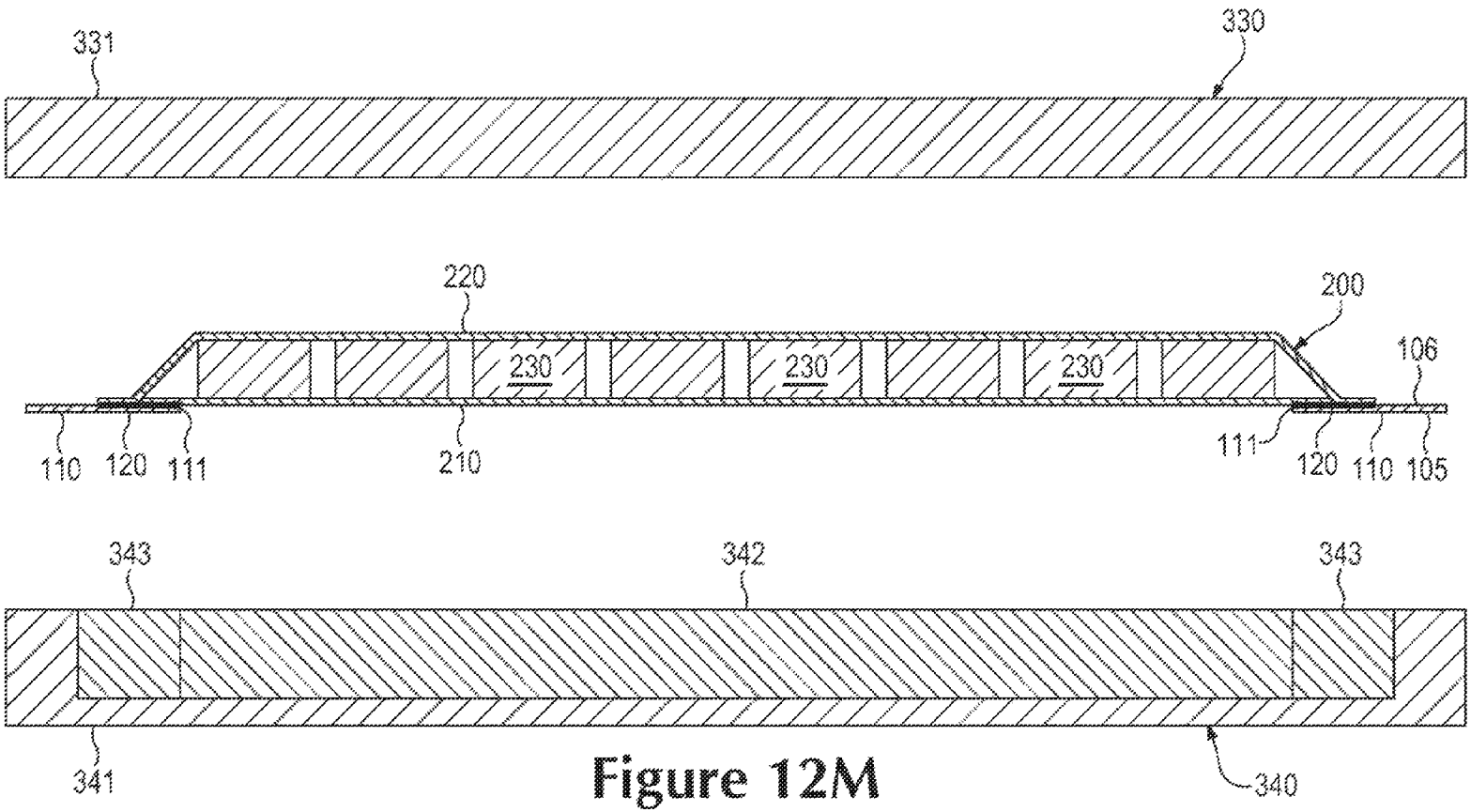

Once compression and bonding are complete, heating plate 330 and press plate 340 separate to expose the bonded base layer 110, bonding element 120, first material layer 210, second material layer 220, and pad components 230, as depicted in FIGS. 11M and 12M. At this stage of the manufacturing process, the manufacture of a portion of apparel 100 and cushioning element 200 is effectively complete.

The above discussion of FIGS. 11A-11M and 12A-12M provides an example of a suitable manufacturing process for a portion of apparel 100 and cushioning element 200. In general, an advantage of the manufacturing process is that the arrangement of die elements 312 determines the resulting arrangement of pad components 230 in cushioning element 200. That is, die 310 is initially set such that die elements 312 are positioned in a particular arrangement, and the resulting positions of pad components 230 effectively mirrors the arrangement of die elements 312. Accordingly, the positions of pad components 320 may be pre-selected through the arrangement of die elements 312.

Figure 11N:
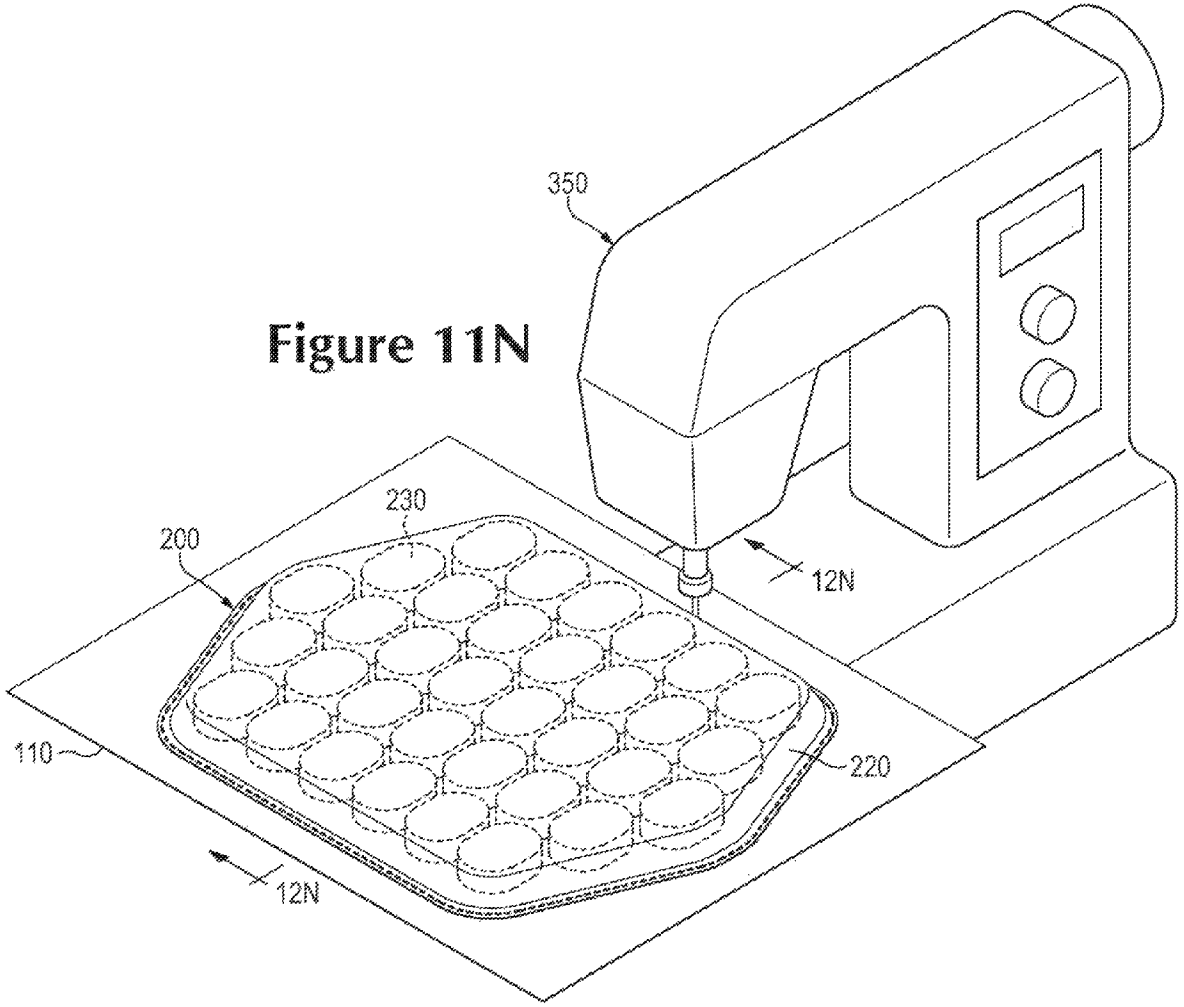
Figure 12N:
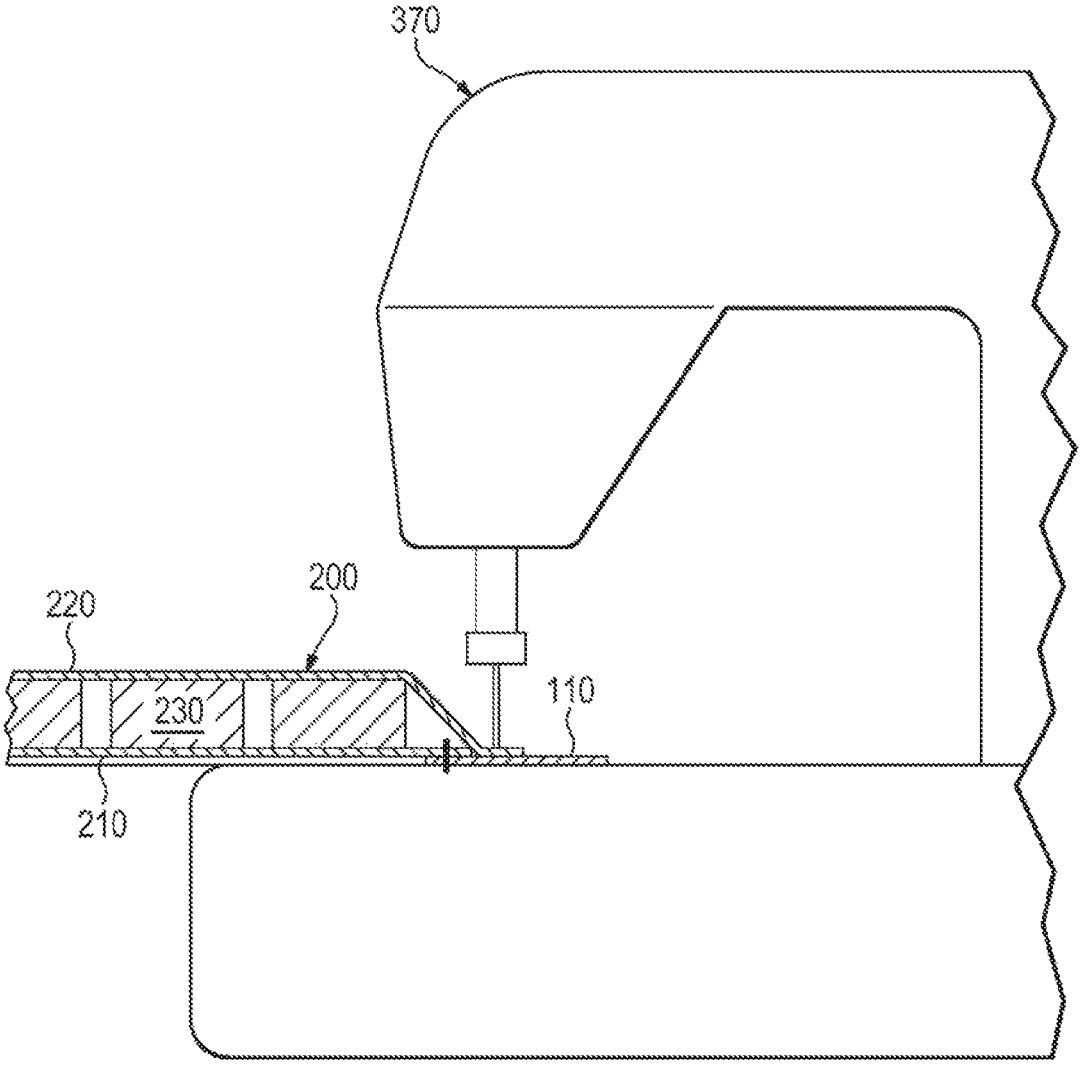

An additional advantage of the manufacturing process is that all the elements of cushioning element 200 may be joined through thermalbonding without the need for additional manufacturing steps. In some configurations, however, optional stitching, adhesive, or thermalbonding steps may be utilized to supplement the joining of material layers 210 and 220 around the periphery of pad components 230. As an example, referring to FIGS. 11N and 12N, a sewing or stitching machine 370 may be utilized to further secure material layers 210 and 220 to each other. Additionally, sewing or stitching machine 370 may be utilized to incorporate cushioning element 200 into apparel 100 or another article.

A variety of other manufacturing processes or variations of the manufacturing process discussed above may also be utilized. For example extractor elements 322 may retract within base 321. Although extractor elements 322 are depicted as having a length that is less than a thickness of pad components 230, extractor elements 322 may have a greater length. An advantage of forming extractor elements 322 to have a greater length is that pad components 230 with greater thicknesses may be formed and incorporated into cushioning component 200. In other configurations, ejection material 313 may be absent or a mechanized ejector may be utilized within die elements 312. Moreover, extractor elements 322 may be removable or positioned in various locations to allow different configurations of pad components 230. Moreover, specialized machinery may be formed to automate the general manufacturing process discussed above.

As a further matter, extractor 320 and press plate 340 are depicted as being located below heating plate 330 in various steps. An advantage to this configuration relates to the positioning of elements forming cushioning element 200. More particularly, when extractor 320 and press plate 340 are below heating plate 330, the elements forming cushioning element 200 may be arranged or otherwise positioned on extractor 320 and press plate 340 prior to the application of heat from heating plate 330. In this configuration, heat is applied to the elements of cushioning element 200 only when heating plate 330 compresses the elements against either extractor 320 or press plate 340. Accordingly, the elements forming cushioning element 200 may be arranged in the absence of applied heat in configurations where heating plate 330 is above extractor 320 and press plate 340.

Further Cushioning Element Configurations

Aspects of cushioning element 200 may vary, depending upon the intended use for cushioning element 200 and the product in which cushioning element 200 is incorporated. Moreover, changes to the dimensions, shapes, and materials utilized within cushioning element 200 may vary the overall properties of cushioning element 200. That is, by changing the dimensions, shapes, and materials utilized within cushioning element 200, the compressibility, impact force attenuation, breathability, flexibility, and overall mass of cushioning element 200 may be tailored to specific purposes or products. A plurality of variations for cushioning element 200 are discussed below. Any of these variations, as well as combinations of these variations, may be utilized to tailor the properties of cushioning element 200 to an intended use or particular product. Moreover, any of these variations may be manufactured through the process or variations of the process discussed above.

Figure 13:
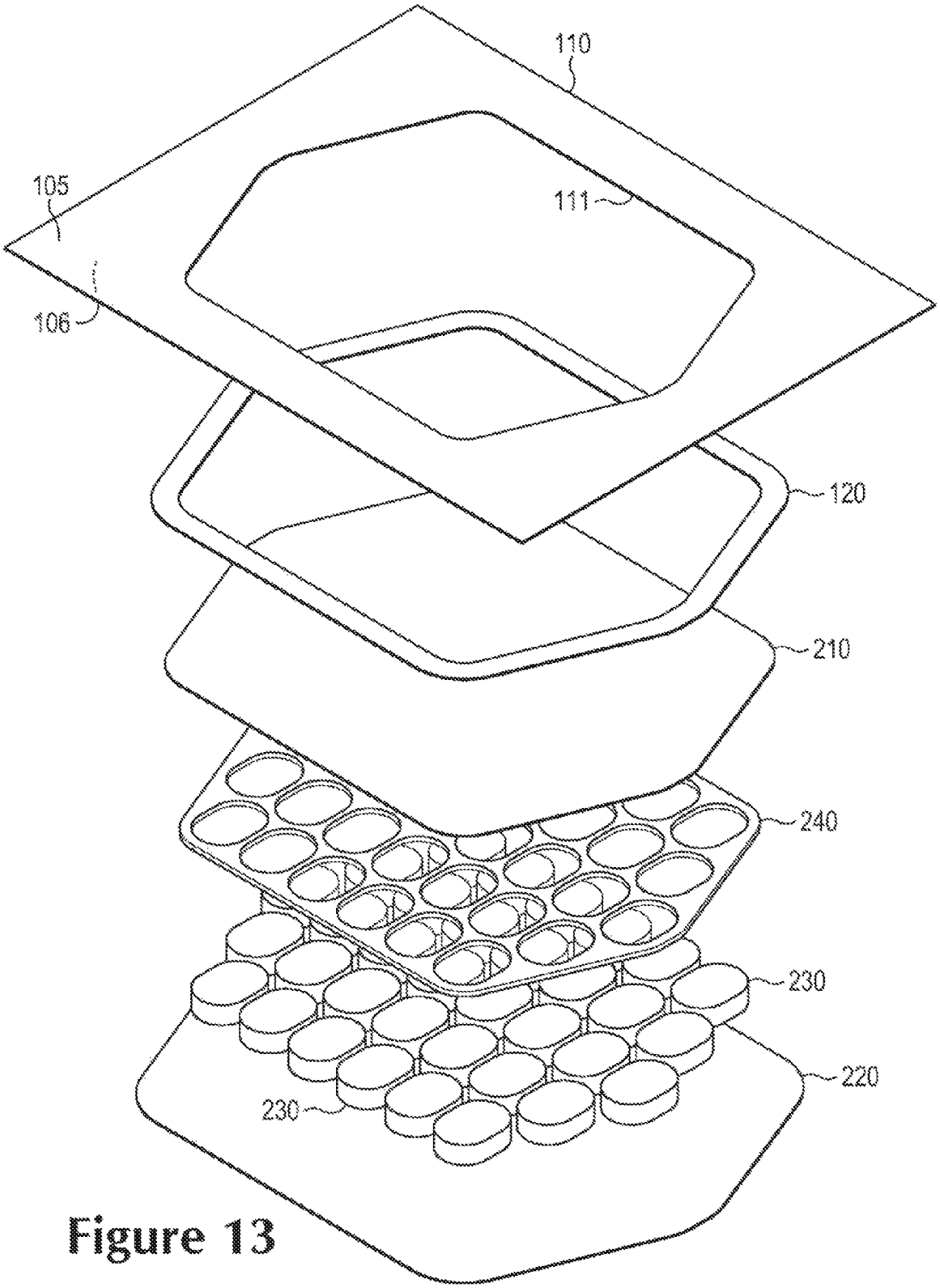
FIG. 13 is an exploded perspective views corresponding with FIG. 7B and depicting a further configuration of the portion of the apparel.

A further configuration of cushioning element 200 is depicted in FIG. 13, wherein a frame component 240 is positioned to extend around and between various pad components 230. Although pad components 230 are secured to material layers 210 and 220, frame component 240 may be unsecured to layers 210 and 220, and a thickness of frame component 240 may be less than the thickness of pad components 230. An advantage of frame component 240 relates to providing additional protection when objects contact cushioning element 200 and protrude between pad components 230.

Figure 14A:
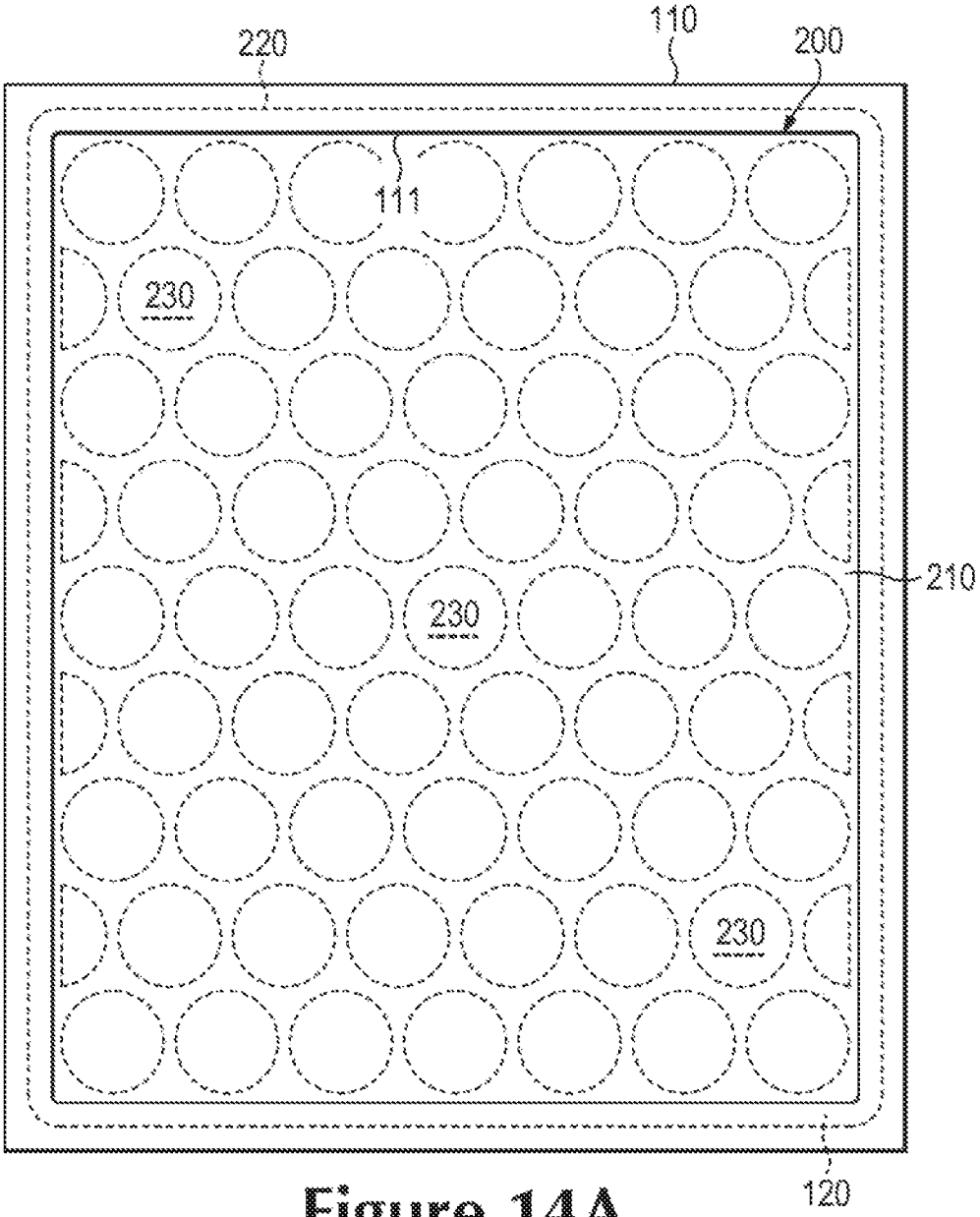
FIGS. 14A-14N are top plan views corresponding with FIG. 8 and depicting further configurations of the portion of the apparel.
Figure 14B:
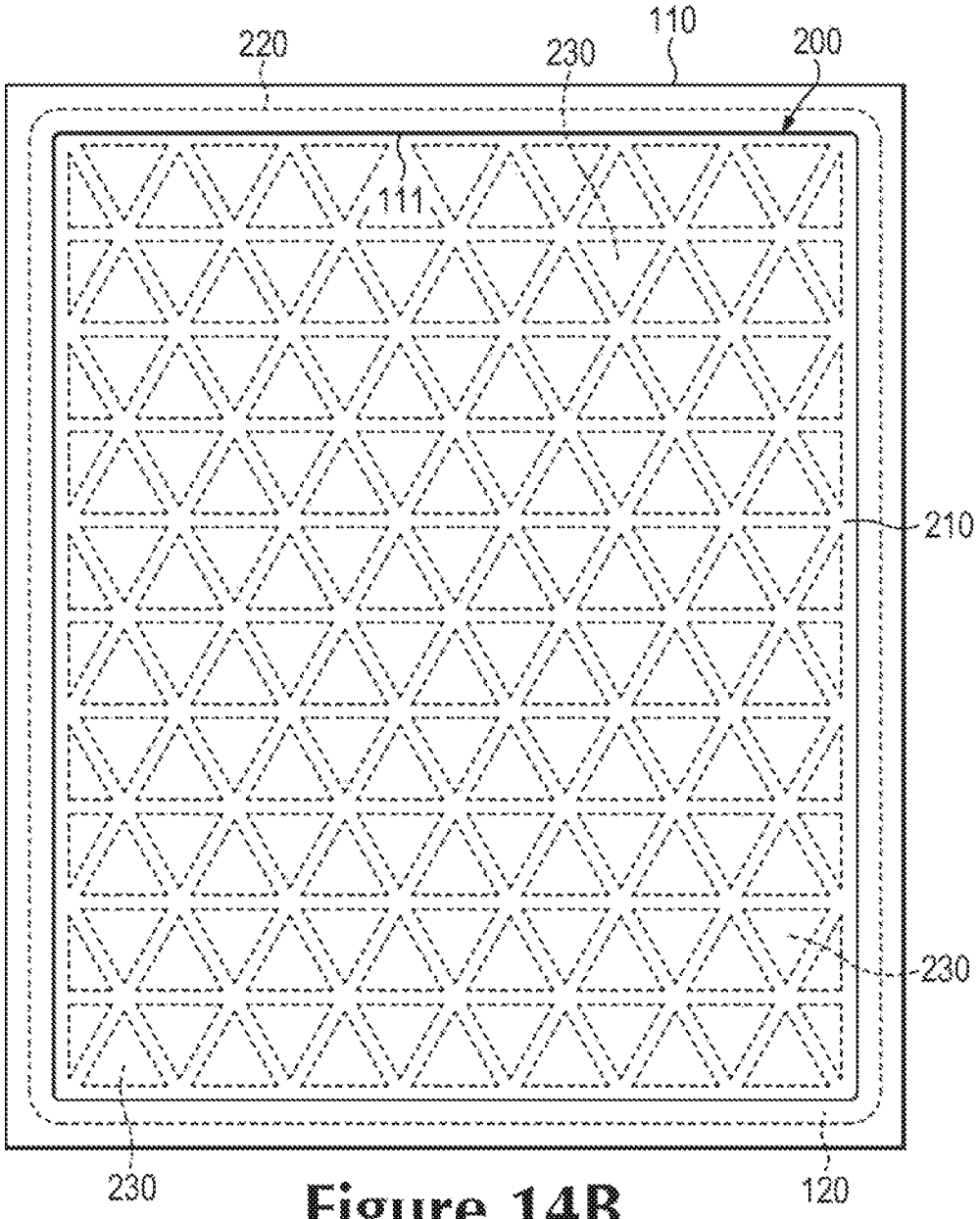
Figure 14C:
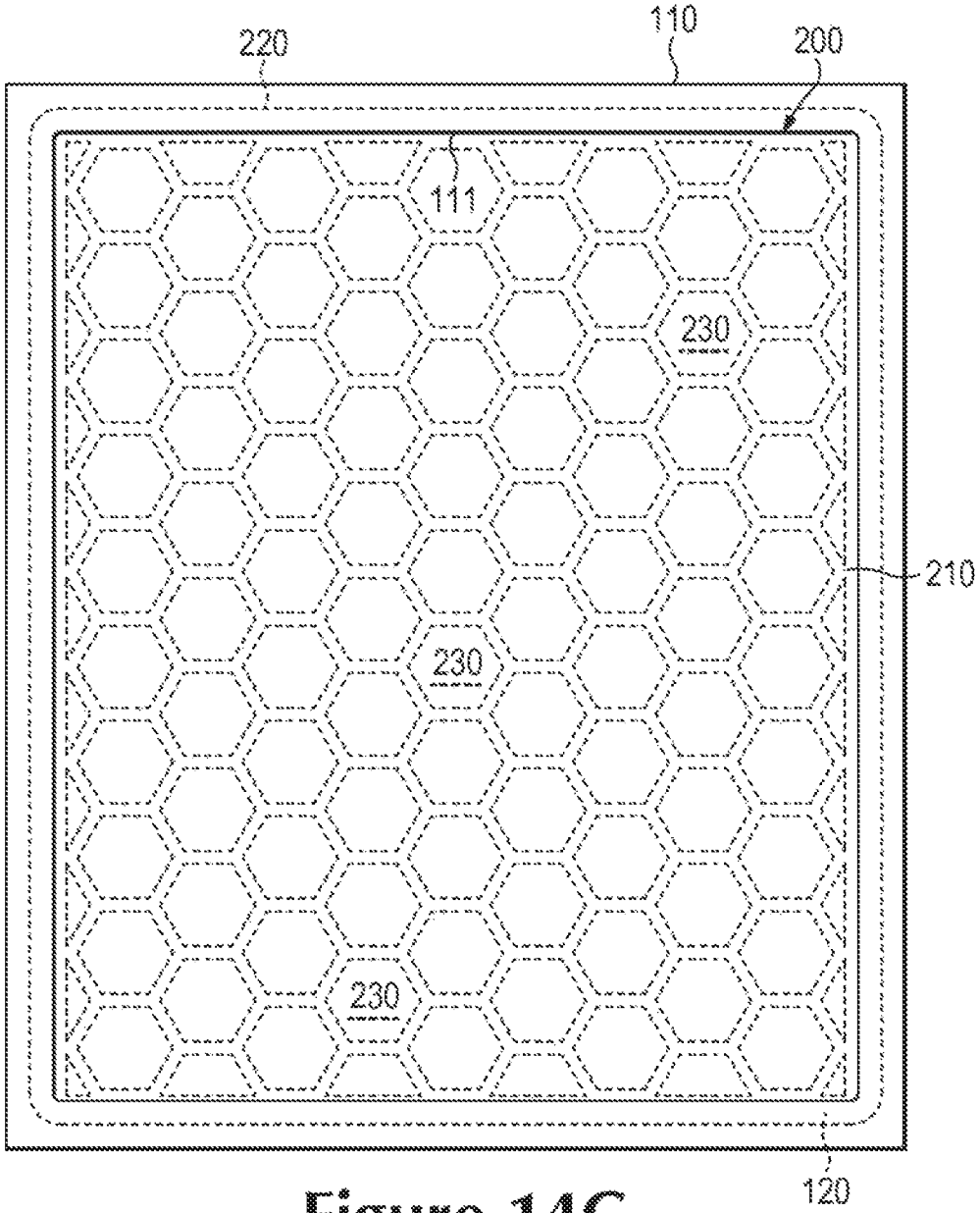
Figure 14D:
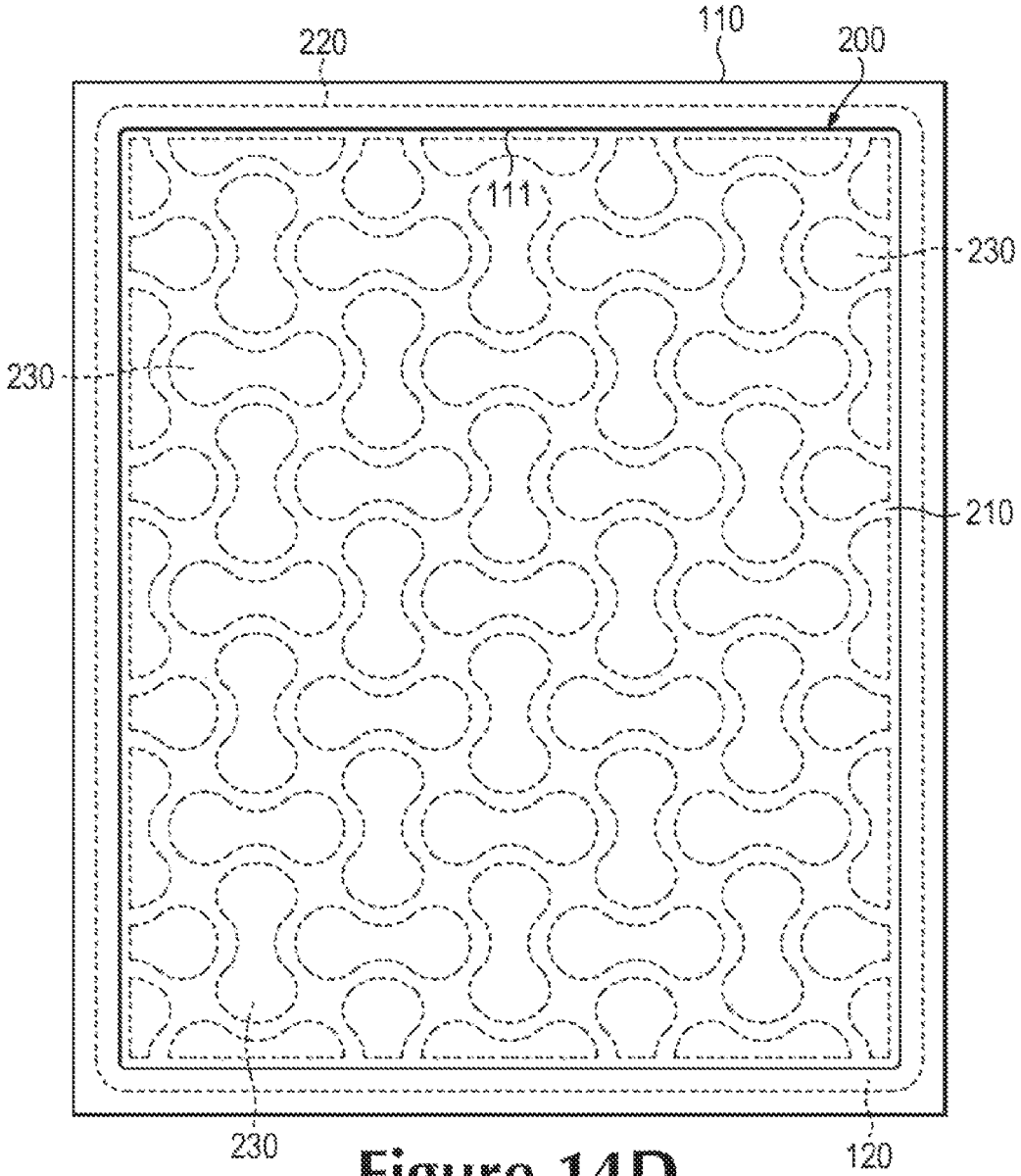
Figure 14E:
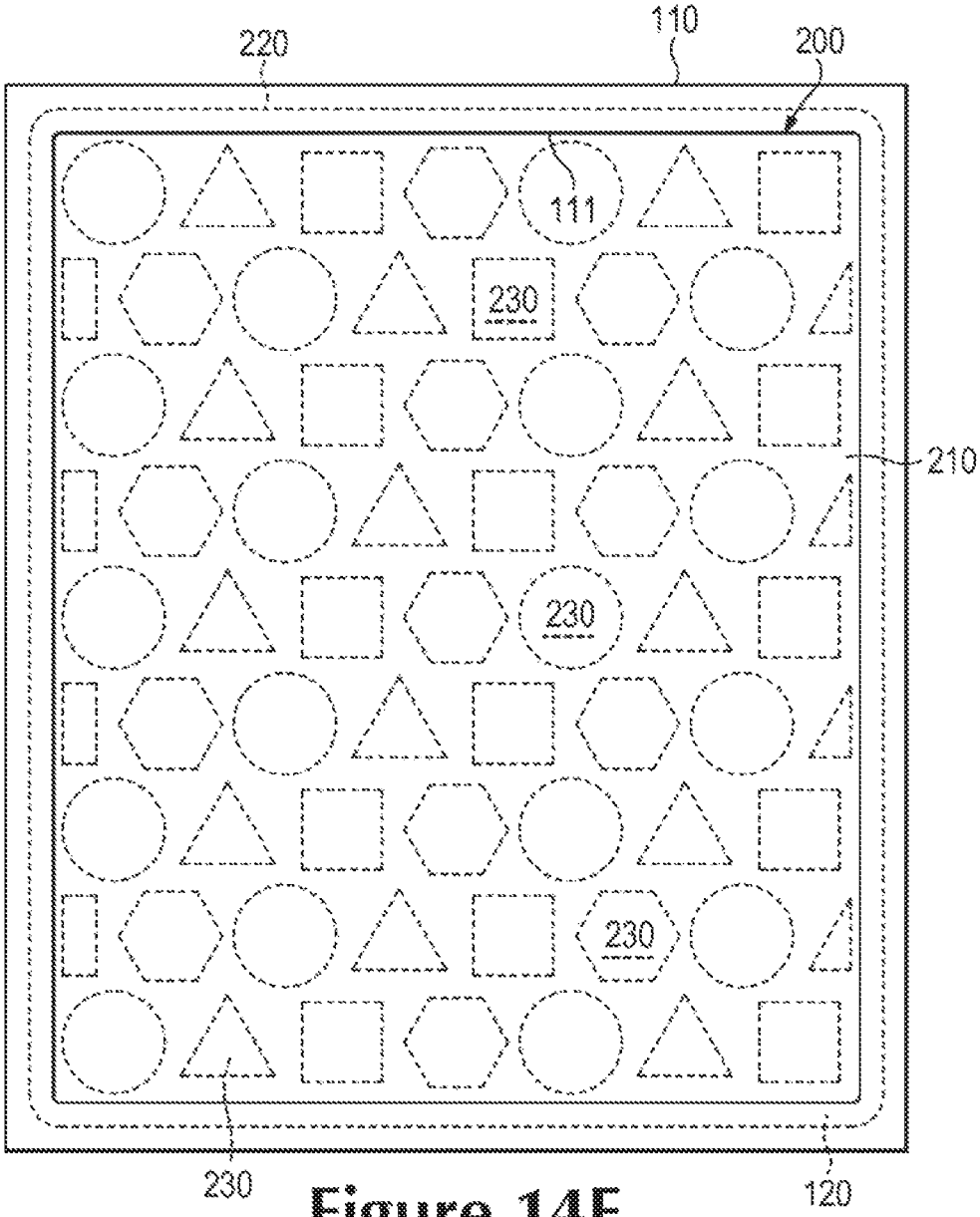
Figure 14F:
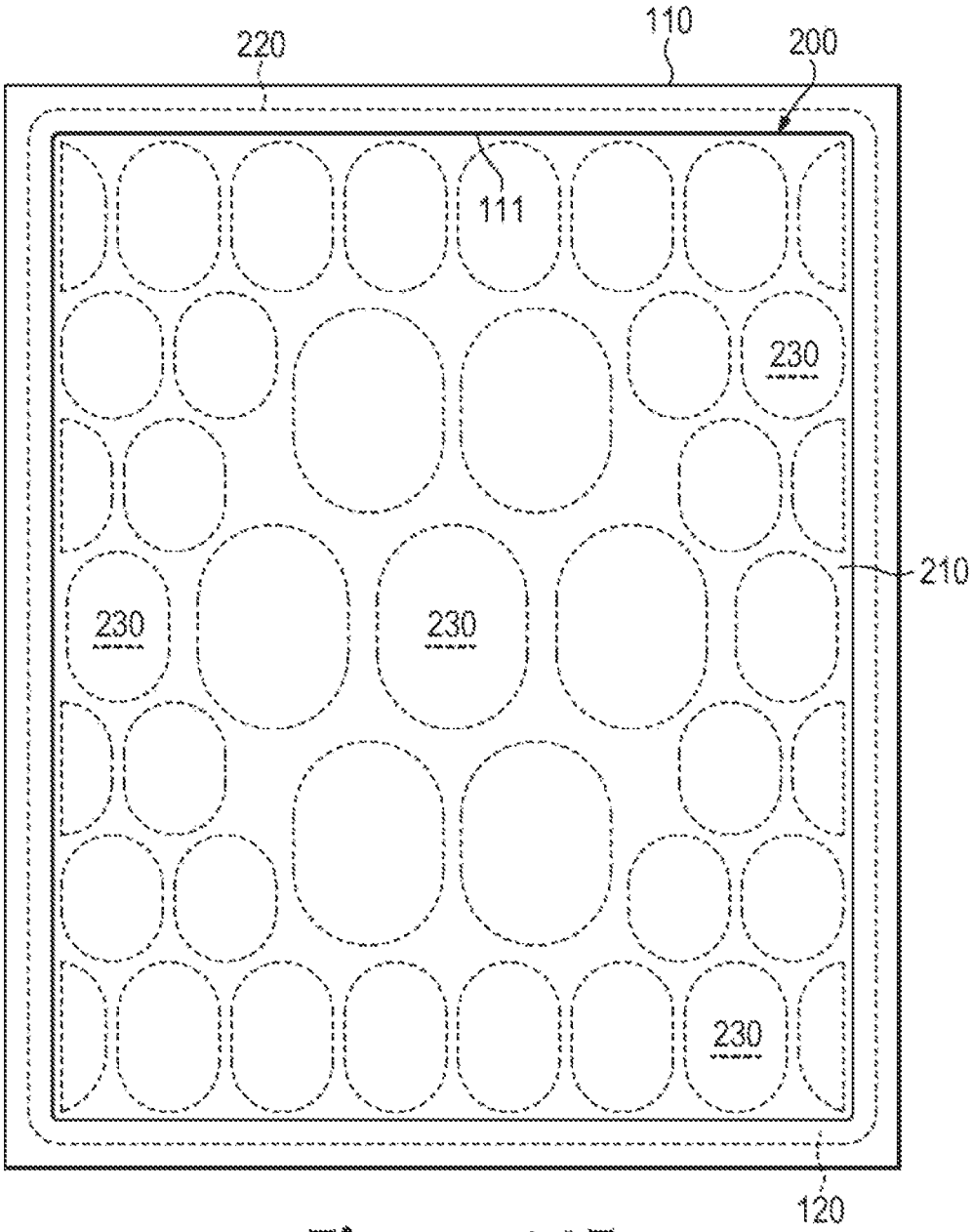

As discussed above, pad components 230 have an elliptical or generally elongate shape with rounded end areas. Pad components 230 may, however, have a variety of other shapes, including round, triangular, and hexagonal, as respectively depicted in FIGS. 14A-14C. Pad components 230 may have an irregular shape, as depicted in FIG. 14D, or may be a mixture of different shapes, as depicted in FIG. 14E. Although each of pad components 230 may have the same shape and size, pad components 230 may also have generally similar shapes with a variety of different sizes, as depicted in FIG. 14F.

Figure 14G:
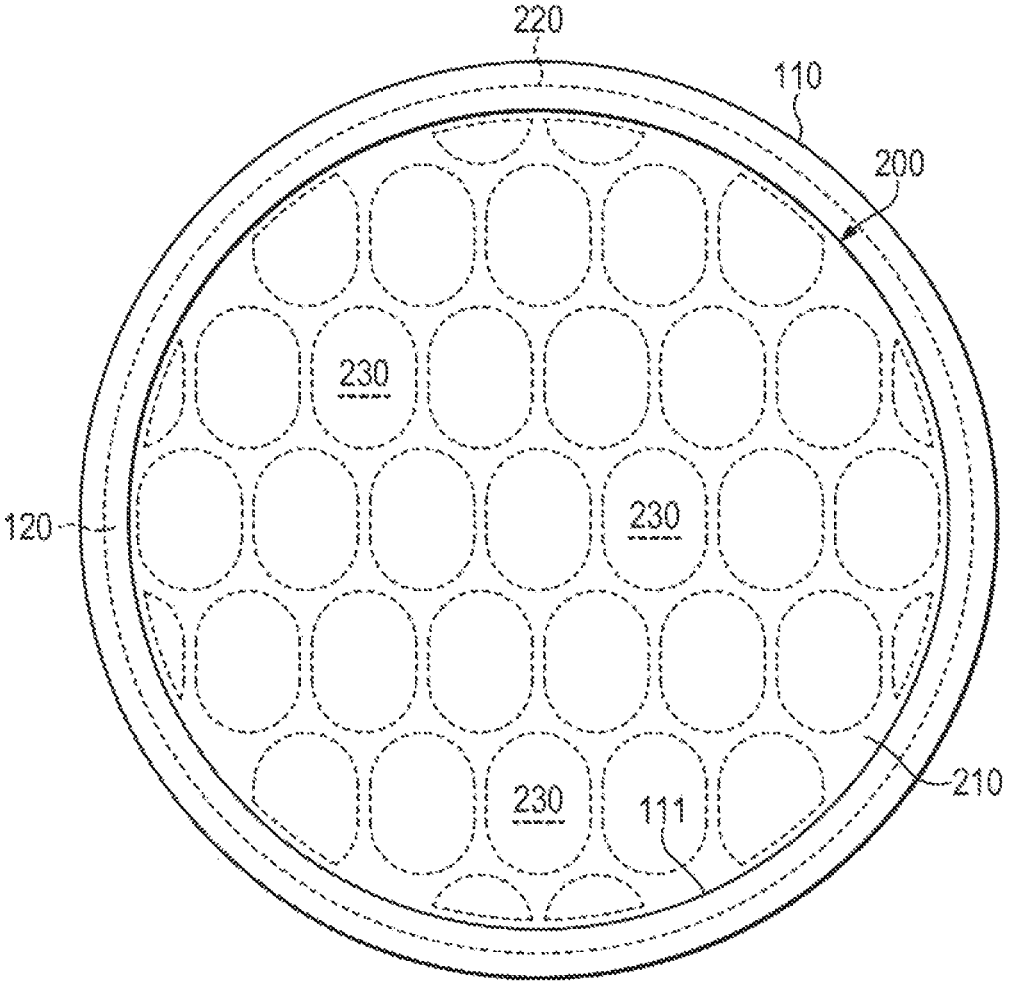
Figure 14H:
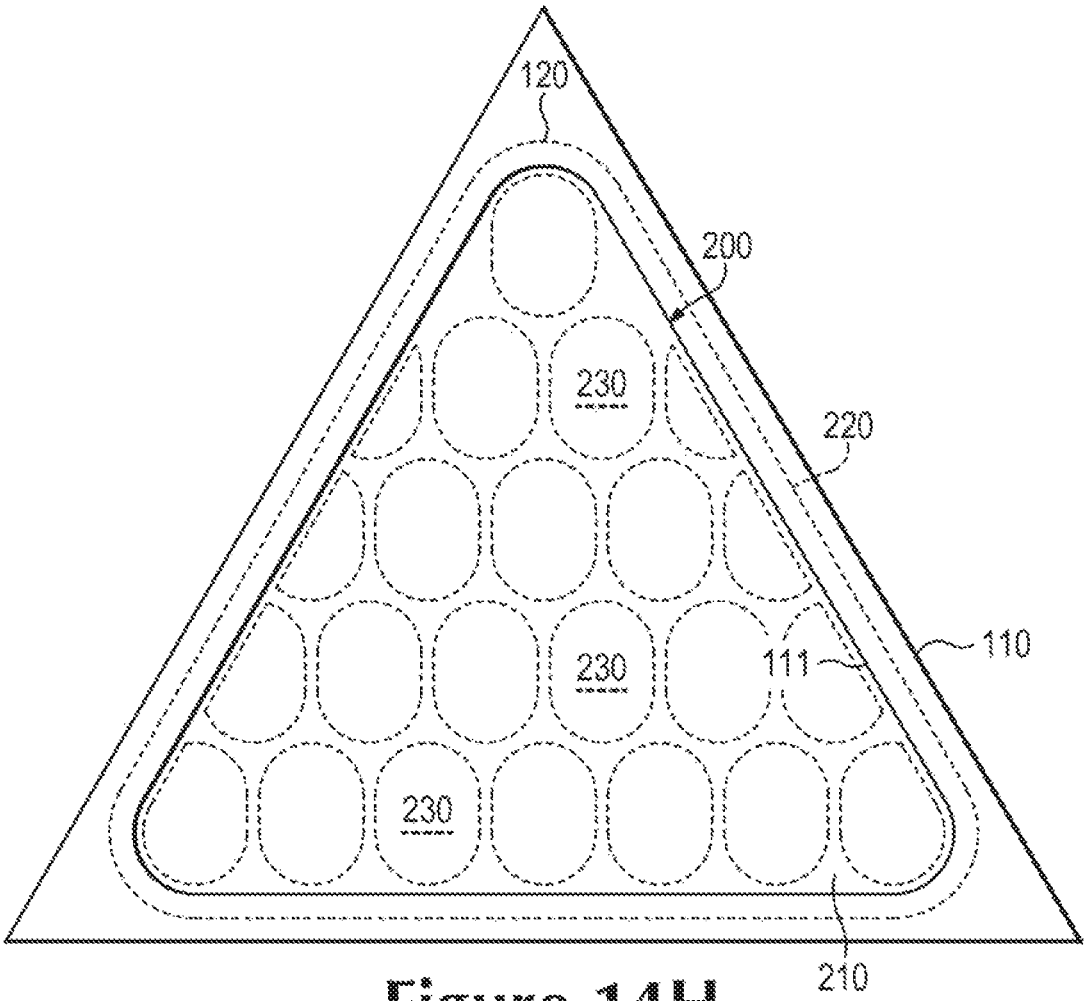
Figure 14I:
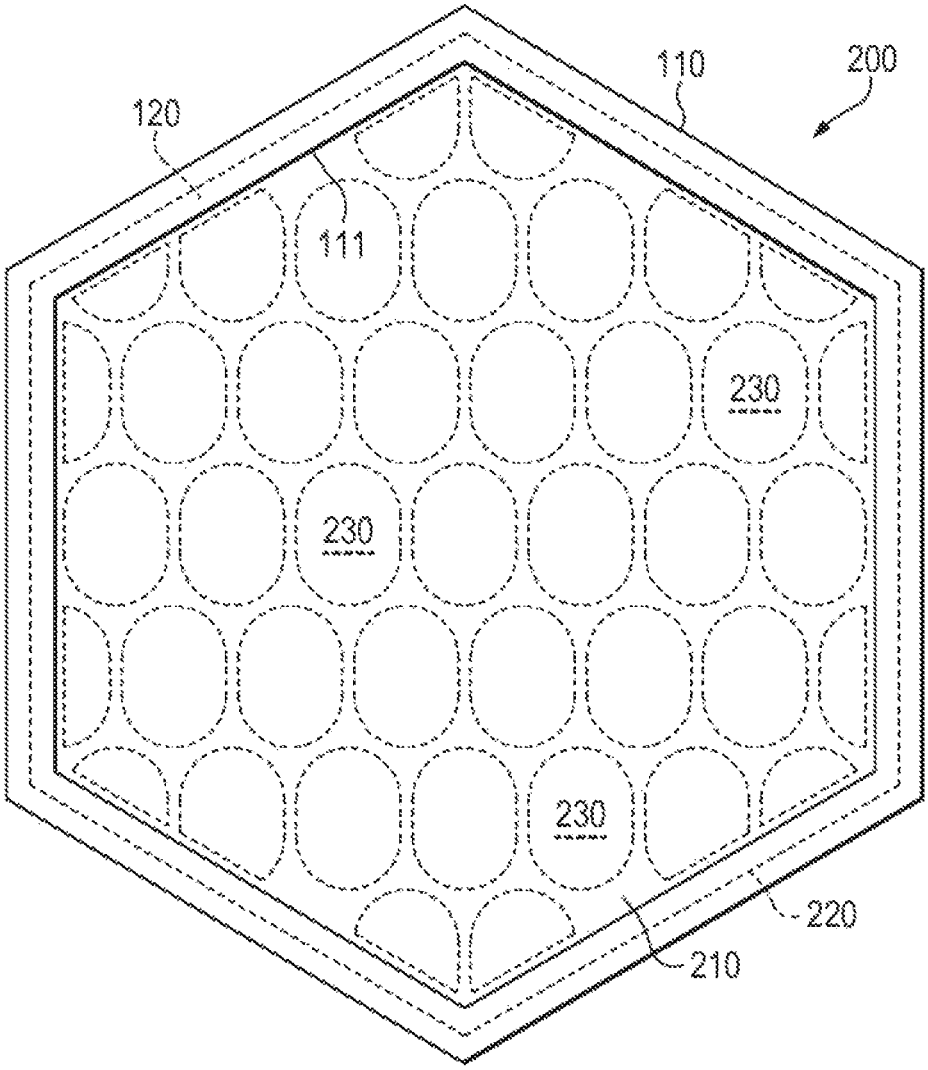
Figure 14J:
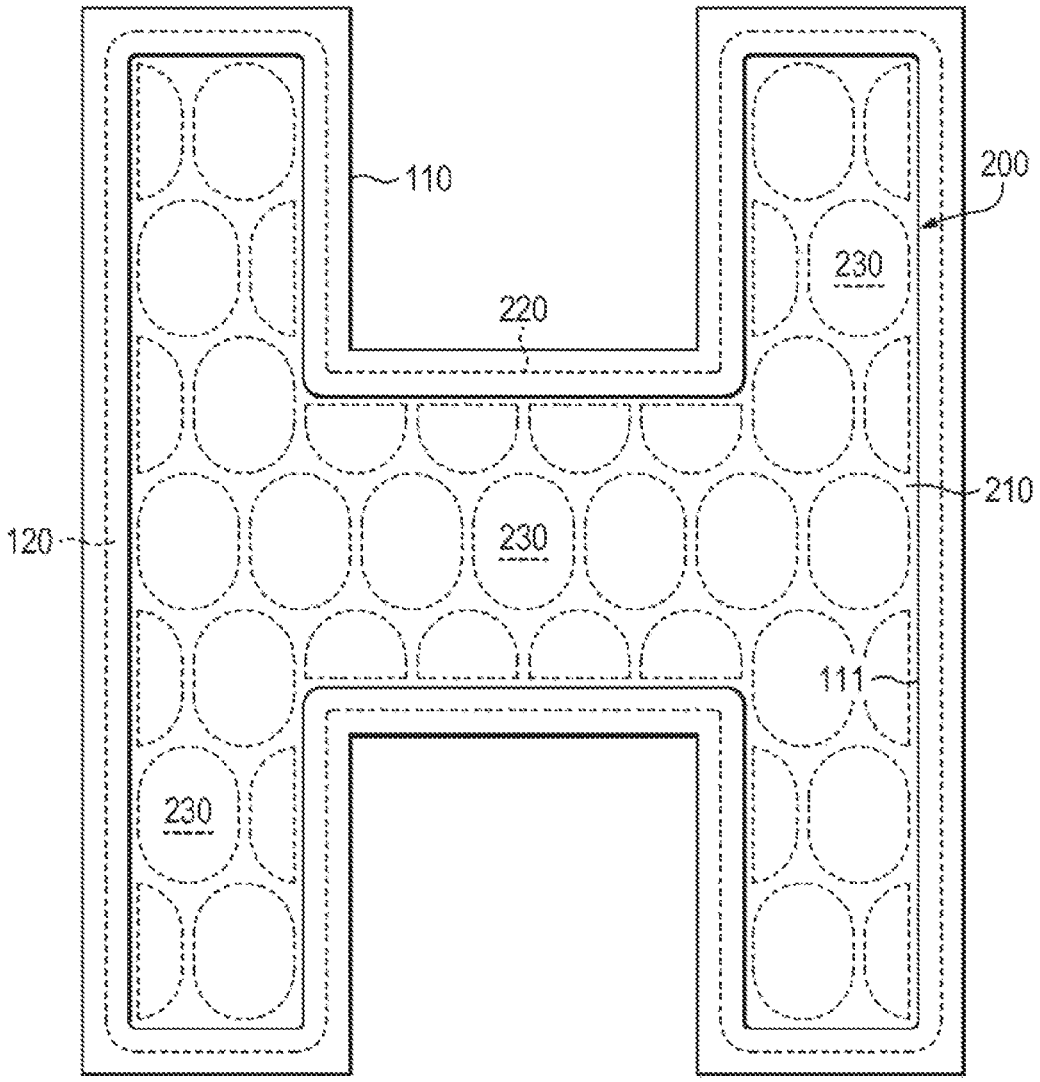
Figure 14K:
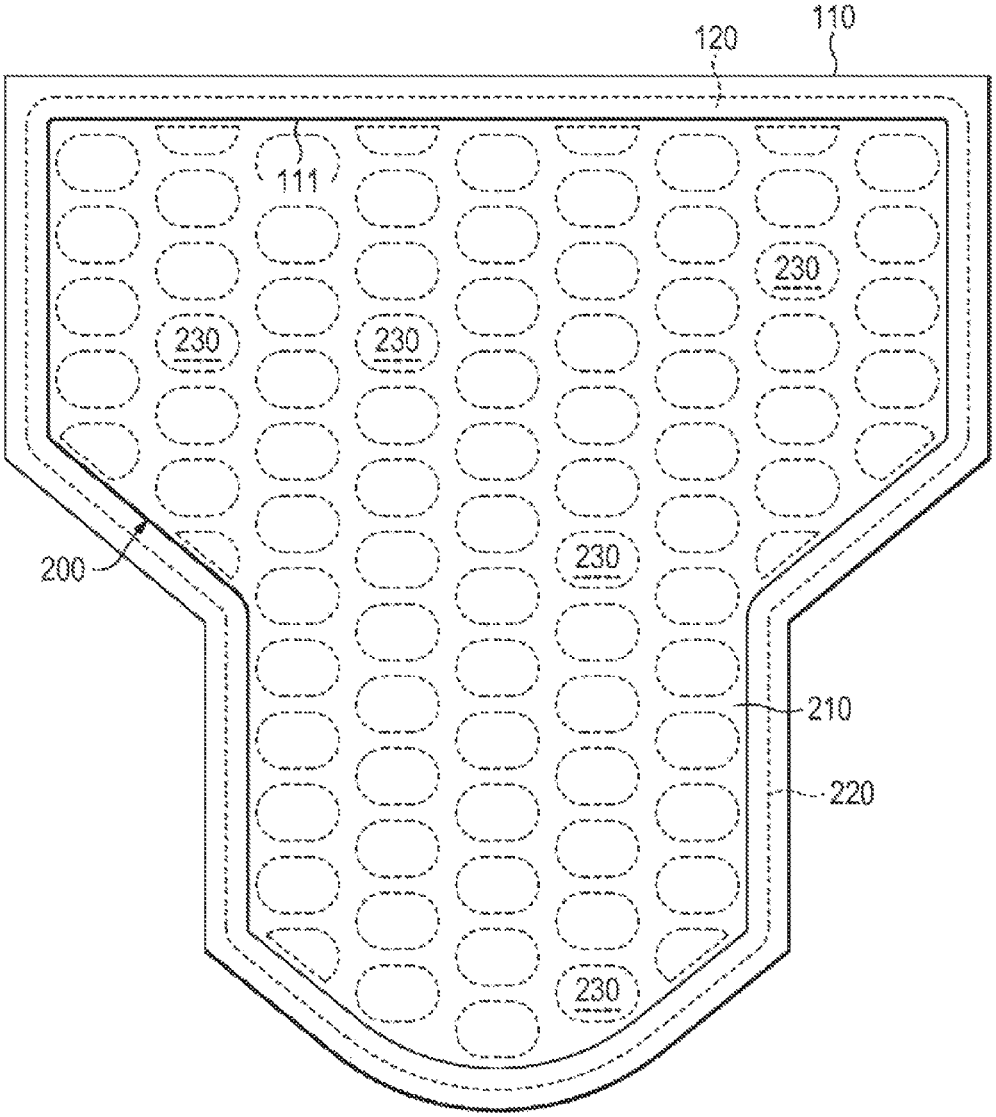
Figure 14L:
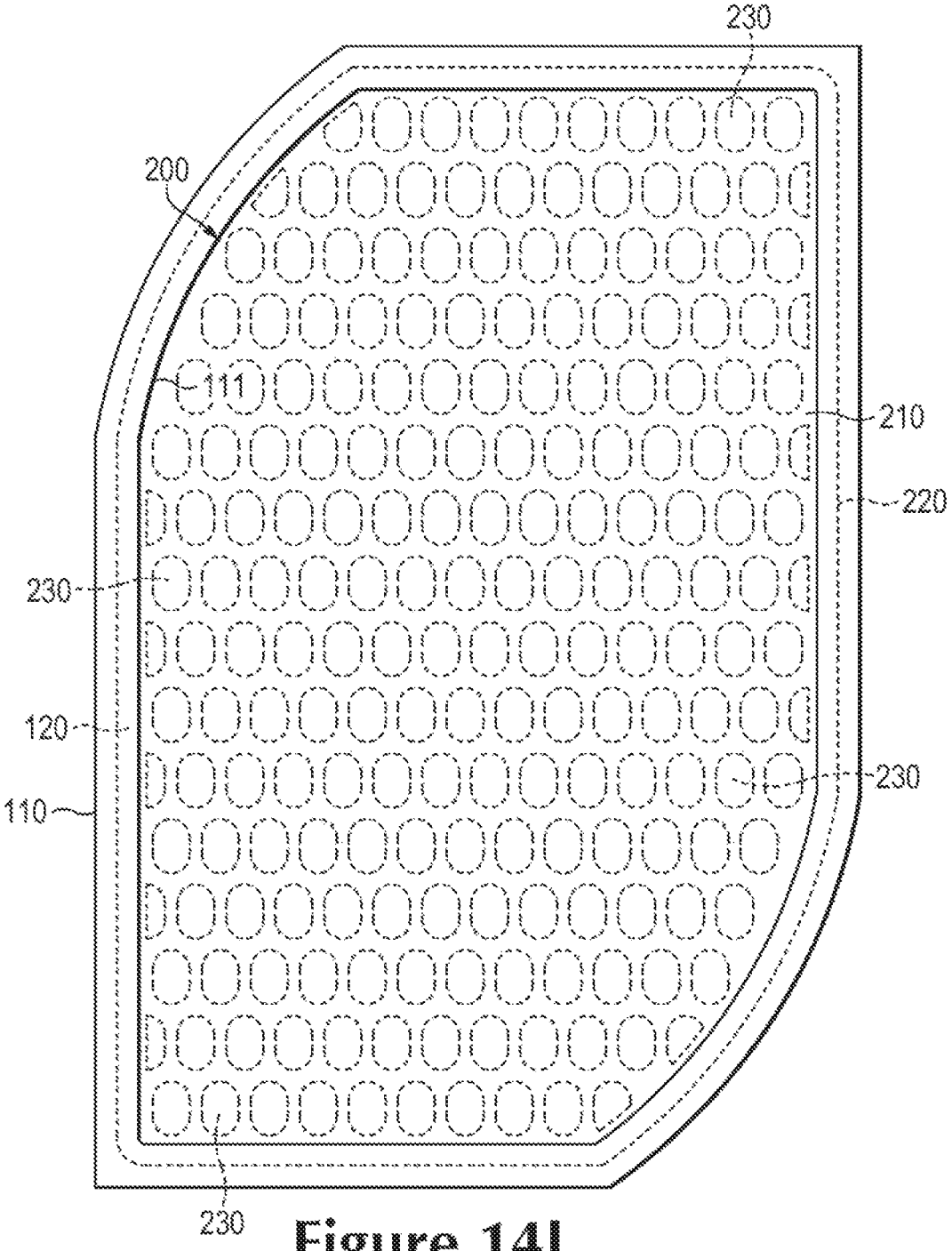
Figure 14M:
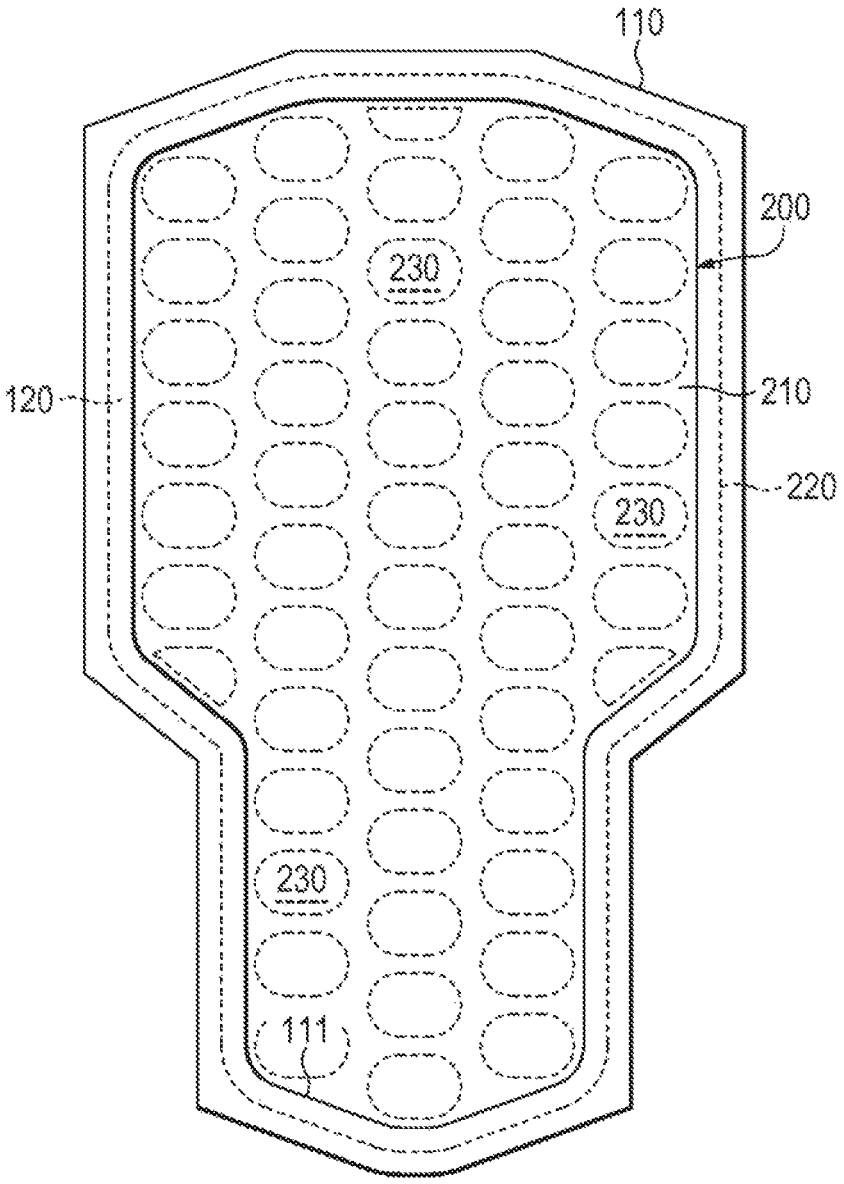

In addition to aspects of pad components 230 that may vary significantly, the overall shape of cushioning element 200 may vary. Referring to FIG. 14G, cushioning element 200 exhibits a generally round or circular shape. In further configurations, cushioning element 200 may have a triangular, hexagonal, or H-shaped structure, as respectively depicted in FIGS. 14H-14J. Various shapes for cushioning element 200 are also depicted in association with apparel 100 in FIGS. 1-5. An example of one of cushioning elements 200 that has a shape suitable for a hip pad is depicted in FIG. 14K. As more examples, one of cushioning elements 200 from apparel 100 that has a shape suitable for a thigh pad is depicted in FIG. 14L, and one of cushioning elements 200 from apparel 100 that has a shape suitable for a tailbone pad is depicted in FIG. 14M.

Figure 14N:
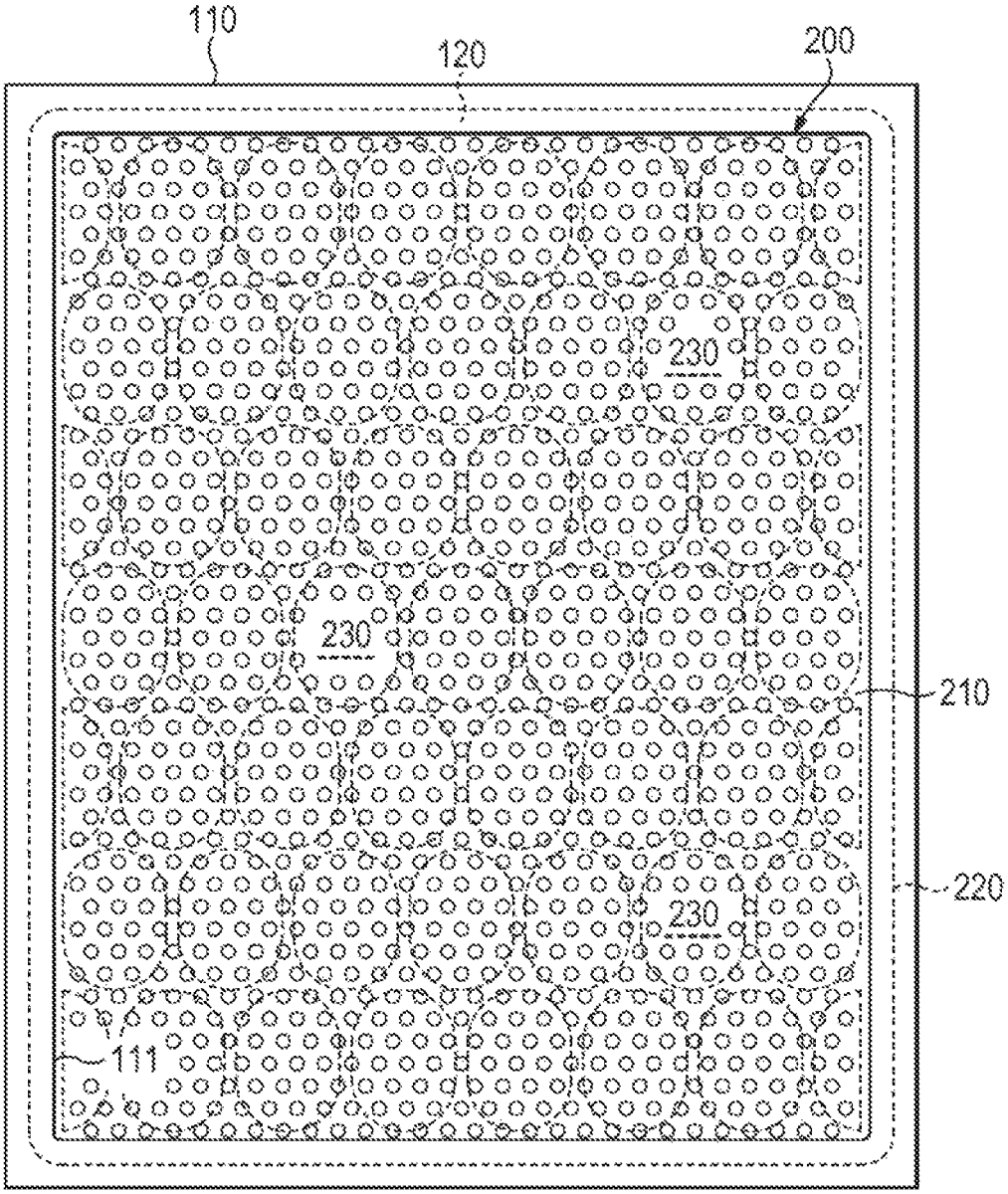

Various aspects relating to first material layer 210 and second material layer 220 may also vary significantly. As discussed above, material layers 210 and 220 may be formed from various textiles, polymer sheets, leather, synthetic leather, or combinations of materials, for example. Referring to FIG. 14N, first material layer 210 is depicted as having the configuration of a mesh material that defines a plurality of holes, through which pad components 230. In addition to imparting greater breathability that allows the transfer of air and moisture, a mesh material may allow for various aesthetic properties. More particularly, pad components 230 may have different colors that are visible through first material layer 210. In addition to a mesh material, other at least semi-transparent textile or polymer sheet materials may also permit pad components 230 with different colors to be visible. In further configurations, first material layer 210 may be entirely absent from cushioning element 200.

Figure 15A:
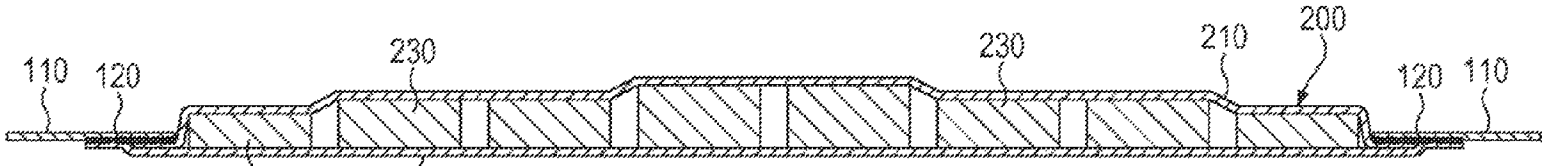
FIGS. 15A-15D are cross-sectional views corresponding with FIG. 9A and depicting further configurations of the portion of the apparel.
Figure 15B:
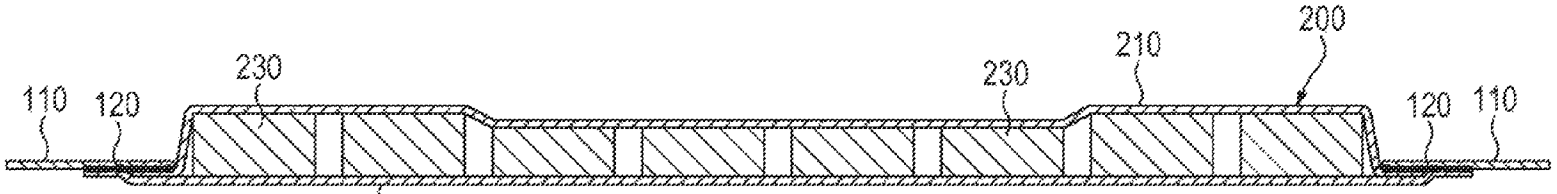
Figure 15C:
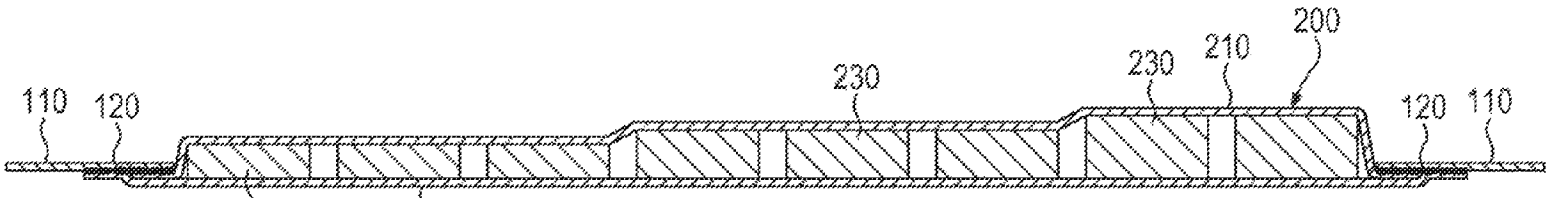
Figure 15D:
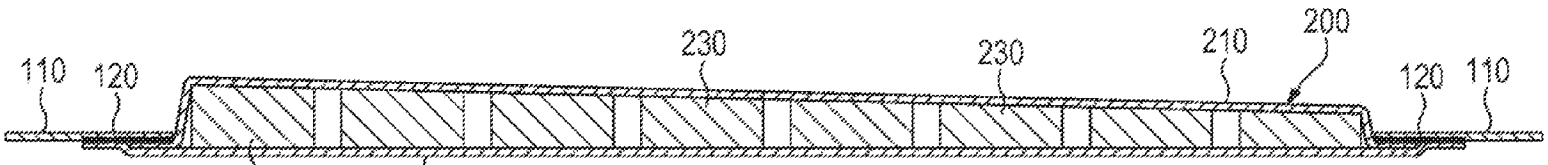

Although the thicknesses of pad components 230 (i.e., distance between surfaces bonded to material layers 210 and 220) may be constant, pad components 230 may also have varying thicknesses, as depicted in FIG. 15A. In some configurations of cushioning element 200, pad components 230 located in the central area may have lesser thickness than pad components 230 located in the peripheral area, as depicted in FIG. 15B. The thicknesses of pad components 230 may also decrease across the width of cushioning element 200, as depicted in FIG. 15C, or may taper across the width of cushioning element 200, as depicted in FIG. 15D.

Further Apparel Configurations

Figure 16A:
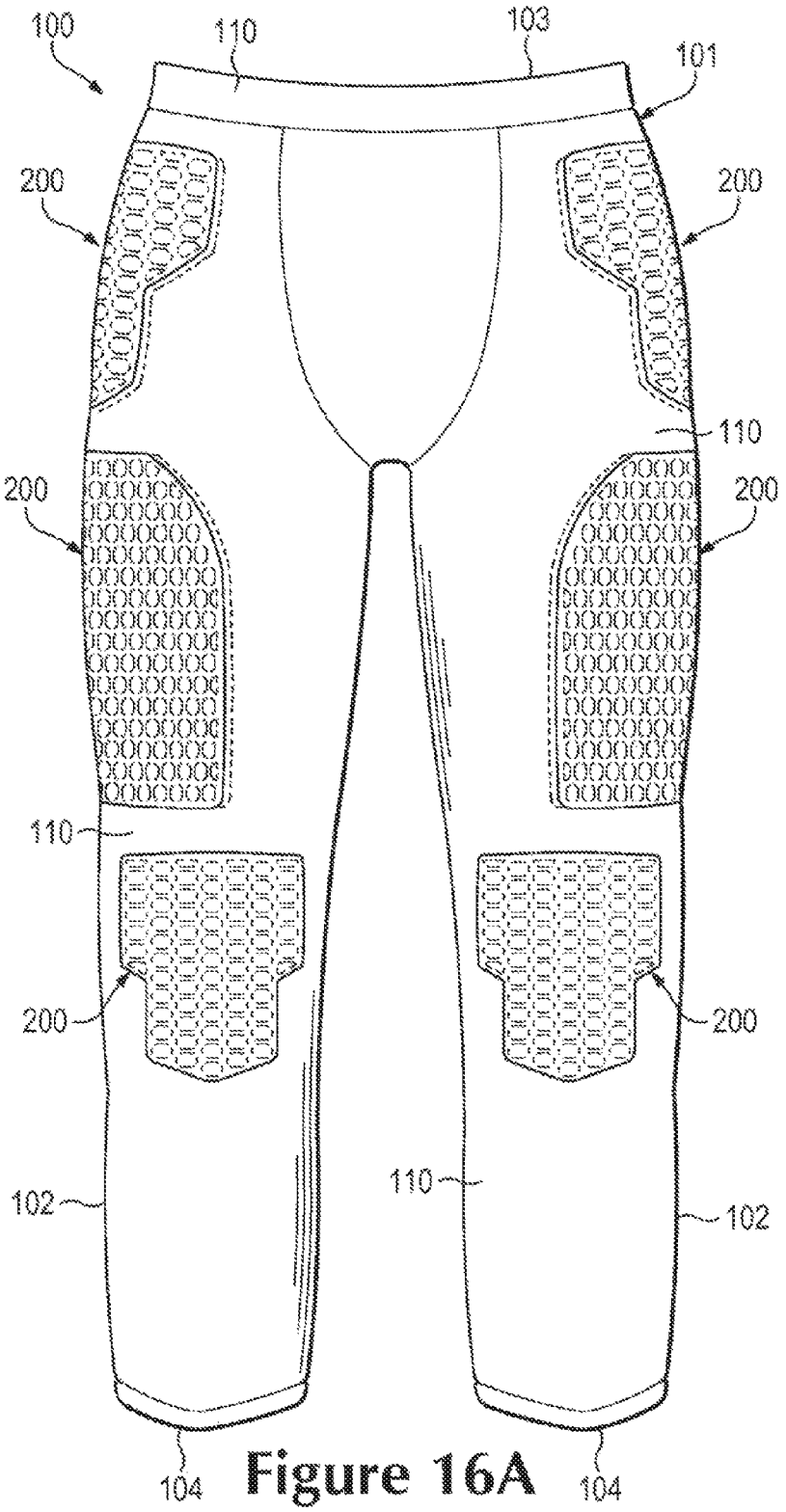
FIGS. 16A-16H are elevational views of additional articles of apparel incorporating the cushioning element.
Figure 16B:
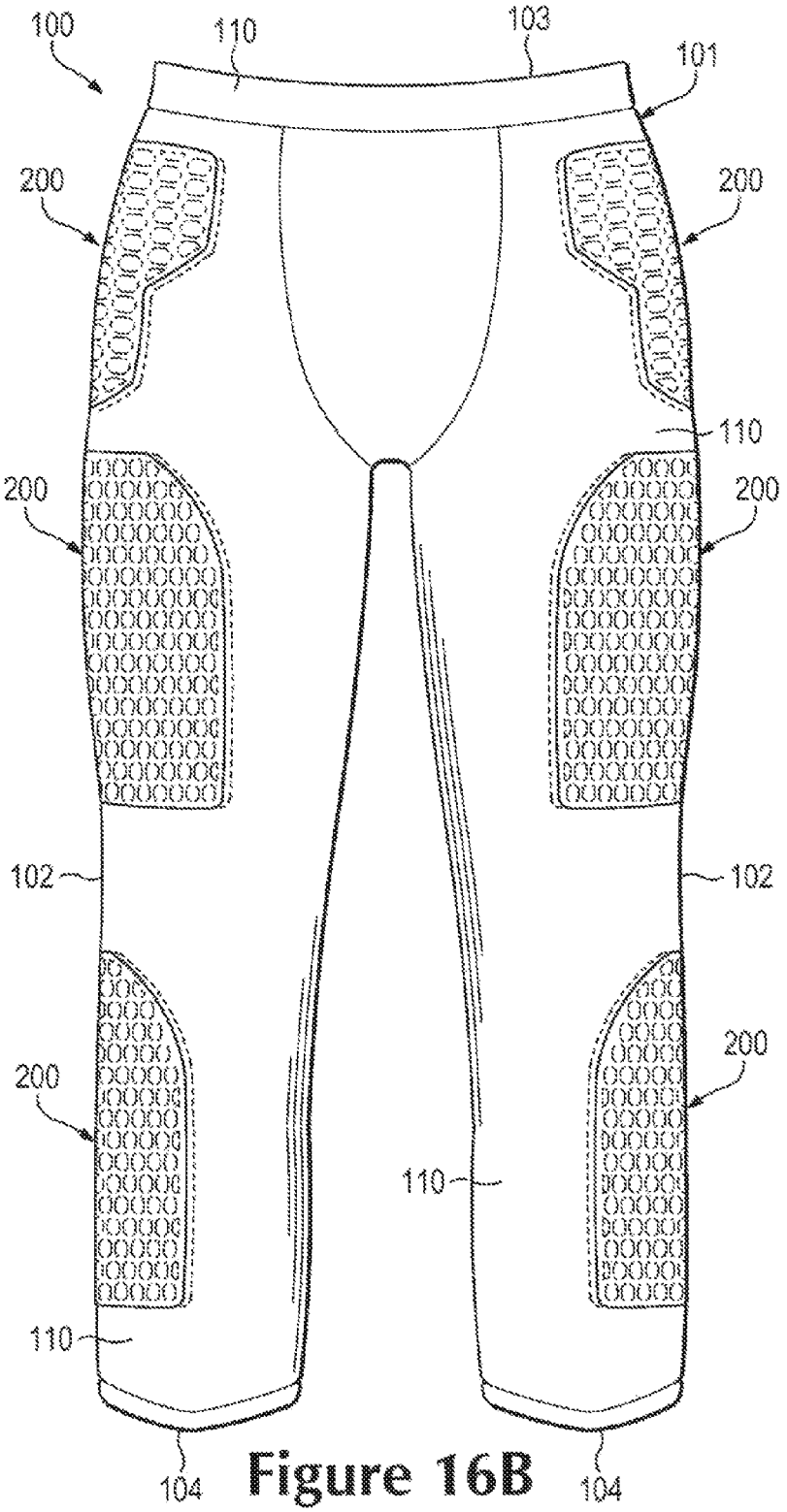

Apparel 100 is depicted in FIGS. 1-5 as having the general configuration of a shorts-type garment. Referring to FIG. 16A, leg regions 102 of apparel 100 extend downward to a greater degree, thereby imparting the configuration of a pants-type garment that includes additional cushioning elements 200 for the knees of individual 10. A similar configuration is depicted in FIG. 16B, wherein apparel 100 includes additional cushioning elements 200 for the ankles or lower legs of individual 10.

Figure 16C:
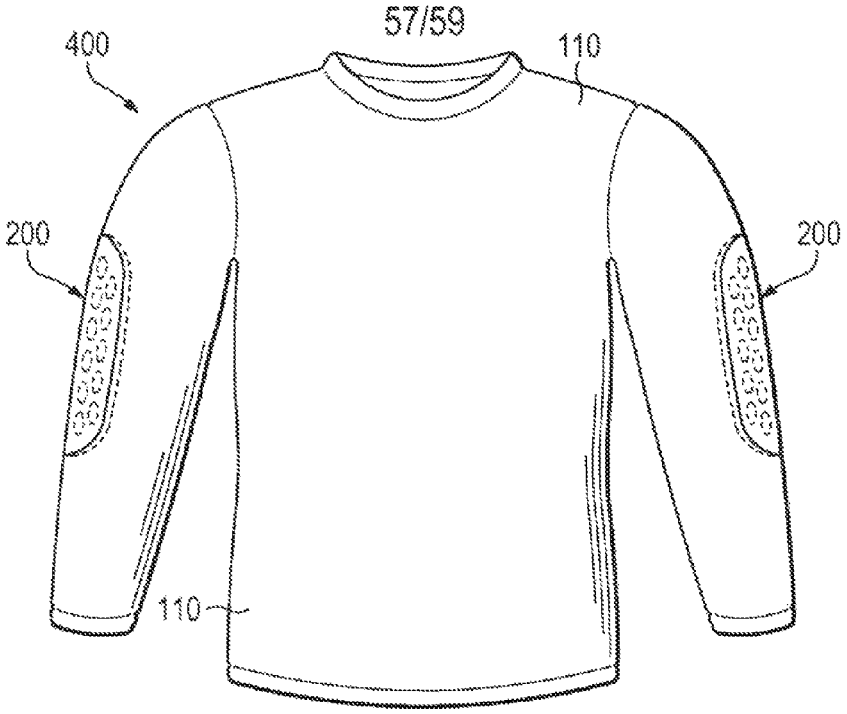
Figure 16D:
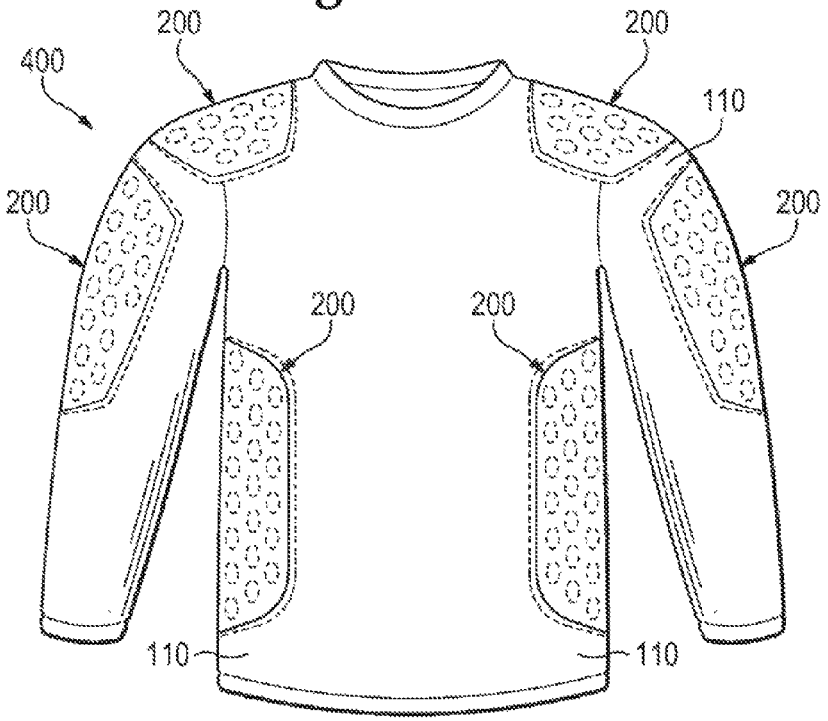

In addition to shorts-type garments and pants-type garments, a variety of other types of apparel may also incorporate cushioning elements 200 in any of the configurations discussed above. Referring to FIG. 16C, an article of apparel 400 having the configuration of a shirt-type garment is depicted as including two cushioning elements 200 in locations that correspond with elbows of a wearer. When worn, cushioning elements 200 may provide protection to the elbows. That is, cushioning elements 200 may attenuate impact forces upon the elbows. In addition to attenuating impact forces, cushioning elements 200 may also simultaneously provide one or more of breathability, flexibility, a relatively low overall mass, and launderability. Although apparel 400 is depicted as a long-sleeved shirt, apparel 400 may have the configuration of other shirt-type garments, including short-sleeved shirts, tank tops, undershirts, jackets, and coats, for example. Referring to FIG. 16D, apparel 400 is depicted as including six cushioning elements 200 in locations that correspond with elbows, shoulders, and sides of a wearer.

Figure 16E:
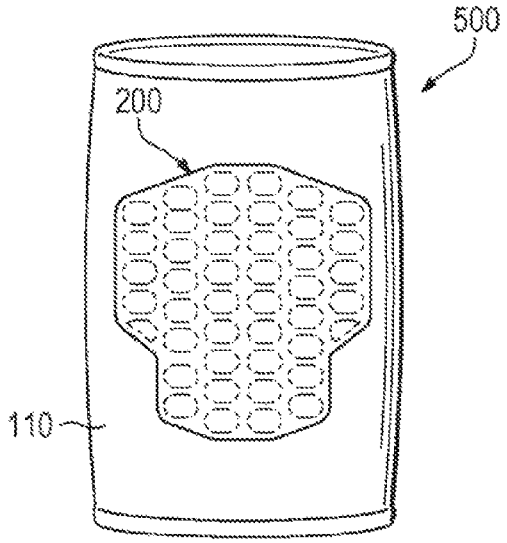
Figure 16F:
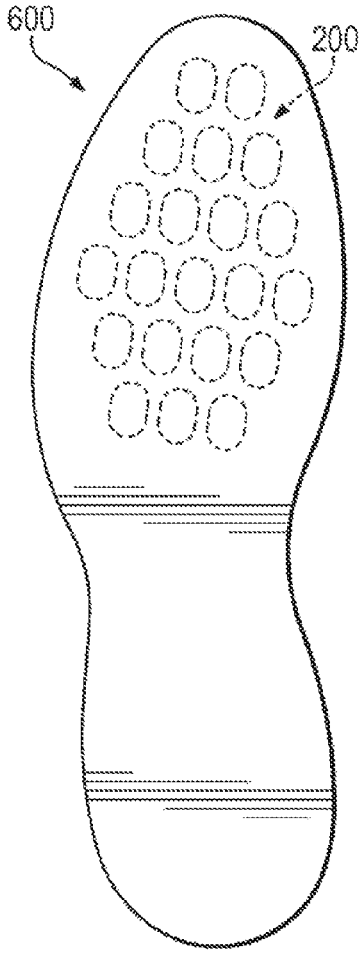
Figure 16G:
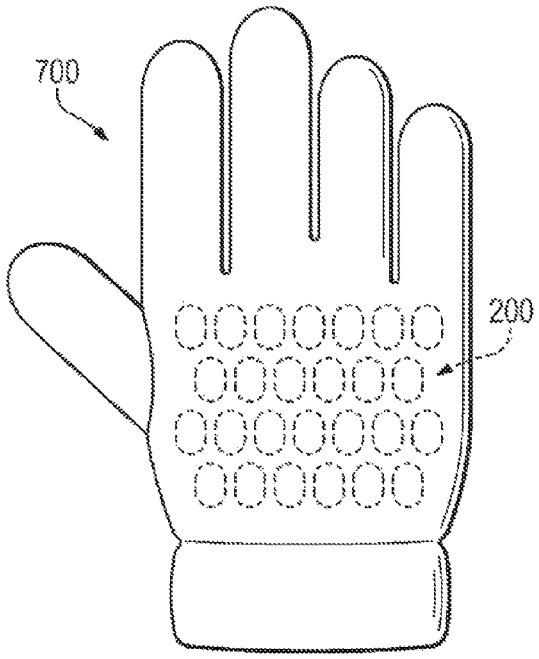
Figure 16H:
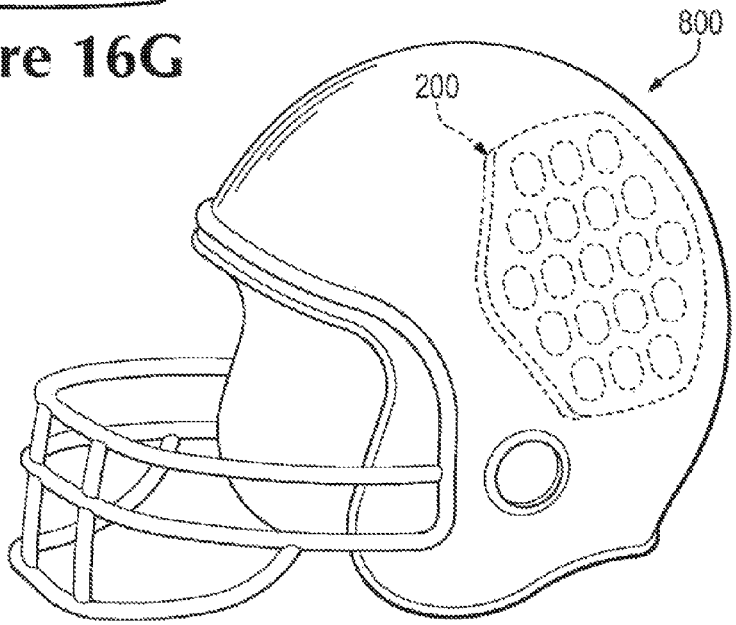

Cushioning elements 200 may also be incorporated into apparel that covers other areas of the wearer, such as hats, helmets, wraps, footwear, socks, and gloves, for example. As an example, a wrap 500 with one cushioning element 200 is depicted in FIG. 16E. Wrap 500 has a generally cylindrical configuration that may be placed upon an arm or a leg of a wearer. When, for example, the elbow is sore or injured, cushioning element 200 of wrap 500 may be located over the elbow to assist with protecting the elbow during athletic activities. As another example, a sockliner 600 that incorporates a cushioning element 200 is depicted in FIG. 16F. Sockliner 600 may be located within an article of footwear to cushion a lower (i.e., plantar) surface of the foot. Additionally, one or more cushioning elements 200 may be incorporated into a glove 700, as depicted in FIG. 16G, to impart protection to a hand of the wearer. One or more cushioning elements 200 may also be incorporated into a helmet 800, as depicted in FIG. 16H, to impart protection to a head of the wearer. In addition to attenuating impact forces, cushioning elements 200 in these configurations may also simultaneously provide one or more of breathability, flexibility, a relatively low overall mass, and launderability.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of apparel comprising:

a base layer having a first surface and an opposite second surface, the base layer defining an aperture extending through the base layer and form the first surface to the second surface; and a cushioning element having a first material layer, a second material layer, and at least one foam component, wherein the first material layer is in indirect contact with and secured to the second surface of the base layer, and wherein the second material layer is in indirect contact with and secured to the second surface of the base layer, wherein the first material layer and the second material layer are separated from the second surface of the base layer by a bonding layer, wherein the first material layer has an outermost edge and the second material layer has a length that extends beyond the outermost edge, and wherein the at least on foam component is located between and secured to the first material layer and the second material layer, and the at least one foam component is positioned to correspond with a location of the aperture.

2. The article of apparel recited in claim 1, further including a bonding element extending around the aperture, the bonding element securing the first material layer and the second material layer to the second surface of the base layer.

3. The article of apparel recited in claim 2, wherein the first material layer is joined to a portion of the bonding element that is positioned adjacent to the aperture, and the second material layer is joined to the a portion of the bonding element that is spaced from the aperture.

4. The article of apparel recited in claim 2, wherein the bonding element is located at an edge of the aperture.

5. The article of apparel recited in claim 2, wherein the bonding element includes a thermoplastic polymer material.

6. The article of apparel recited in claim 1, wherein the second material layer has a greater area than the first material layer.

7. The article of apparel recited in claim 1, wherein both the first material layer and the first surface of the base layer form a portion of an exterior surface of the apparel.

8. An article of apparel comprising:

a base layer having a first surface and an opposite second surface, the base layer defining an aperture extending through the base layer and from the first surface to the second surface;

a cushioning component having a first material layer, a second material layer, and at least one foam component; and a bonding element secured to the second surface of the base layer that extends continuously around the aperture, wherein the bonding element has a first side and an opposing second side, wherein the bonding element includes a first portion that is positioned adjacent to the aperture, and the bonding element includes a second portion that is spaced from the aperture, wherein the first portion and the second portion are continuous so that the bonding element extends uninterrupted from a position adjacent the aperture to an edge of the second portion, wherein the at least one foam component are located between and bonded to the first material layer and the second material layer, and the at least one foam component is positioned to correspond with a location of the aperture;

wherein the first material layer is in direct contact with the first portion of the bonding element on the first side of the bonding element and the second material layer is in direct contact with the second portion of the bonding element on the first side of the bonding element, and wherein the second surface of the base layer is in direct contact with the opposing second side of the bonding element;

wherein the first material layer has an outermost edge; and wherein the second material layer has a length that extends beyond the outermost edge of the first material layer.

9. The article of apparel recited in claim 8, wherein the bonding element is located at an edge of the aperture.

10. The article of apparel recited in claim 8, wherein the first material layer separates the bonding element from the second material layer adjacent the first portion of the bonding element.

11. The article of apparel recited in claim 8, wherein the second material layer has a greater area than the first material layer.

12. The article of apparel recited in claim 8, wherein both the first material layer and the first surface of the base layer form a portion of an exterior surface of the apparel.

13. An article of apparel comprising:

a base layer having a first surface and an opposite second surface;

an aperture defined by the base layer and extending from the first surface to the second surface through the base layer;

a bonding layer that extends around a perimeter of the aperture, wherein the bonding layer has a first side and an opposing second side; and a cushioning element including a first material layer, a second material layer, and at least one foam component, wherein the first material layer is secured to the second material layer to form a pocket between the first material layer and the second material layer;

wherein the at least one foam component is disposed within the pocket;

wherein the first side of the bonding layer is in direct contact with the first material layer and the second side of the bonding layer is in direct contact with the second surface of the base layer to secure the first material layer to the second surface of the base layer so that the first material layer is exposed through the aperture, wherein the first material layer has an outermost edge, wherein the second material layer has a length that extends beyond the outermost edge of the first material layer, and wherein the cushioning element is positioned to correspond with a location of the aperture so that the first material layer protrudes at least partially through the aperture.

14. The article of apparel recited in claim 13, wherein the first side of the bonding layer is in direct contact with the second material layer to secure the second material layer to the second surface of the base layer.

15. The article of apparel recited in claim 14, wherein the bonding layer comprises a first portion and a second portion, wherein the first portion is positioned adjacent the aperture and the second portion is spaced apart from the aperture.

16. The article of apparel recited in claim 15, wherein the second material layer has a greater area than the first material layer, and wherein the first portion secures the first material layer to the second surface and the second portion secures the second material layer to the second surface.

17. The article of apparel recited in claim 13, wherein the at least one foam component is positioned so that the perimeter of the aperture extends around the at least one foam component.

18. The article of apparel recited in claim 17, wherein the at least one foam component is positioned below the aperture when in a neutral position and extend at least partially through the aperture when subjected to a force.

19. The article of apparel recited in claim 18, wherein the force is exerted when the article of apparel is positioned on a user's body.

20. The article of apparel recited in claim 13, wherein the first material layer and the second material layer are selected so that the cushioning element is configured to increase the breathability of the article of apparel.

* * * * *